US007578735B2

(12) United States Patent
Frizzell et al.

(10) Patent No.: US 7,578,735 B2
(45) **Date of Patent: *Aug. 25, 2009**

(54) GAMING DEVICE HAVING A GAME INCLUDING A REARRANGEMENT PATH

(75) Inventors: Kelly D. Frizzell, Reno, NV (US); Karen M. Cregan, Reno, NV (US); Robert N. Silva, III, Reno, NV (US)

(73) Assignee: IGT, Reno, NV (US)

( * ) Notice: Subject to any disclaimer, the term of this patent is extended or adjusted under 35 U.S.C. 154(b) by 463 days.

This patent is subject to a terminal disclaimer.

(21) Appl. No.: 10/953,599

(22) Filed: Sep. 28, 2004

(65) Prior Publication Data

US 2005/0054436 A1 Mar. 10, 2005

Related U.S. Application Data

(63) Continuation-in-part of application No. 10/657,578, filed on Sep. 8, 2003, now Pat. No. 7,371,170.

(51) Int. Cl.
*A63F 13/00* (2006.01)

(52) U.S. Cl. ..... 463/20; 463/16; 463/21; 463/31; 273/138.1; 273/139

(58) Field of Classification Search ..... 273/138.1, 273/139, 142 B; 463/16, 19–23, 30–32
See application file for complete search history.

(56) References Cited

U.S. PATENT DOCUMENTS 1,978,395 A 10/1934 Groetchen
3,420,525 A 1/1969 Waders
3,642,287 A 2/1972 Lally et al.
3,735,987 A 5/1973 Ohki
4,089,524 A * 5/1978 Hauck ..... 463/15
4,326,351 A 4/1982 Heywood et al.

(Continued)

FOREIGN PATENT DOCUMENTS

EP 1 184 822 7/1982

(Continued)

OTHER PUBLICATIONS

Barn Yard Article, Aristocrat, Undated.

(Continued)

*Primary Examiner*—Peter DungBa Vo
*Assistant Examiner*—Arthur O. Hall
(74) *Attorney, Agent, or Firm*—K&L Gates LLP

(57) ABSTRACT

A gaming device and a method for operating a gaming device which increases the possibility of obtaining a winning combination of symbols on reels. In one embodiment, the gaming device rearranges one or more sets of indicated symbols on the reels to potentially generate additional combinations of symbols on a payline. In another embodiment, the gaming device rearranges one or more sets of symbols displayed along a rearrangement path to potentially generate additional combinations of symbols on a payline. The rearranged symbols may move to different reels and different paylines in the rearrangement. The gaming device, in one embodiment performs an evaluation of the rearranged symbols after each rearrangement to give each rearrangement a chance to generate a winning combination of symbols on the reels.

53 Claims, 38 Drawing Sheets

U.S. PATENT DOCUMENTS

| | | | | | |
|---|---|---|---|---|---|
| 4,611,811 | A * | 9/1986 | Haase | 463/19 |
| 4,695,053 | A | 9/1987 | Vazquez, Jr. et al. | |
| 5,152,529 | A | 10/1992 | Okada | |
| 5,364,100 | A | 11/1994 | Ludlow et al. | |
| 5,395,111 | A | 3/1995 | Inoue | |
| 5,449,173 | A | 9/1995 | Thomas et al. | |
| 5,584,764 | A | 12/1996 | Inoue | |
| 5,664,998 | A | 9/1997 | Seelig et al. | |
| 5,722,891 | A * | 3/1998 | Inoue | 463/20 |
| 5,752,881 | A | 5/1998 | Inoue | |
| 5,769,716 | A | 6/1998 | Saffari et al. | |
| 5,833,536 | A | 11/1998 | Davids et al. | |
| 5,882,259 | A | 3/1999 | Holmes, Jr. et al. | |
| 5,984,782 | A | 11/1999 | Innoue | |
| 5,997,400 | A | 12/1999 | Seelig et al. | |
| 5,997,401 | A | 12/1999 | Crawford | |
| 6,033,307 | A | 3/2000 | Vancura | |
| 6,056,642 | A | 5/2000 | Bennett | |
| 6,059,289 | A | 5/2000 | Vancura | |
| 6,086,066 | A | 7/2000 | Tekeuchi et al. | |
| 6,089,976 | A | 7/2000 | Schneider et al. | |
| 6,089,977 | A * | 7/2000 | Bennett | 463/20 |
| 6,120,031 | A | 9/2000 | Adams | |
| 6,120,376 | A | 9/2000 | Bennett | |
| 6,135,885 | A | 10/2000 | Lermusiaux | |
| 6,142,875 | A | 11/2000 | Kodachi et al. | |
| 6,270,411 | B1 | 8/2001 | Gura et al. | |
| 6,290,600 | B1 | 9/2001 | Glasson | |
| 6,315,663 | B1 | 11/2001 | Sakamoto | |
| 6,316,663 | B1 | 11/2001 | Sakamoto | |
| 6,319,124 | B1 | 11/2001 | Baerlocher et al. | |
| 6,364,766 | B1 * | 4/2002 | Anderson et al. | 463/16 |
| 6,551,187 | B1 * | 4/2003 | Jaffe | 463/20 |
| 6,554,704 | B2 * | 4/2003 | Nicastro et al. | 463/20 |
| 6,561,900 | B1 * | 5/2003 | Baerlocher et al. | 463/20 |
| 6,589,114 | B2 * | 7/2003 | Rose | 463/20 |
| 6,602,136 | B1 * | 8/2003 | Baerlocher et al. | 463/16 |
| 6,659,864 | B2 | 12/2003 | McGahn et al. | |
| 6,676,512 | B2 | 1/2004 | Fong et al. | |
| 6,786,820 | B2 * | 9/2004 | Gerrard et al. | 463/20 |
| 6,855,054 | B2 * | 2/2005 | White et al. | 463/21 |
| 6,905,405 | B2 * | 6/2005 | McClintic | 463/16 |
| 6,908,383 | B2 | 6/2005 | Baerlocher et al. | |
| 6,988,947 | B2 * | 1/2006 | Baerlocher et al. | 463/20 |
| 7,070,502 | B1 | 7/2006 | Bussick et al. | |
| 7,195,559 | B2 * | 3/2007 | Gilmore et al. | 463/20 |
| 7,445,547 | B2 * | 11/2008 | Suzuki | 463/16 |
| 2002/0010018 | A1 * | 1/2002 | Lemay et al. | 463/20 |
| 2002/0016200 | A1 * | 2/2002 | Baerlocher et al. | 463/20 |
| 2003/0092480 | A1 * | 5/2003 | White et al. | 463/20 |
| 2003/0104855 | A1 * | 6/2003 | McClintic | 463/16 |
| 2004/0012145 | A1 | 1/2004 | Inoue | |
| 2004/0014516 | A1 | 1/2004 | Inoue | |
| 2004/0014517 | A1 | 1/2004 | Inoue | |
| 2004/0018866 | A1 | 1/2004 | Inoue | |
| 2004/0026854 | A1 | 2/2004 | Inoue | |
| 2004/0036218 | A1 | 2/2004 | Inoue | |
| 2004/0038726 | A1 | 2/2004 | Inoue | |
| 2004/0097280 | A1 * | 5/2004 | Gauselmann | 463/16 |
| 2005/0051952 | A1 * | 3/2005 | Jackson | 273/138.1 |
| 2005/0164774 | A1 | 7/2005 | Gauselmann | |
| 2007/0178965 | A1 * | 8/2007 | Inoue | 463/30 |

FOREIGN PATENT DOCUMENTS

| | | | |
|---|---|---|---|
| EP | 0 060 019 | | 9/1982 |
| EP | 1 083 531 | | 3/2001 |
| EP | 1 205 894 | A2 | 10/2001 |
| EP | 1422673 | A | 5/2004 |
| GB | EP0060019 | A1 * | 1/1982 |
| GB | 2 081 952 | | 2/1982 |
| GB | 2 090 690 | A | 7/1982 |
| GB | 2 096 376 | A | 10/1982 |
| GB | 2 097 160 | A | 10/1982 |
| GB | 2 100 905 | A | 1/1983 |
| GB | 2 105 891 | A | 3/1983 |
| GB | 2 113 881 | A | 8/1983 |
| GB | 2 117 155 | A | 10/1983 |
| GB | 2 137 392 | A | 10/1984 |
| GB | 2 161 008 | A | 1/1986 |
| GB | 2 170 643 | A | 8/1986 |
| GB | 2 181 589 | A | 4/1987 |
| GB | 2 183 882 | A | 6/1987 |
| GB | 2 191 030 | A | 12/1987 |
| GB | 2 222 712 | A | 3/1990 |
| GB | 2 225 889 | A | 6/1990 |
| GB | 2 226 436 | A | 6/1990 |
| GB | 2 242 300 | A | 9/1991 |
| GB | 2 262 642 | A | 6/1993 |
| GB | 2 372 132 | | 8/2002 |
| WO | W0 9732285 | | 9/1997 |
| WO | WO 03/026756 | A1 | 4/2003 |

OTHER PUBLICATIONS

Barn Yard Article, Strictly Slots, Mar. 2002.
Cash Chameleon Advertisement, Aristocrat, Jan. 2000.
Description of Animating Symbol Features in Gaming Machine, IGT, Jan. 2000.
Description of Expanding Symbol, IGT, Sep. 1999.
Description of Gaming Machine with Animating Symbols, IGT, Jan. 2000.
Description of Symbol Feature in Australian UFO Gaming Machine, Barcrest, Ltd., 1995.
Description of Traveling Symbols, IGT, Sep. 1999.
Ghoulish Gamble Article, Strictly Slots, Sep. 2000.
Gold Fever Advertisement, Atronic Casino Technology, Ltd., 1999.
Gold Fever Atronic Webpage, Atronic Casino Technology, Ltd., Mar. 2002.
Goooaal!, pp. 1-2, Bally Gaming, Inc., Dec. 2000.
Mystery Mine Advertisement, Konami Australia Pty, Ltd., Jan. 1999.
Office action dated Apr. 9, 2007 for U.S. Appl. No. 10/657,578.
South Park Advertisement, IGT, Sep. 1999.

* cited by examiner

GAMING DEVICE HAVING A GAME INCLUDING A REARRANGEMENT PATH

PRIORITY CLAIM

This application is a continuation-in-part of and claims the benefit of U.S. patent application Ser. No. 10/657,578 filed on Sep. 8, 2003 now U.S. Pat. No. 7,371,170, the entire contents of which are incorporated herein.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND OF THE INVENTION

The present invention relates in general to a gaming device, and more particularly, to a gaming device with multiple symbols in different display positions which swap with one another upon a triggering event in a game. Gaming device manufacturers provide gaming machines having a plurality of reels, each reel including a plurality of symbols. In a reel game, the player causes the reels to spin by placing a wager on the game. The reels spin and then stop to display a generated combination of symbols on the reels. If a generated symbol or combination of symbols appears along an active payline associated with the reels or in a scatter pay, and the symbol or the combination of symbols corresponds to, or is associated with, an award, the player receives the award associated with the winning symbol or combination of symbols. It can be frustrating for a player to "almost win an award" when the symbols necessary for a winning combination appear together on the reels but are not in the proper configuration or order to produce a winning combination. One popular game feature which attempts to rectify the player's frustration in such a situation and increase the player's award opportunities is commonly referred to as a nudge feature or option. A nudge occurs after the reels initially spin and stop allowing the game or the player to move the reels through a limited rotation from a first or non-winning to a second and possibly winning position (to effect a winning combination or align a winning combination on an active payline).

In other games, the symbols are moved more than just a vertical nudge along the rotational path of the reels. U.K. Patent No. GB2,097,160, discloses a game wherein the player or the game switches the places of two entire reels. U.S. Pat. No. 6,089,977 discloses a game including a wild symbol which replaces a predetermined number of symbols on the reels to form different symbol combinations which include the wild symbol.

There is therefore a need for other ways of manipulating the position of symbols on the reels to create winning combinations on the reels. There is also a need for new and different games which employ reels.

SUMMARY OF THE INVENTION

The present invention provides a gaming device which performs a series of rearrangements of symbols and determines whether a winning combination of symbols exists after each rearrangement. In one embodiment, the gaming device includes multiple fixed positions, symbol display positions or defined areas on portions of the reels in which a plurality of symbols are displayed after the reels stop spinning or after an activation of the reels. In one embodiment, the reels include a plurality of swapping indicators associated with the plurality of the symbols on the reels.

Each reel spins independently of the other reels coming to a stop or a stop position to establish a first position for each of the symbols. The spinning or activation of the reels, in one embodiment, establishes a first position of the symbols in the fixed positions on the reels. The gaming device, in one embodiment, first determines if a winning combination has occurred along one or more of the paylines. If no winning combination exists, or, alternatively, after an award for a winning combination is provided to the player, the gaming device determines if a plurality of symbols are indicated on the reels.

In one embodiment, if a predetermined number of swapping indicators associated with a plurality of the generated symbols line up, match one another, are adjacent to one another or, alternatively, form a predetermined configuration on the display, a set of indicated symbols is identified, and the gaming device initiates a symbol swapping rearrangement of the set of indicated symbols. In one embodiment, the swapping indicators associated with symbols on adjacent reels must align with one another to initiate a rearrangement.

The symbol swapping rearrangement, in one embodiment, includes moving the symbols associated with the swapping indicators to a different fixed position and, in one embodiment, to the fixed positions of the other symbols which are swapped. In one embodiment, a plurality of symbols above or below or beside one another exchange positions with one another. A symbol can traverse or cross over to another payline or another reel, or another position on the same reel. A symbol is thus able to move from one position on the reel to another position on the same reel. Alternatively, or in addition, a symbol is able to move to an adjacent or different reel. In one embodiment, the rearrangement includes rotating the indicated symbols in a counter-clockwise fashion on the reels. Alternatively, the symbols can rotate in a clockwise direction. It should be appreciated that any suitable movement of a symbol in the indicated set to any fixed position or position previously occupied by one of the other symbols in the set is contemplated by the present invention.

In one embodiment of the present invention, a predetermined configuration of swapping indicators associated with four symbols triggers a rearrangement of those symbols on the reels. Two of the four symbols appear together on a first reel and are adjacent to the other two symbols which appear together on a second reel. Upon the initiation of a rearrangement, the four symbols, in one embodiment, each rotate in a clockwise or counterclockwise fashion. One symbol moves down the reel into the position of a second symbol; the second symbol moves to the adjacent reel to the position of a third symbol; the third symbol moves in an upward direction to replace the fourth symbol on the same reel; and the fourth symbol moves to the position of the first symbol. It should be appreciated that the rearrangement of the symbols can vary in direction, sequence, and in the number of positions moved.

In one embodiment, after each symbol swapping rearrangement, the gaming device determines if a winning combination has occurred on the reels such as along one or more paylines as a result of the rearrangement. In one embodiment, the player receives any award or outcome associated with a winning combination comprising the rearranged symbols. In one embodiment, the gaming device continues to rotate or rearrange the symbols and to reevaluate the existence of any other winning combinations. It should be appreciated that the rearrangement can occur a plurality of times, and the player, in one embodiment, may receive the awards associated with each of the winning combinations generated by the rearrangement of the symbols. Alternatively, the gaming device rearranges the symbols until a winning combination of symbols is generated.

In one embodiment, the indicated symbols continue to undergo a symbol swapping rearrangement until all predetermined symbol combinations of the indicated symbols are generated or until, as in one embodiment, each of the indicated symbols are rearranged to their original positions. Alternatively, in an embodiment in which the symbol swapping indicators are associated with the symbols, the indicated symbols are rearranged only if a triggering configuration of the swapping indicators occurs with each rearrangement.

It should also be appreciated that multiple rearrangements or rotations can occur when more than one set of swapping indicators align to trigger a rearrangement or rotation as a result of the initial spin of the reels or any subsequent rearrangement of indicated symbols. In an embodiment in which the symbol swapping indicators are associated with each of the symbols, rearrangement of the indicated symbols may position the symbol swapping indicators in a configuration which indicates another set of symbols.

In one embodiment in which multiple sets of symbols are simultaneously indicated for rearrangement, the predetermined symbol combinations of the rearranged symbols of one set of indicated symbols are evaluated before the rearrangement of another set of indicated symbols occurs. In one embodiment, this evaluation occurs after each rearrangement of the indicated symbols in that set. Alternatively, an evaluation occurs after each set of indicated symbols undergoes at least one rearrangement. In a further alternative embodiment, an evaluation occurs between the rearrangement of the indicated symbols of one set and the rearrangement of the indicated symbols of another set in an alternating fashion. It should be appreciated that an evaluation of the rearranged indicated symbols for a winning combination of symbols can occur at any suitable time and with any suitable frequency as desired by the implementer of the gaming device.

In an alternative embodiment, one or more rearrangements of symbols occur if the gaming device determines that a symbol swapping triggering symbol such as a wild symbol or a symbol swapping triggering combination of symbols has been generated on the reels. In one embodiment, the symbol swapping triggering symbol or combination of symbols must occur at a predetermined fixed position or at a plurality of predetermined fixed positions.

It should be appreciated that each of the fixed positions can be an independent reel wherein symbols are generated at each of the fixed positions independent of the other symbols generated at the other fixed positions. Independent reels are described in U.S. Pat. No. 6,413,162. It should be appreciated that in embodiments including independent reels, the fixed positions can be arranged in any suitable linear or non-linear matrix or configuration.

It should also be appreciated that the symbol swapping rearrangement can occur in other types of games displaying multiple symbols such as the rearrangement of the hidden symbols associated with a displayed symbol in gaming devices having symbol stacks as described in U.S. Published Application No. 2004/0023714 A1.

The symbol swapping rearrangement includes a multi-position movement or movement of each of a plurality of symbols to a non-adjacent fixed position. For example, in one embodiment, the symbol swapping rearrangement includes moving each rearranged symbol at least two positions from its original fixed position.

In one embodiment, the symbol swapping triggering symbol or combination of symbols remain fixed or locked throughout the rearrangement. In one embodiment, if a symbol swapping triggering symbol or combination of symbols is generated at at least one fixed position having other fixed positions adjacently arranged on a plurality of or all sides of that fixed position, the gaming device initiates a symbol swapping rearrangement of the symbols at fixed positions around or surrounding the fixed position occupied by the triggering symbol or symbols. In one embodiment, each of the symbols displayed at rearrangement positions move to each of those rearrangement positions for one rearrangement. In another embodiment, if a symbol swapping triggering symbol or combination of symbols is generated at at least one fixed position having other fixed positions adjacently arranged on a plurality of or all sides of the fixed position, the gaming device initiates a symbol swapping rearrangement of the symbols displayed on fixed positions of the perimeter of the plurality of fixed positions or the outermost fixed positions on the display.

In one embodiment, the symbol swapping rearrangement includes movement in a clockwise direction of the symbols to the fixed positions around or surrounding the fixed position occupied by the triggering symbol or symbols. Alternatively, the symbol swapping rearrangement includes movement in a counter-clockwise direction.

Alternatively, the symbol swapping triggering symbol or combination of symbols generated on the display are included in the rearrangement. In one embodiment including rows and columns of fixed positions, if a symbol swapping triggering symbol or combination of symbols is generated, the gaming device initiates a symbol swapping rearrangement which shifts the symbols across a row, left or right, and up or down a column in a snake-like pattern. In another embodiment, the symbols can switch or swap positions with a symbol in an adjacent fixed position or non-adjacent fixed position upon the generation of a symbol swapping triggering symbol or combination of symbols.

It should be appreciated that the symbol swapping rearrangement can include multiple combinations of symbol movement as described above as part of a single movement sequence or rearrangement. In other words, it is contemplated by the present invention to move the symbols in different patterns, different directions, different numbers of positions, etc. within the same symbol swapping rearrangement. The rearrangements can be random or predetermined.

In one embodiment, the gaming device determines if a winning combination has occurred such as along one or more paylines after each symbol swapping rearrangement. Alternatively, the symbols are rearranged a predetermined number of times before the gaming device determines if a winning combination has occurred on the reels.

In one embodiment, the player receives any award or outcome associated with at least one winning combination comprising the rearranged symbols. In another embodiment, the symbol swapping triggering symbols themselves are also included in the winning combinations.

In one embodiment, the symbols are rearranged a predetermined number of times. Alternatively, the symbols continue to undergo a symbol swapping rearrangement until all predetermined symbol combinations of the symbols are generated or until, as in one embodiment, each of the symbols are rearranged to their originally generated positions. In one embodiment, the gaming device rearranges the symbols until a designated number such as one or more winning combination of symbols is generated. In one embodiment, the symbols continue to undergo a symbol swapping rearrangement even if a winning combination occurs as a result of the symbol swapping rearrangement or the player has received an award or outcome associated with a winning combination. It should be appreciated that the rearrangement can occur a plurality of times, and the player can receive the awards associated with each of the winning combinations generated by the rearrangement of the symbols.

It is therefore an advantage of the present invention to add a feature to a gaming device which provides increased excitement and enjoyment to the player.

A further advantage of the present invention to provide a gaming device which increases the chances of a player obtaining an award.

It is also an advantage of the present invention to selectively rearrange symbols to increase the likelihood of forming a winning combination of symbols.

It is an advantage of the present invention to provide a reel game that generates multiple combinations of symbols with each spin of the reels.

It is an advantage of the present invention to provide a reel game having symbols which can change reels to potentially form a winning combination.

Other objects, features and advantages of the invention will be apparent from the following detailed disclosure, taken in conjunction with the accompanying sheets of drawings, wherein like numerals refer to like parts elements, components, steps and processes.

DETAILED DESCRIPTION OF THE INVENTION

Gaming Device and Electronics

Figure 1A:
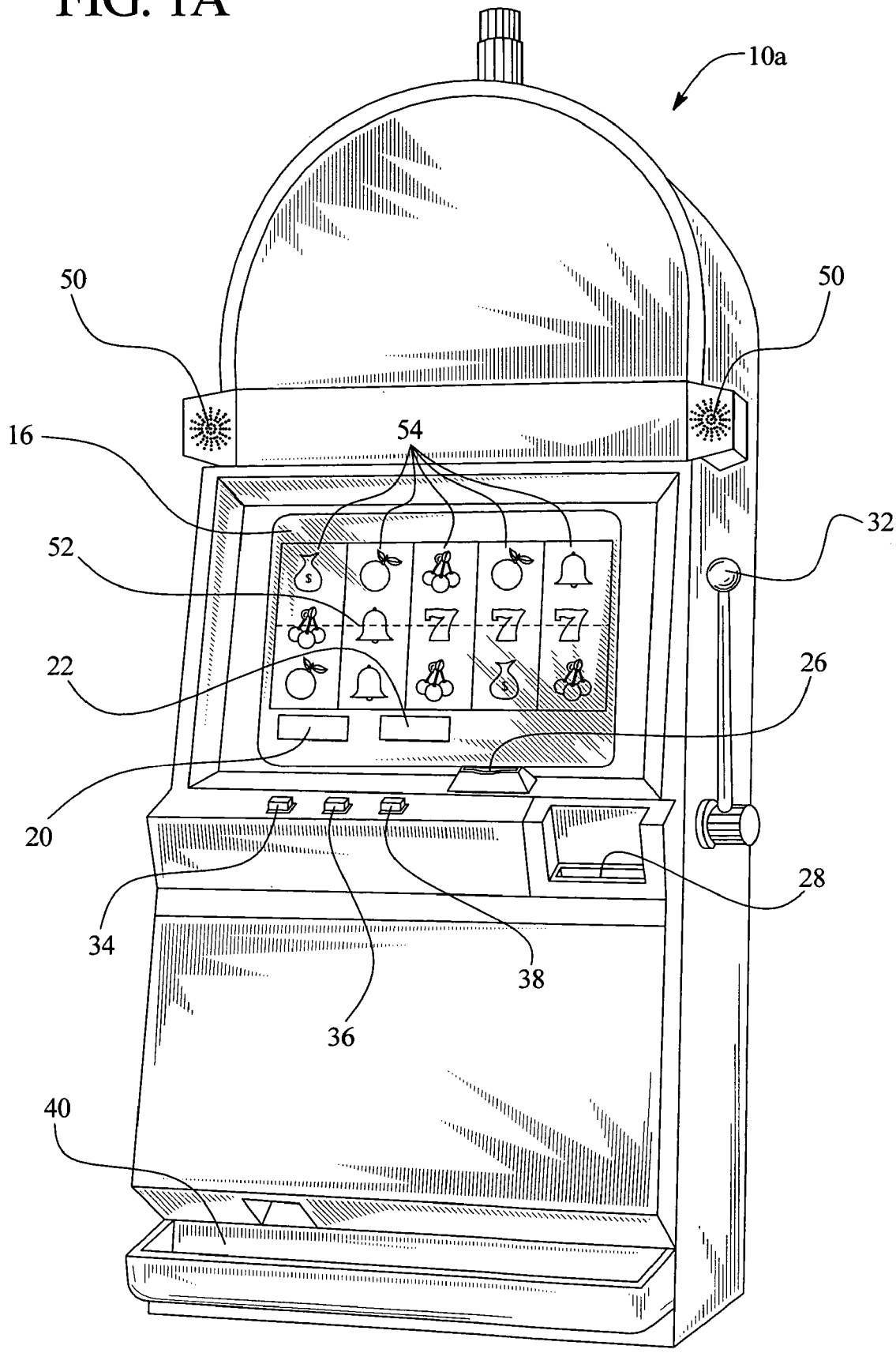
FIG. 1A is a front perspective view of one embodiment of the gaming device of the present invention.
Figure 1B:
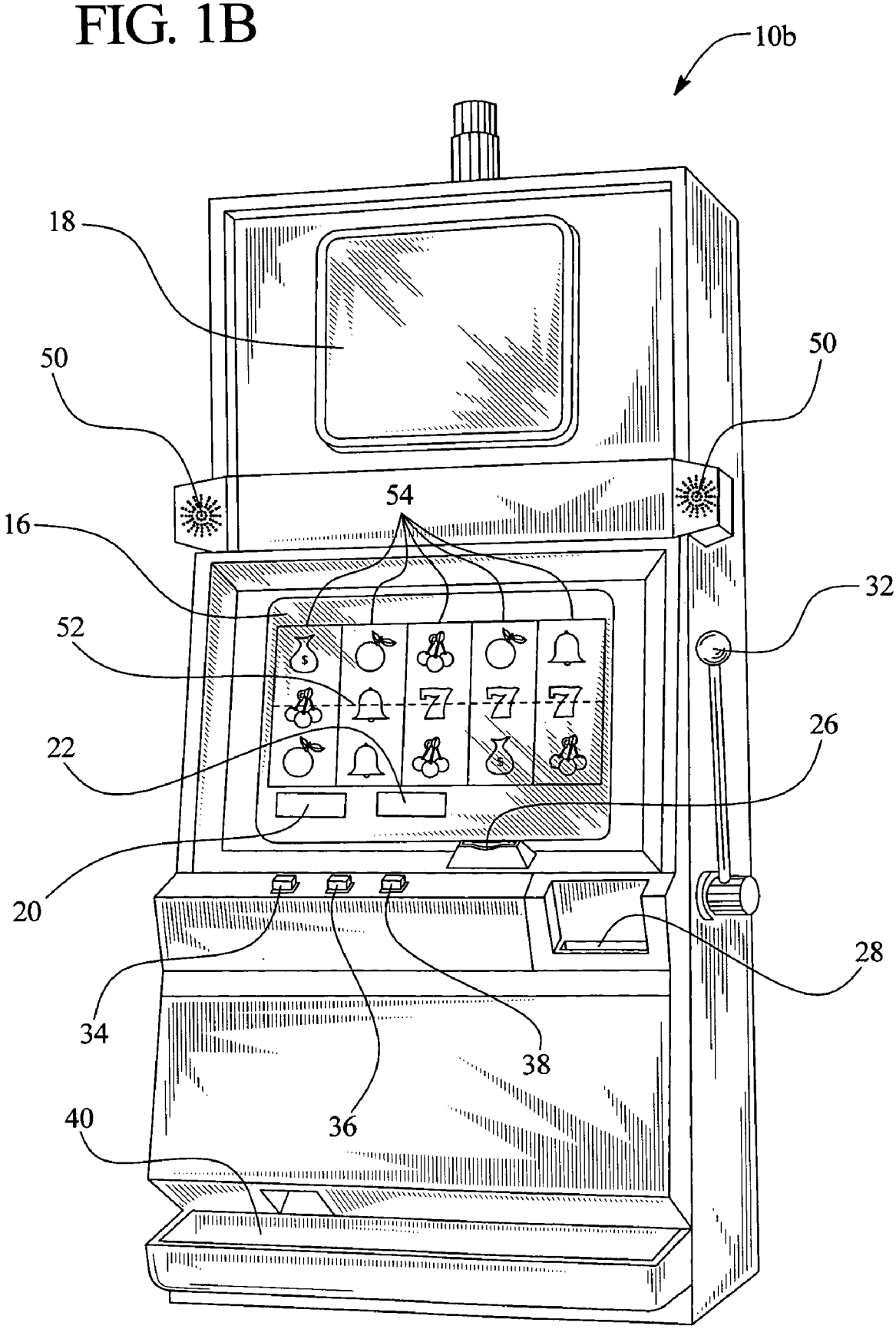
FIG. 1B is a front perspective view of another embodiment of the gaming device of the present invention.

Referring now to the drawings, two alternative embodiments of the gaming device of the present invention are illustrated in FIGS. 1A and 1B as gaming device 10*a* and gaming device 10*b*, respectively. Gaming device 10*a* and/or gaming device 10*b* are generally referred to herein as gaming device 10.

In one embodiment, as illustrated in FIGS. 1A and 1B, gaming device 10 has a support structure, housing or cabinet which provides support for a plurality of displays, inputs, controls and other features of a conventional gaming machine. It is configured so that a player can operate it while standing or sitting. The gaming device may be positioned on a base or stand or can be configured as a pub-style table-top game (not shown) which a player can operate preferably while sitting. As illustrated by the different configurations shown in FIGS. 1A and 1B, the gaming device can be constructed with varying cabinet and display configurations.

Figure 2A:
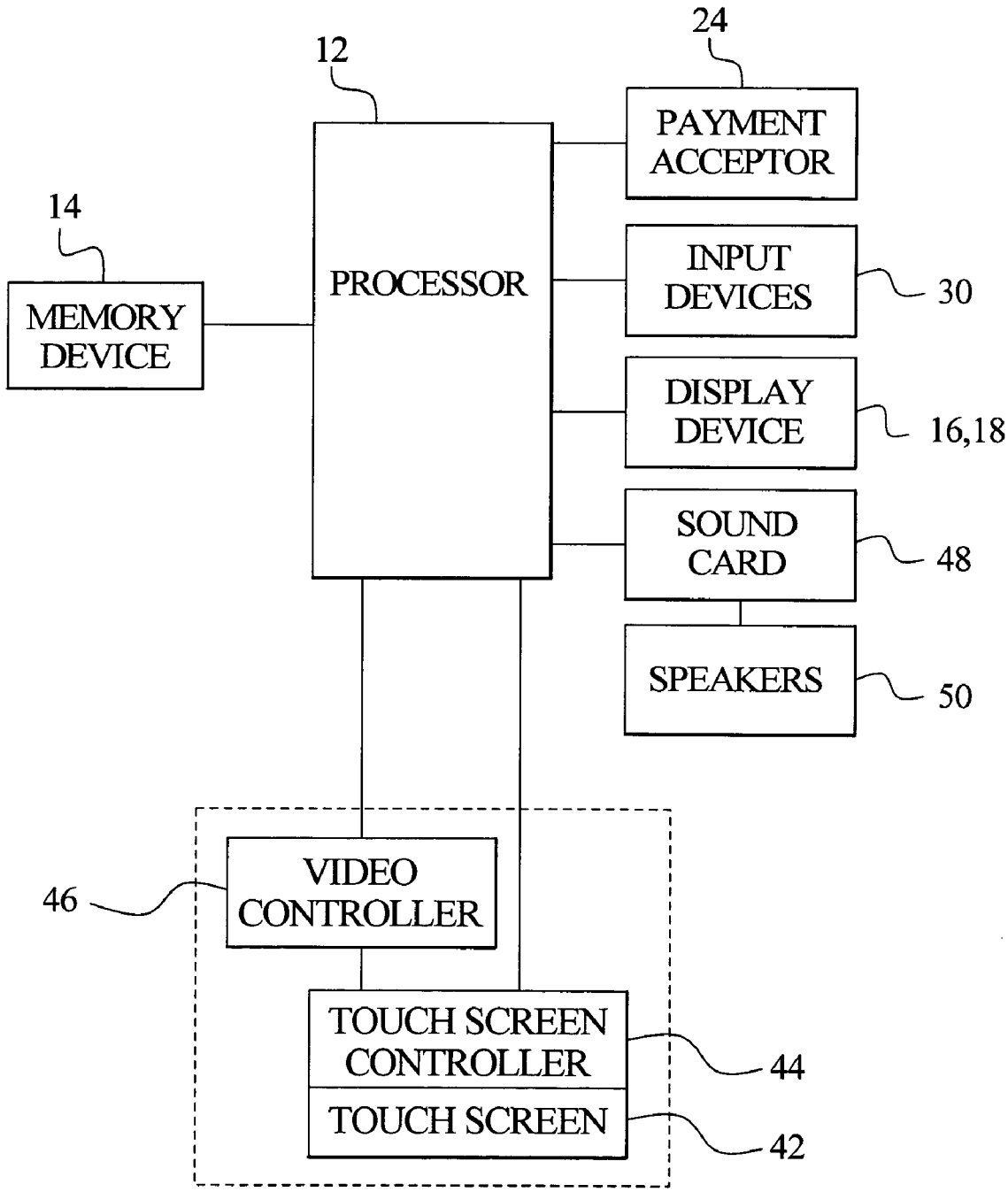
FIG. 2A is a schematic block diagram of the electronic configuration of one embodiment of the gaming device of the present invention.

In one embodiment, as illustrated in FIG. 2A, the gaming device preferably includes at least one processor 12, such as a microprocessor, a microcontroller-based platform, a suitable integrated circuit or one or more application-specific integrated circuits (ASIC's). The processor is in communication with or operable to access or to exchange signals with at least one data storage or memory device 14. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or information and applicable game rules that relate to the play of the gaming device. In one embodiment, the memory device includes random access memory (RAM). In one embodiment, the memory device includes read only memory (ROM). In one embodiment, the memory device includes flash memory and/or EEPROM (electrically erasable programmable read only memory). Any other suitable magnetic, optical and/or semiconductor memory may be implemented in conjunction with the gaming device of the present invention.

In one embodiment, part or all of the program code and/or operating data described above can be stored in a detachable or removable memory device, including, but not limited to, a suitable cartridge, disk or CD ROM. A player can use such a removable memory device in a desktop, a laptop personal computer, a personal digital assistant (PDA) or other computerized platform. The processor and memory device may be collectively referred to herein as a "computer" or "controller."

In one embodiment, as discussed in more detail below, the gaming device randomly generates awards and/or other game outcomes based on probability data. That is, each award or other game outcome is associated with a probability and the gaming device generates the award or other game outcome to be provided to the player based on the associated probabilities. In this embodiment, since the gaming device generates outcomes randomly or based upon a probability calculation, there is no certainty that the gaming device will ever provide the player with any specific award or other game outcome.

In another embodiment, as discussed in more detail below, the gaming device employs a predetermined or finite set or pool of awards or other game outcomes. In this embodiment, as each award or other game outcome is provided to the player, the gaming device removes the provided award or other game outcome from the predetermined set or pool. Once removed from the set or pool, the specific provided award or other game outcome cannot be provided to the player again. This type of gaming device provides players with all of the available awards or other game outcomes over the course of the play cycle and guarantees the amount of actual wins and losses.

In one embodiment, as illustrated in FIG. 2A, the gaming device includes one or more display devices controlled by the processor. The display devices are preferably connected to or mounted to the cabinet of the gaming device. The embodiment shown in FIG. 1A includes a central display device 16 which displays a primary game. This display device may also display any secondary game associated with the primary game as well as information relating to the primary or secondary game. The alternative embodiment shown in FIG. 1B includes a central display device 16 and an upper display device 18. The upper display device may display the primary game, any suitable secondary game associated with the primary game and/or information relating to the primary or secondary game. As seen in FIGS. 1A and 1B, in one embodiment, gaming device includes a credit display 20 which displays a player's current number of credits, cash, account balance or the equivalent. In one embodiment, gaming device includes a bet display 22 which displays a player's amount wagered.

The display devices may include, without limitation, a monitor, a television display, a plasma display, a liquid crystal display (LCD) a display based on light emitting diodes (LED) or any other suitable electronic device or display mechanism. In one embodiment, as described in more detail below, the display device includes a touch-screen with an associated touch-screen controller. The display devices may be of any suitable configuration, such as a square, rectangle, elongated rectangle.

The display devices of the gaming device are configured to display at least one and preferably a plurality of game or other suitable images, symbols and indicia such as any visual representation or exhibition of the movement of objects such as mechanical, virtual or video reels and wheels, dynamic lighting, video images, images of people, characters, places, things and faces of cards, tournament advertisements and the like.

In one alternative embodiment, the symbols, images and indicia displayed on or of the display device may be in mechanical form. That is, the display device may include any electromechanical device, such as one or more mechanical objects, such as one or more rotatable wheels, reels or dice, configured to display at least one and preferably a plurality of game or other suitable images, symbols or indicia.

As illustrated in FIG. 2A, in one embodiment, the gaming device includes at least one payment acceptor 24 in communication with the processor. As seen in FIGS. 1A and 1B, the payment acceptor may include a coin slot 26 and a payment, note or bill acceptor 28, where the player inserts money, coins or tokens. The player can place coins in the coin slot or paper money, ticket or voucher into the payment, note or bill acceptor. In other embodiments, devices such as readers or validators for credit cards, debit cards or credit slips could be used for accepting payment. In one embodiment, a player may insert an identification card into a card reader of the gaming device. In one embodiment, the identification card is a smart card having a programmed microchip or a magnetic strip coded with a player's identification, credit totals and other relevant information. In one embodiment, money may be transferred to a gaming device through electronic funds transfer. When a player funds the gaming device, the processor determines the amount of funds entered and the corresponding amount is shown on the credit or other suitable display as described above.

As seen in FIGS. 1A, 1B and 2A, in one embodiment the gaming device includes at least one and preferably a plurality of input devices 30 in communication with the processor. The input devices can include any suitable device which enables the player to produce an input signal which is read by the processor. In one embodiment, after appropriate funding of the gaming device, the input device is a game activation device, such as a pull arm 32 or a play button 34 which is used by the player to start any primary game or sequence of events in the gaming device. The play button can be any suitable play activator such as a bet one button, a max bet button or a repeat the bet button. In one embodiment, upon appropriate funding, the gaming device begins the game play automatically. In another embodiment, upon the player engaging one of the play buttons, the gaming device automatically activates game play.

In one embodiment, as shown in FIGS. 1A and 1B, one input device is a bet one button 36. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) which enables the player to bet the maximum wager permitted for a game of the gaming device.

In one embodiment, one input device is a cash out button 38. The player may push the cash out button and cash out to receive a cash payment or other suitable form of payment corresponding to the number of remaining credits. In one embodiment, when the player cashes out, the player receives the coins or tokens in a coin payout tray 40. In one embodiment, when the player cashes out, the player may receive other payout mechanisms such as tickets or credit slips redeemable by a cashier or funding to the player's electronically recordable identification card.

In one embodiment, as mentioned above and seen in FIG. 2A, one input device is a touch-screen 42 coupled with a touch-screen controller 44, or some other touch-sensitive display overlay to allow for player interaction with the images on the display. The touch-screen and the touch-screen controller are connected to a video controller 46. A player can make decisions and input signals into the gaming device by touching touch-screen at the appropriate places.

The gaming device may further include a plurality of communication ports for enabling communication of the processor with external peripherals, such as external video sources, expansion buses, game or other displays, an SCSI port or a key pad.

In one embodiment, as seen in FIG. 2A, the gaming device includes a sound generating device controlled by one or more sounds cards 48 which function in conjunction with the processor. In one embodiment, the sound generating device includes at least one and preferably a plurality of speakers 50 or other sound generating hardware and/or software for generating sounds, such as playing music for the primary and/or secondary game or for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized for or to provide any appropriate information.

In one embodiment, the gaming machine may include a player or other sensor, such as a camera in communication with the processor (and possibly controlled by the processor) that is selectively positioned to acquire an image of a player actively using the gaming device and/or the surrounding area of the gaming device. In one embodiment, the camera may be configured to selectively acquire still or moving (e.g., video) images and may be configured to acquire the images in either an analog, digital or other suitable format. The display devices may be configured to display the image acquired by the camera as well as display the visible manifestation of the game in split screen or picture-in-picture fashion. For example, the camera may acquire an image of the player and that image can be incorporated into the primary and/or secondary game as a game image, symbol or indicia.

Gaming device 10 can incorporate any suitable wagering primary or base game. The gaming machine or device of the present invention may include some or all of the features of conventional gaming machines or devices. It should be appreciated that, if the present invention is the a base or primary game or is incorporated into the base or primary game, the bonus or secondary game may comprise any suitable reel-type game, card game, number game or other game of chance susceptible to representation in an electronic or electromechanical form which produces a random outcome based on probability data upon activation from a wager. Alternatively, the base or primary game may comprise any suitable reel-type game, card game, number game or other game of chance and the present invention is the bonus or secondary or is incorporated into the bonus or secondary game. That is, different primary wagering games, such as video poker games, video blackjack games, video keno, video bingo or any other suitable base or primary game may be played in combination with the present invention.

In one embodiment, as illustrated in FIGS. 1A and 1B, a base or primary game or a bonus or secondary game may be a slot game with one or more paylines 52. The paylines may be horizontal, vertical, circular, diagonal, angled or any combination thereof. In this embodiment, the gaming device displays at least one and preferably a plurality of reels 54, such as three to five reels 54 in either electromechanical form with mechanical rotating reels or video form with simulated reels and movement thereof. In one embodiment, an electromechanical slot machine includes a plurality of adjacent, rotatable wheels which may be combined and operably coupled with an electronic display of any suitable type. In another embodiment, if the reels 54 are in video form, the plurality of simulated video reels 54 are displayed on one or more of the display devices as described above. Each reel 54 displays a plurality of indicia such as bells, hearts, fruits, numbers, letters, bars or other images which preferably correspond to a theme associated with the gaming device. In this embodiment, the gaming device awards prizes when the reels of the primary game stop spinning if specified types and/or configurations of indicia or symbols occur on an active pay line or otherwise occur in a winning pattern.

In one embodiment, a base or primary game or a bonus or secondary game may be a poker game wherein the gaming device enables the player to play a conventional game of video poker and initially deals five cards all face up from a virtual deck of fifty-two card deck. Cards may be dealt as in a traditional game of cards or in the case of the gaming device, may also include that the cards are randomly selected from a predetermined number of cards. If the player wishes to draw, the player selects the cards to hold via one or more input device, such as pressing related hold buttons or via the touch screen. The player then presses the deal button and the unwanted or discarded cards are removed from the display and replacement cards are dealt from the remaining cards in the deck. This results in a final five-card hand. The final five-card hand is compared to a payout table which utilizes conventional poker hand rankings to determine the winning hands. The player is provided with an award based on a winning hand and the credits the player wagered.

In another embodiment, a base or primary game or a bonus or secondary game may be a multi-hand version of video poker. In this embodiment, the player is dealt at least two hands of cards. In one such embodiment, the cards are the same cards. In one embodiment each hand of cards is associated with its own deck of cards. The player chooses the cards to hold in a primary hand. The held cards in the primary hand are also held in the other hands of cards. The remaining non-held cards are removed from each hand displayed and for each hand replacement cards are randomly dealt into that hand. Since the replacement cards are randomly dealt independently for each hand, the replacement cards for each hand will usually be different. The poker hand rankings are then determined hand by hand and awards are provided to the player.

In one embodiment, a base or primary game or a bonus or secondary game may be a keno game wherein the gaming device displays a plurality of selectable indicia or numbers on at least one of the display devices. In this embodiment, the player selects at least one and preferable a plurality of the selectable indicia or numbers via an input device or via the touch screen. The gaming device then displays a series of drawn numbers to determine an amount of matches, if any, between the player's selected numbers and the gaming device's drawn numbers. The player is provided an award based on the amount of matches, if any, based on the amount of determined matches.

In one embodiment, in addition to winning credits in a base or primary game, the gaming device may also give players the opportunity to win credits in a bonus or secondary game or bonus or secondary round. The bonus or secondary game enables the player to obtain a prize or payout in addition to the prize or payout, if any, obtained from the base or primary game. In general, a bonus or secondary game produces a significantly higher level of player excitement than the base or primary game because it provides a greater expectation of winning than the base or primary game and is accompanied with more attractive or unusual features than the base or primary game.

In one embodiment, the bonus or secondary game may be any type of suitable game, either similar to or completely different from the base or primary game. In one embodiment, the gaming device includes a program which will automatically begin a bonus round when the player has achieved a triggering event or qualifying condition in the base or primary game. In one embodiment, the triggering event or qualifying condition may be a selected outcome in the primary game or a particular arrangement of one or more indicia on a display device in the primary game, such as the number seven appearing on three adjacent reels along a payline in the primary slot game embodiment seen in FIGS. 1A and 1B. In another embodiment, the triggering event or qualifying condition may be by exceeding a certain amount of game play (number of games, number of credits, amount of time), reaching a specified number of points earned during game play or as a random award.

In one embodiment, once a player has qualified for a bonus game, the player may subsequently enhance his/her bonus game participation through continued play on the base or primary game. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or geometric increase in the number of bonus wagering credits awarded. In one embodiment, extra bonus wagering credits may be redeemed during the bonus game to extend play of the bonus game.

In one embodiment, no separate entry fee or buy in for a bonus game need be employed. That is, a player may not purchase an entry into a bonus game; he must win or earn entry through play of the primary game and, thus, play of the primary game is encouraged. In another embodiment, qualification of the bonus or secondary game could be accomplished through a simple "buy in" by the player if, for example, the player has been unsuccessful at qualifying through other specified activities.

Figure 2B:
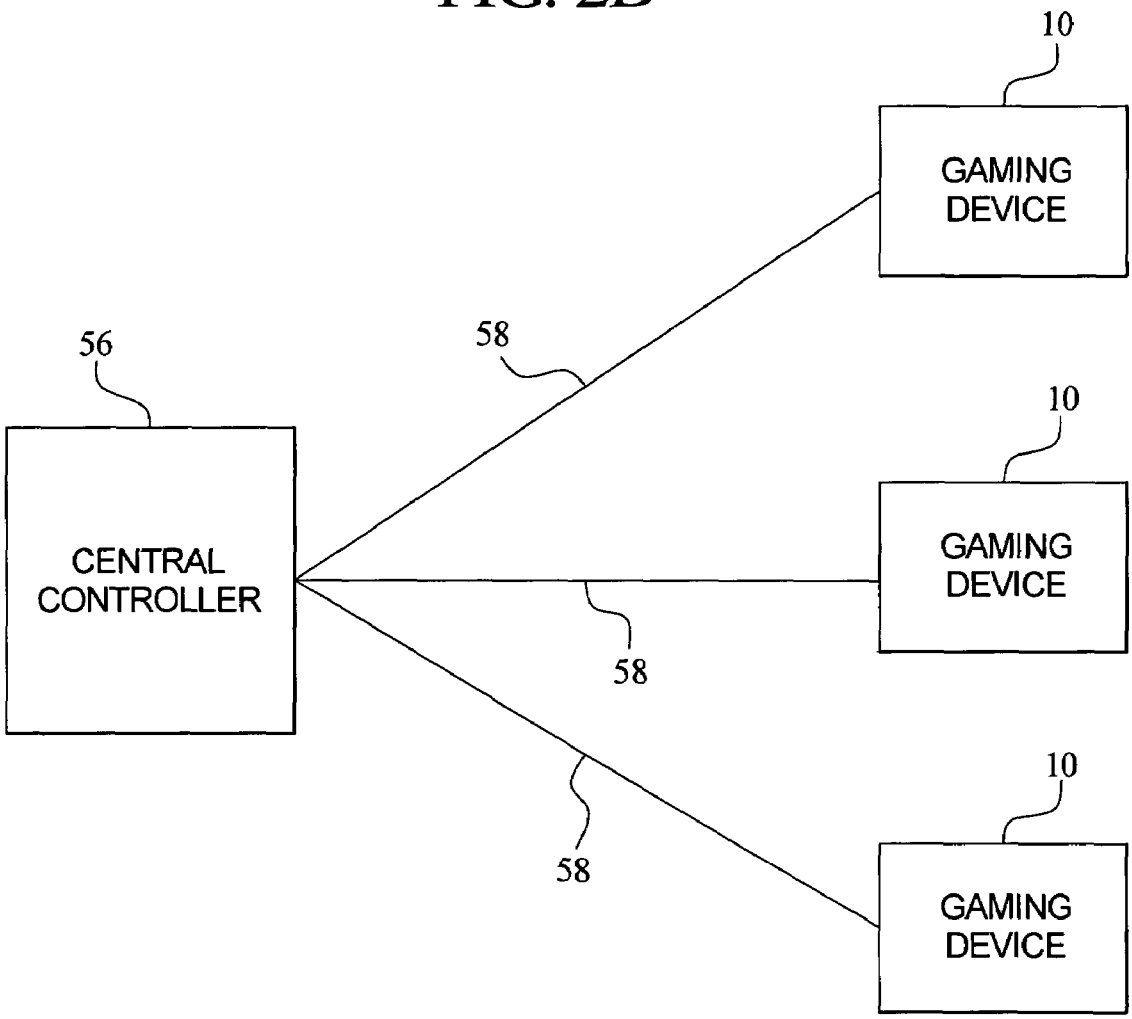
FIG. 2B is a schematic block diagram of a central determination embodiment of the gaming device of the present invention.

In one embodiment, as illustrated in FIG. 2B, one or more of the gaming devices 10 of the present invention may be connected to each other through a data network or a remote communication link 58 with some or all of the functions of each gaming device provided at a central location such as a central server or central controller 56. More specifically, the processor of each gaming device may be designed to facilitate transmission of signals between the individual gaming device and the central server or controller.

In one embodiment, the game outcome provided to the player is determined by a central server or controller and provided to the player at the gaming device of the present invention. In this embodiment, each of a plurality of such gaming devices are in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the primary game based on probability data. In another embodiment, the central server or controller randomly generates a game outcome for the secondary game based on probability data. In another embodiment, the central server or controller randomly generates a game outcome for both the primary game and the secondary game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, primary and secondary game outcomes, or a series of game outcomes such a free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control can assist a gaming establishment or other entity in maintaining appropriate records, controlling gaming, reducing and preventing cheating or electronic or other errors, reducing or eliminating win-loss volatility and the like.

In another embodiment, one or more of the gaming devices of the present invention are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

A plurality of the gaming devices of the present invention are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system of the present invention may be substantially identical to the LAN gaming system described above, although the number of gaming devices in each system may vary relative to each other.

In another embodiment, the data network is an internet or intranet. In this embodiment, the operation of the gaming device can be viewed at the gaming device with at least one internet browser. In this embodiment, operation of the gaming device and accumulation of credits may be accomplished with only a connection to the central server or controller (the internet/intranet server) through a conventional phone or other data transmission line, digital signal line (DSL), T-1 line, coaxial cable, fiber optic cable, or other suitable connection. In this embodiment, players may access an Internet game page from any location where an internet connection and computer, or other internet facilitator are available. The expansion in the number of computers and number and speed of internet connections in recent years increases opportunities for players to play from an ever-increasing number of remote sites. It should be appreciated that enhanced bandwidth of digital wireless communications may render such technology suitable for some or all communications according to the present invention, particularly if such communications are encrypted. Higher data transmission speeds may be useful for enhancing the sophistication and response of the display and interaction with the player.

In another embodiment, a plurality of gaming devices at one or more gaming sites may be networked to a central server in a progressive configuration, as known in the art, wherein a portion of each wager to initiate a base or primary game may be allocated to bonus or secondary event awards. In one embodiment, a host site computer is coupled to a plurality of the central servers at a variety of mutually remote gaming sites for providing a multi-site linked progressive automated gaming system. In one embodiment, a host site computer may serve gaming devices distributed throughout a number of properties at different geographical locations including, for example, different locations within a city or different cities within a state.

In one embodiment, the host site computer is maintained for the overall operation and control of the system. In this embodiment, a host site computer oversees the entire progressive gaming system and is the master for computing all progressive jackpots. All participating gaming sites report to, and receive information from, the host site computer. Each central server computer is responsible for all data communication between the gaming device hardware and software and the host site computer.

Symbol Swapping

Referring now to FIGS. 3A to 3E, in one embodiment of the present invention, the gaming device displays a plurality of fixed positions on each of five reels 54*a*, 54*b*, 54*c*, 54*d* and 54*e*. The illustrated gaming device also has four paylines 52*a*, 52*b*, 52*c* and 52*d* associated with the reels. The illustrated gaming device also has a plurality of symbols 102 which, in this example, are represented by the letters A, B, C, D, E and F displayed on the reels. It should be appreciated that the symbols can include any suitable character, numeral, indicia or image. In one embodiment, a plurality of swapping indicators 104*a*, 104*b*, 104*c* and 104*d* are associated with a plurality of the symbols 102.

In one embodiment, the game begins by activating the reels areas. In the embodiment illustrated in FIG. 3A, the gaming device spins the reels to rearrange the symbols. In one embodiment, the symbols remain associated with their respective fixed positions through this first rearrangement. As in a conventional reel game, each reel spins independently of the other reels until each reel stops at a generated stop position to indicate a combination of symbols, if any, along the paylines. U.S. Pat. No. 6,413,162 issued on Jul. 2, 2002 and assigned to IGT discloses a different reel arrangement. It should be appreciated that the present invention can employ the reels disclosed in that patent.

Figure 3A:
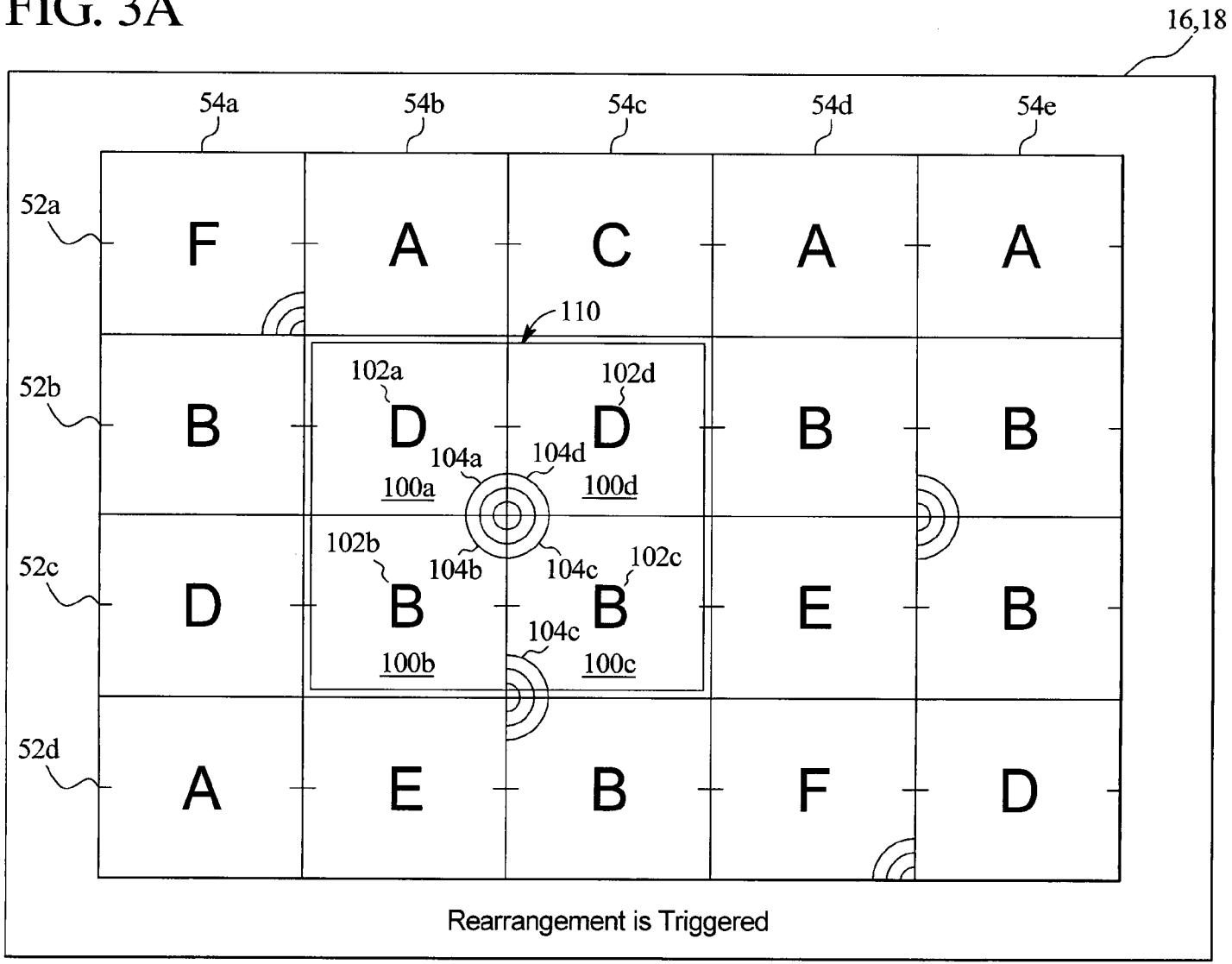
FIGS. 3A, 3B, 3C, 3D and 3E are front perspective views of one embodiment of the present invention illustrating a rearrangement of one set of symbols.

In FIG. 3A, the swapping indicators 104*a* to 104*d* represented by four radial quadrants associated with each of four symbols 102*a* to 102*d*, respectively generated along paylines 52*b* and 52*c* on two different reels, have aligned or matched to form, in the illustrated embodiment, a plurality of concentric circles. It should be appreciated that each of the swapping indicators can be any suitable shape, size, degree of illumination, or any suitable indicia to combine with other swapping indicators to form any suitable configuration, pattern or arrangement to indicate a set of symbols to be swapped or rearranged. In one embodiment, as illustrated in FIG. 3A, the matching or alignment of the swapping indicators triggers the rearrangement of the set of four indicated symbols 110. In FIG. 3A, the set of indicated symbols 110 to be rearranged includes the D symbol 102*a* in position or fixed position 100*a*, the B symbol 102*b* in fixed position 100*b*, the B symbol 102*c* in fixed position 100*c*, and the D symbol 102*d* in fixed position 100*d*. Although the swapping indicators of the two B symbols on reel 54*c* and the two B symbols on reel 54*e* match one another, the gaming device, in the illustrated embodiment, does not recognize the alignment of less than four swapping indicators to trigger the rearrangement of the symbols. It should be appreciated, however, that any suitable number of swapping indicators can trigger the rearrangement of at least three indicated symbols to each swap or move to at least one other locations in one embodiment.

Figure 3B:
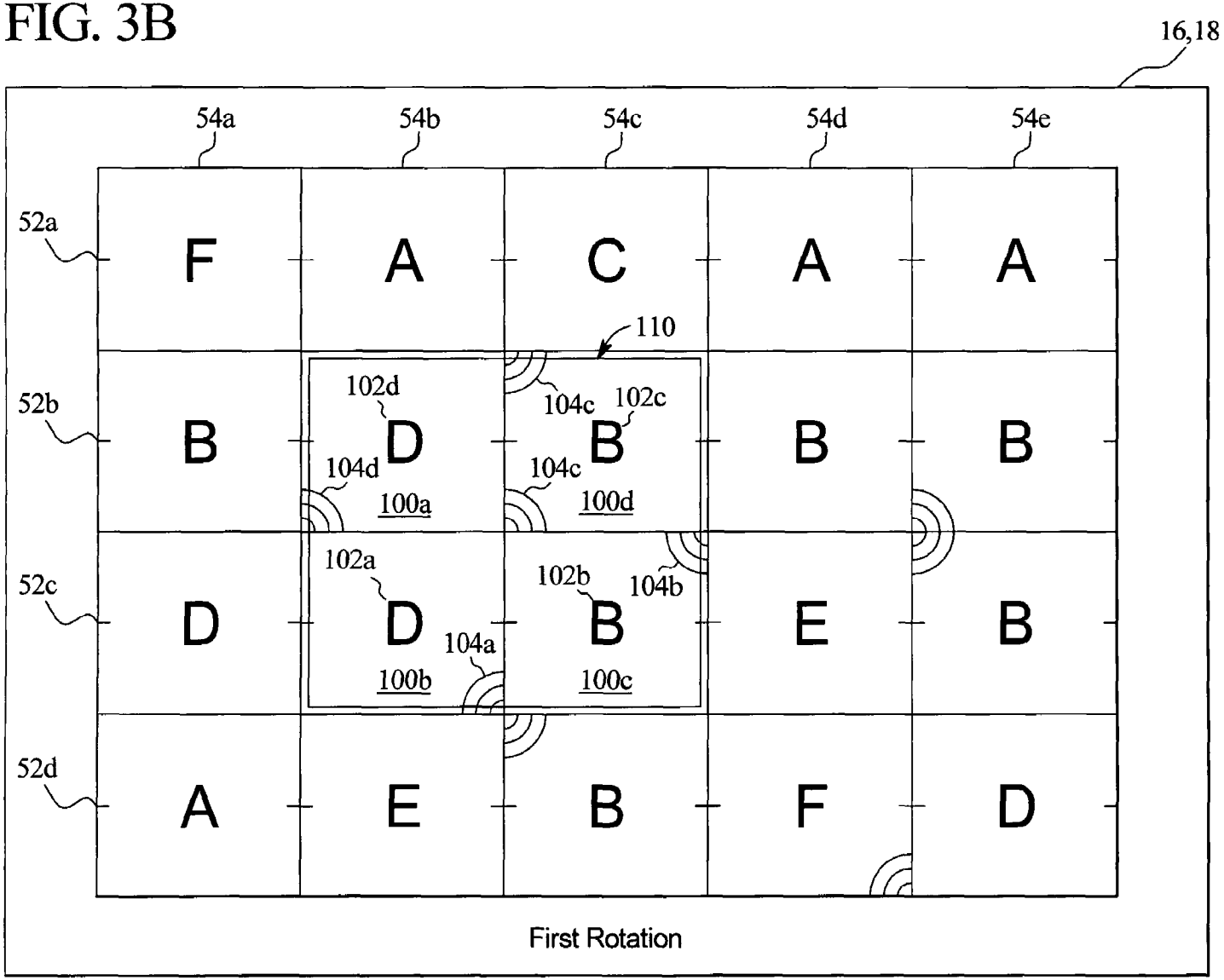

In FIGS. 3A and 3B, after the first evaluation for winning combinations, the D symbol 102*a* in fixed position 100*a* moves to fixed position 100*b*. The B symbol 102*b* in fixed position 100*b* moves to the fixed position 100*c* on the adjacent reel 54*c*. The B symbol 102*c* in fixed position 100*c* of reel 54*c* moves to the fixed position 100*d* on reel 54*c*. The D symbol 102*d* in fixed position 100*d* on reel 54*c* moves to the fixed position 100*a* on the adjacent reel 54*b*. It should be appreciated that the symbols, in one embodiment, move in a counter-clockwise rotation within the four fixed positions 100*a* to 100*d* on the two reels 54*b* and 54*c*. Alternatively, it should be appreciated that the symbols can rotate in a clockwise direction within the four positions on the two reels, or the symbols can move in any other random or predetermined direction, sequence or configuration sequentially or randomly.

Once a rearrangement or rotation of the set of indicated symbols occurs, the gaming device re-evaluates the symbols indicated on each of the active paylines to determine if a winning combination associated with an award exists on the display. In FIG. 3B, the same symbol, B is generated along the same payline 52*b* on all the reels, except for the D symbol 102*d* on reel 54*b*.

Figure 3C:
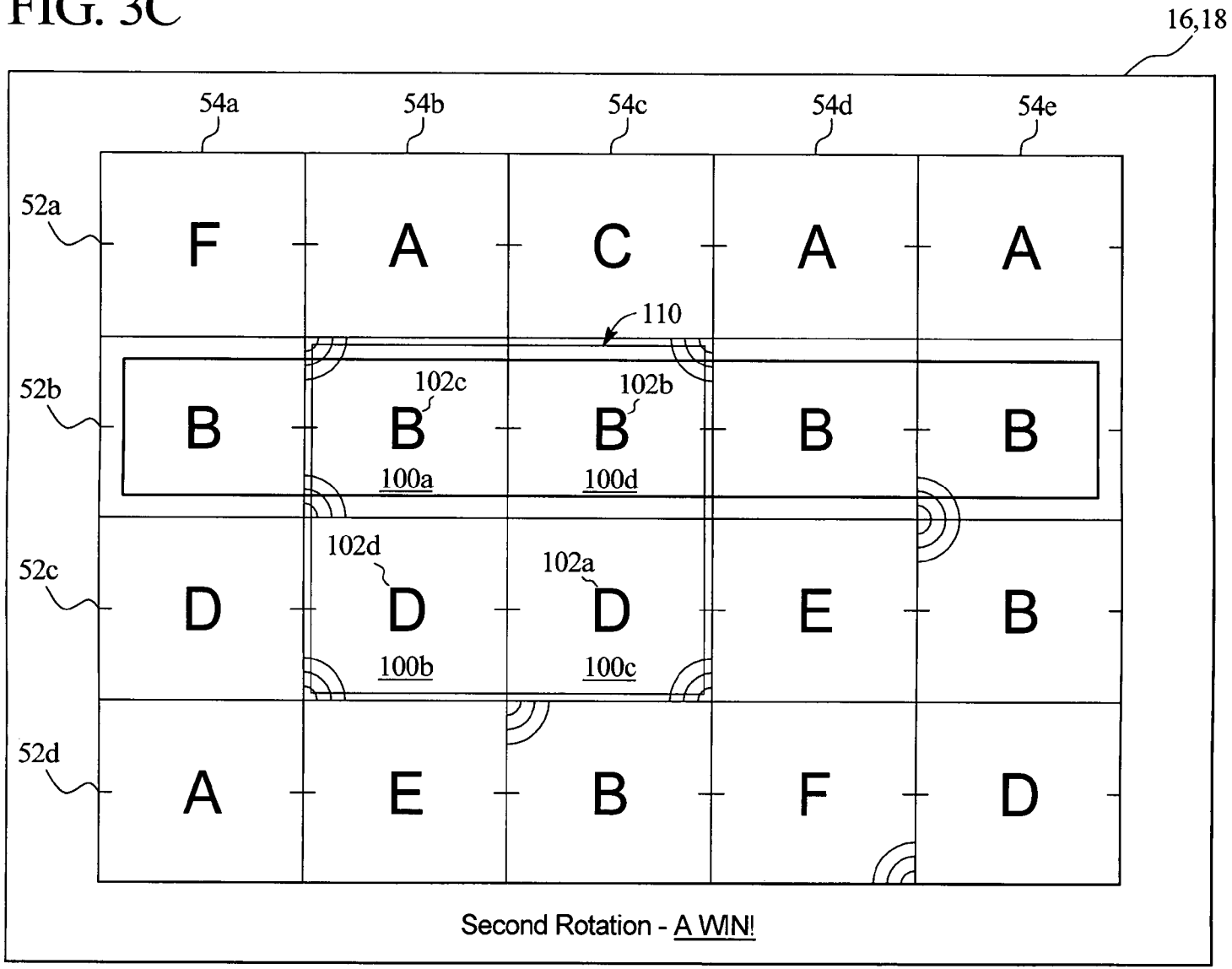

In FIGS. 3B and 3C, the D symbol 102*d* in fixed position 100*a* moves to fixed position 100*b*. The D symbol 102*a* in fixed position 100*b* moves to the fixed position 100*c* on the adjacent reel 54*c*. The B symbol 102*b* in fixed position 100*c* of reel 54*c* moves to the fixed position 100*d* on reel 54*c*. The B symbol 102*c* in fixed position 100*d* on reel 54*c* moves to the fixed position 100*a* on the adjacent reel 54*b*. As performed after the first rearrangement illustrated in FIG. 3B, the gaming device reevaluates the active paylines to determine if a winning combination is associated with an award in the game. As a result of the rearrangement of the set of indicated symbols in the embodiment illustrated in FIG. 3C, a combination of five of the same "B" symbols on payline 52*b* is associated with an award in the game, and the gaming device provides the player the award. It should be appreciated that any suitable award or outcome can be associated with a predetermined winning combination of symbols on the reels as discussed above.

Figure 3D:
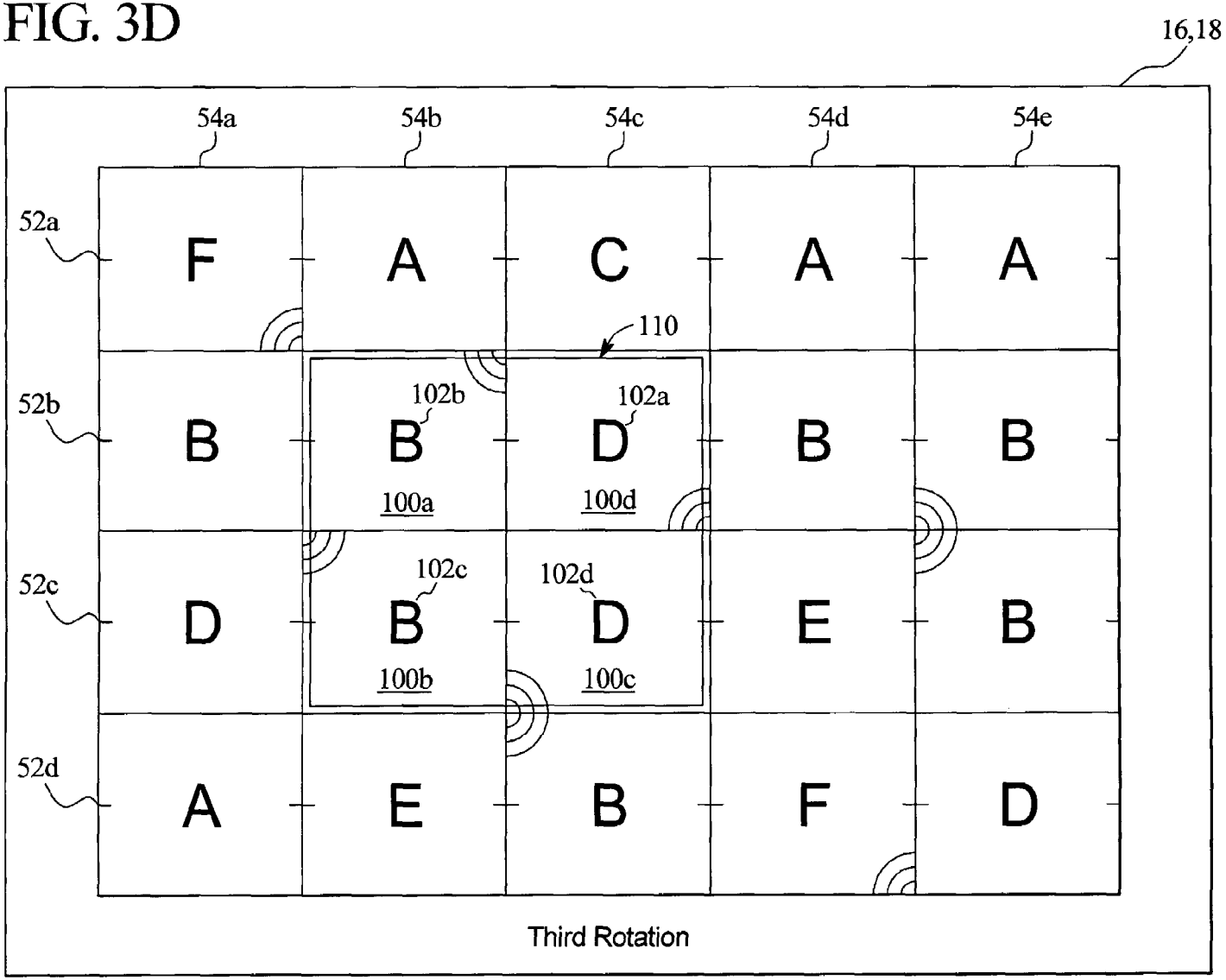

In one embodiment, the gaming device continues to perform rearrangements of the set of indicated symbols even after a winning combination has occurred on the reels. In one embodiment the rearrangement of the set of indicated symbols continues until the indicated symbols are returned to the original fixed positions the symbols occupied after the initial spinning of the reels. Alternatively, the symbols are rearranged less than the number of times required to return each of the symbols to their original fixed positions. In FIGS. 3C and 3D, the B symbol 102*c* in fixed position 100*a* moves to fixed position 100*b* on reel 54*b*. The D symbol 102*d* in fixed position 100*b* moves to fixed position 100*c* on the adjacent reel 54*c*. D symbol 102*a* in fixed position 100*c* moves to fixed position 100*d* on reel 54*c*. The B symbol 102*b* in fixed position 100*d* moves to fixed position 100*a* on the adjacent reel 54*b* to complete the rearrangement sequence. The gaming device reevaluates the active paylines to determine if a winning combination exists. Payline 52*b* includes all B symbols except for a D symbol on reel 54*c* which is not a winning combination of symbols.

Figure 3E:
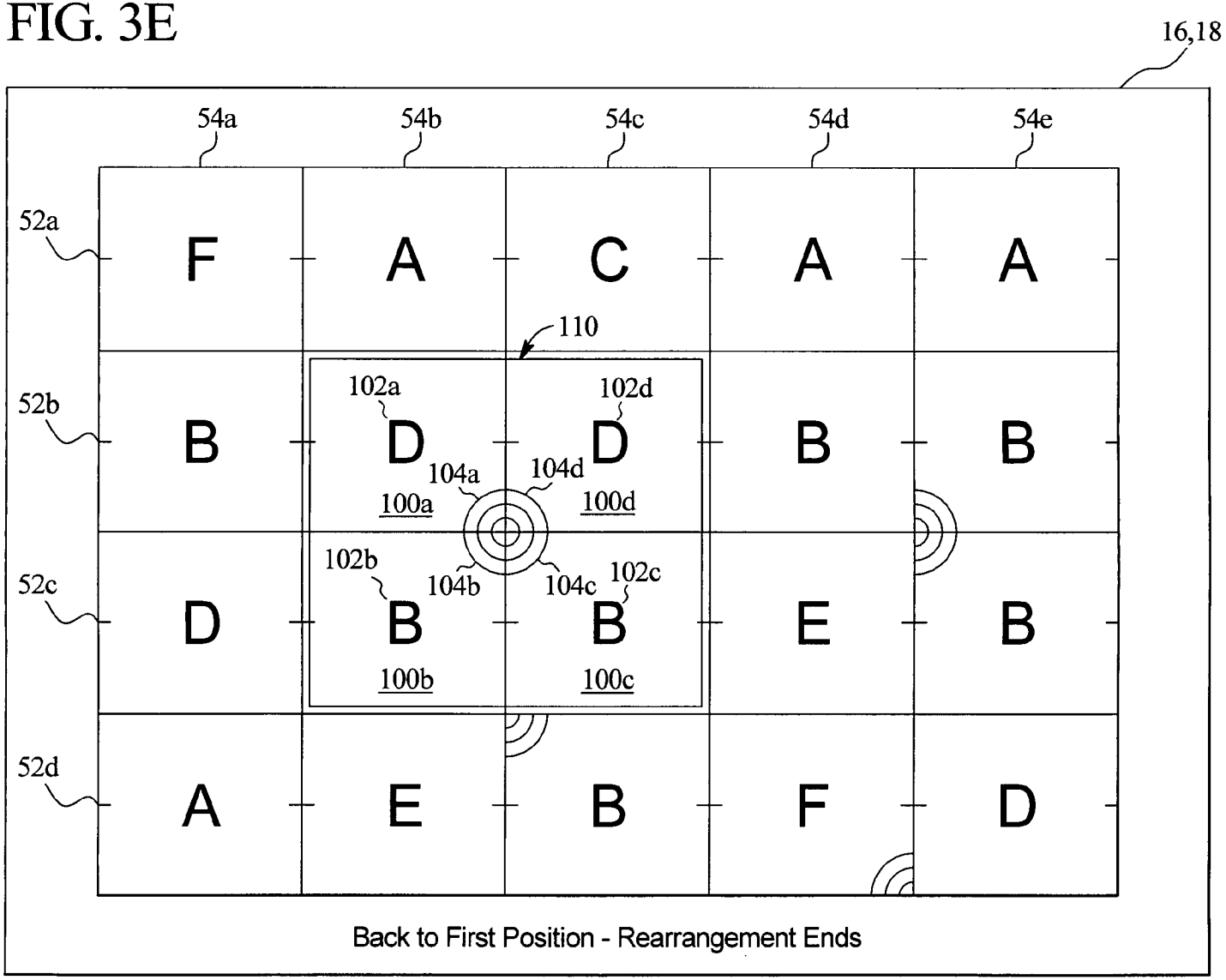

In one embodiment, the rearrangement continues to occur. In FIGS. 3D and 3E, the B symbol 102*b* in fixed position 100*a* moves to fixed position 100*b* on reel 54*b*. The B symbol 102*c* in fixed position 100*b* moves to fixed position 100*c* on the adjacent reel 54*c*. The D symbol 102*d* in fixed position 100*c* moves to fixed position 100*d* on reel 54*c*. The D symbol 102*a* in fixed position 100*d* moves to fixed position 100*a* on the adjacent reel 54*b*. Upon completion of this rearrangement cycle, it should be appreciated that an entire rotation has occurred on the reels, and the symbols 102*a* to 102*d* have returned to their original fixed positions 100*a* to 100*d*, respectively. The gaming device, in one embodiment, reevaluates the possible winning combinations of symbols after each indicated symbol has been moved to each of the fixed positions associated with the indicated symbols. It should be appreciated that any additional rotation in either direction or any rearrangement of the symbols would yield the same results as produced in the previous three rearrangements or rotations.

Figure 4A:
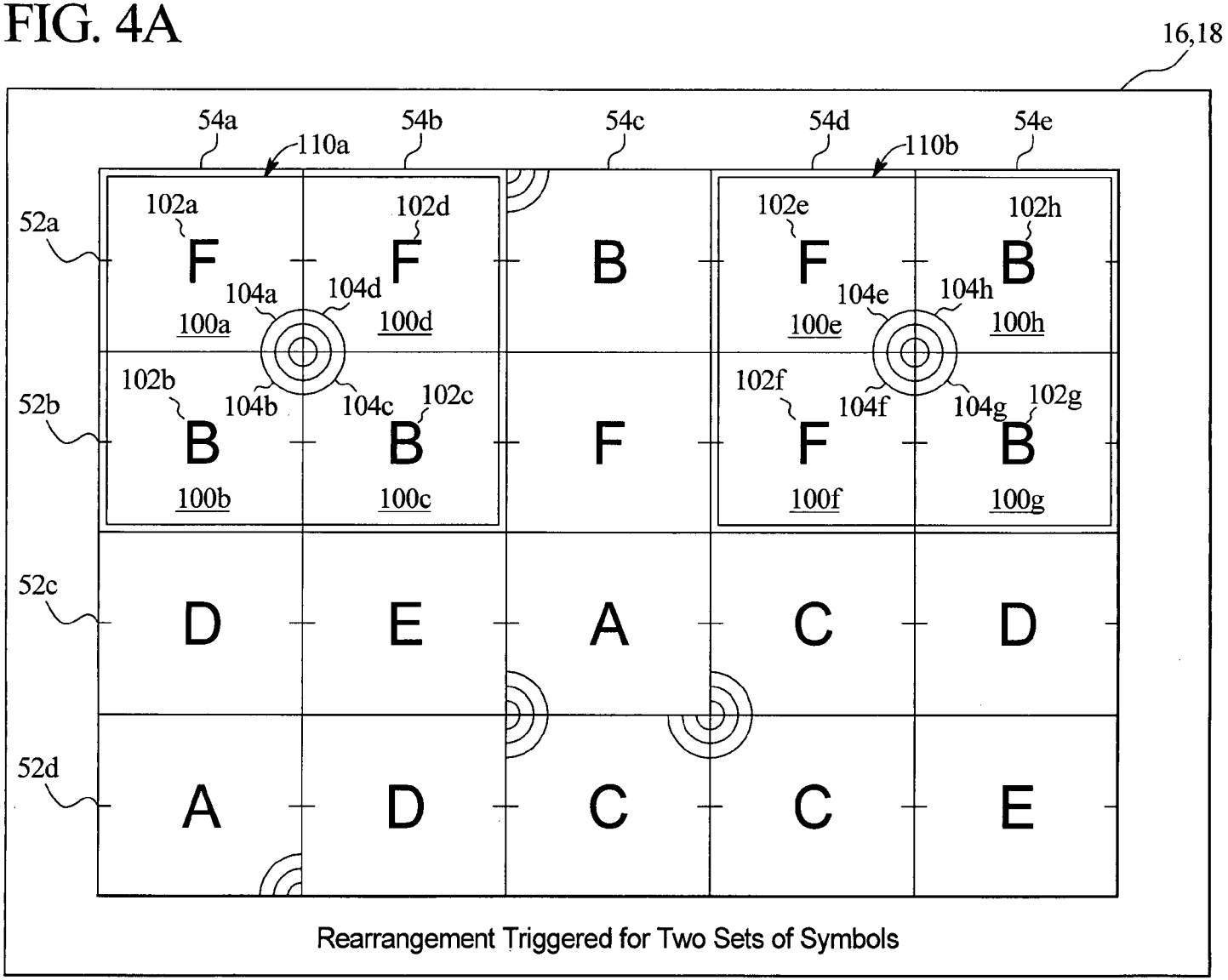
FIGS. 4A, 4B and 4C are front perspective views of one embodiment of the present invention illustrating a rearrangement of two sets of symbols.
Figure 4B:
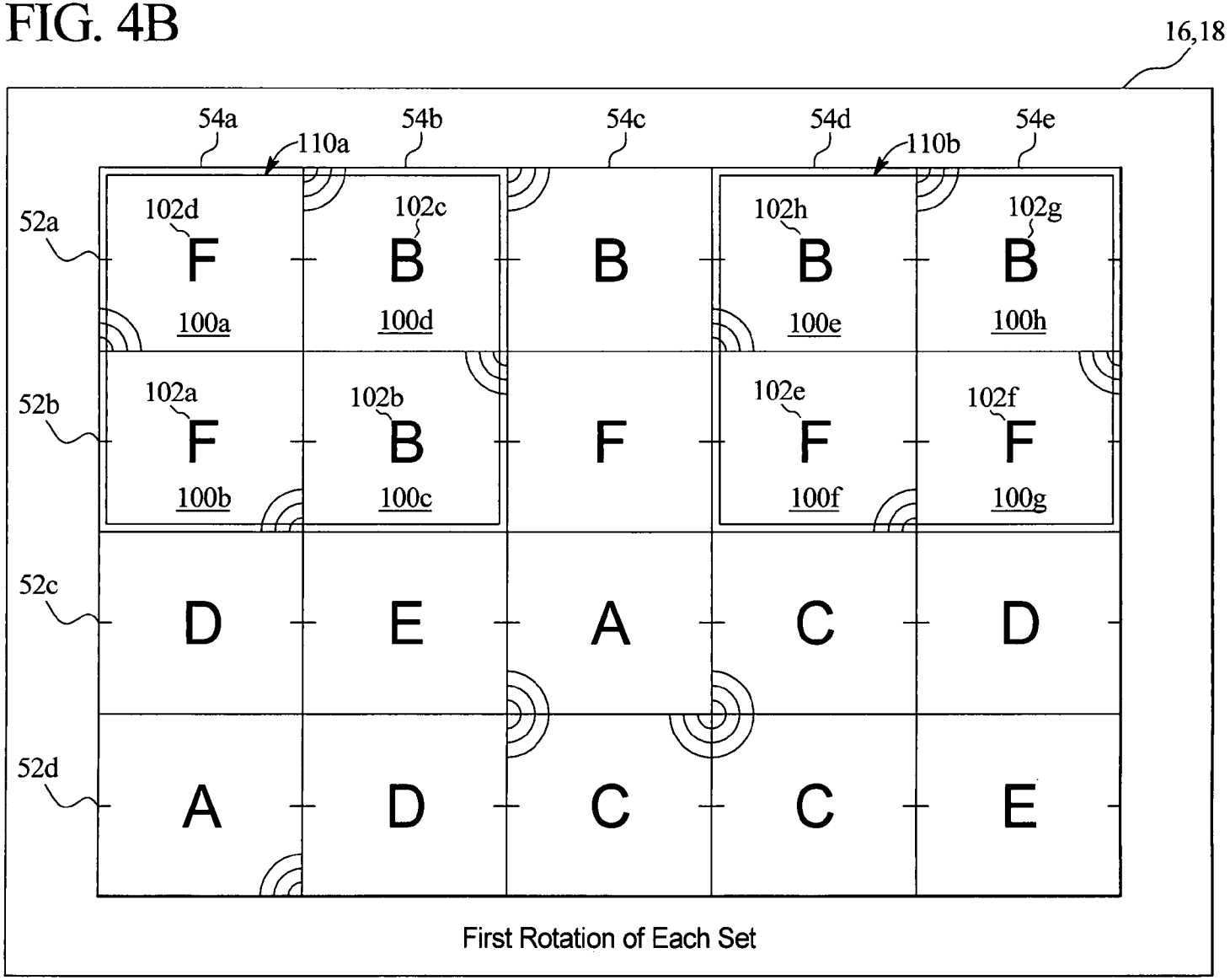
Figure 4C:
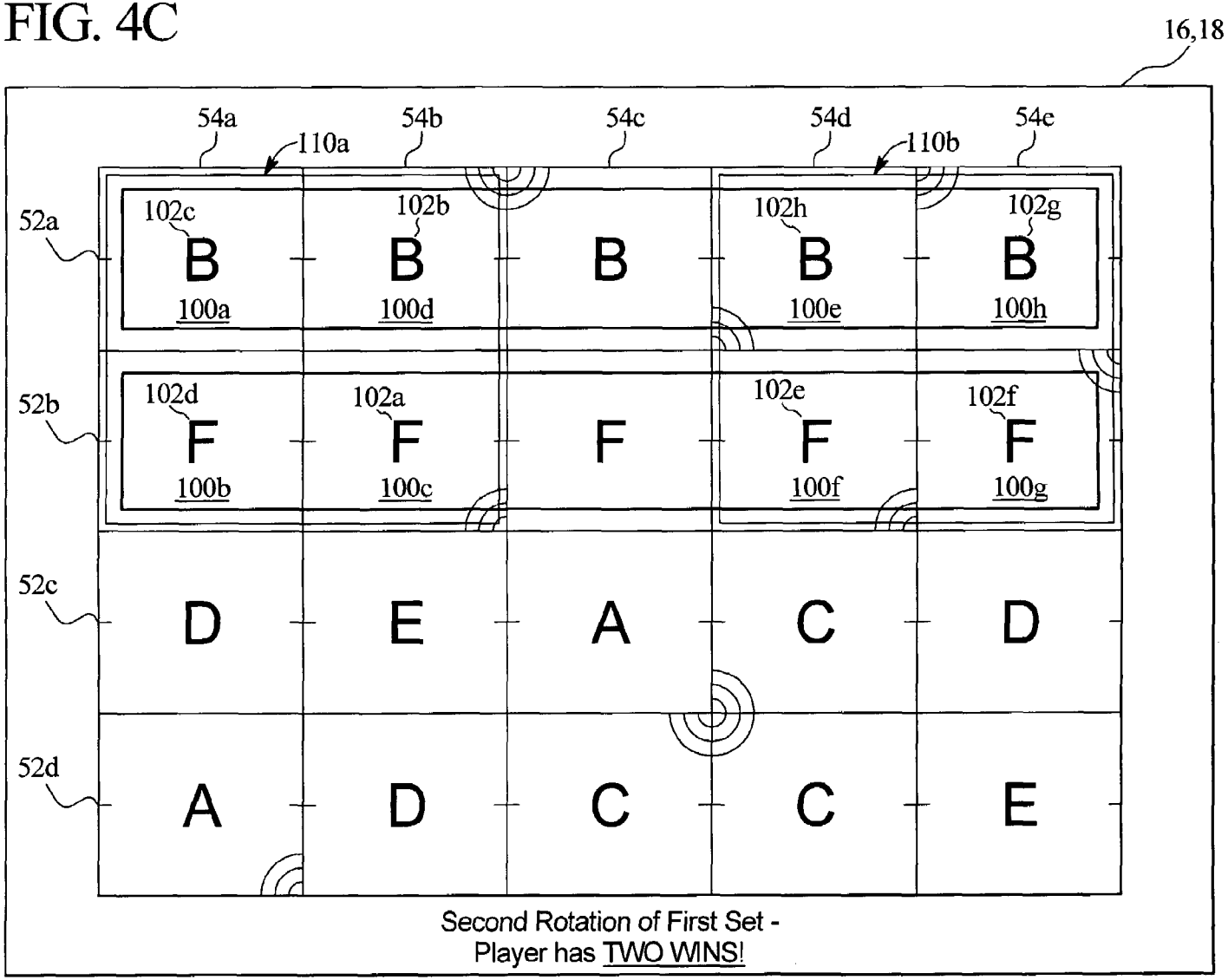

Referring now to FIGS. 4A to 4C, in one embodiment of the present invention the gaming device generates more than one set of indicated symbols on the reels. In FIG. 4A, the indicators of two sets 110*a* and 110*b* of four symbols each are aligned on the reels to trigger a symbol rearrangement or rotation within each of the four fixed positions associated with the indicated symbols on the reels. Again, other symbol indicators have aligned such as the C symbols on paylines 52*c* and 52*d* on reels 54*c* and 54*d*, respectively. However, the indicator for symbol A is not in alignment with the other symbol indicators as required by the illustrated embodiment. In one embodiment, the rearrangement or rotation of the indicated symbols on the reels occurs simultaneously, changing up to four of the five symbols on a single payline between each re-evaluation of the paylines by the gaming device to determine if a winning combination exists. Alternatively, one set of indicated symbols rotates, and the gaming device determines if any winning symbol combinations exist before the rearrangement of another set of indicated symbols. It should be appreciated that this embodiment of rearranging one set of indicated symbols before reevaluating symbol combinations provides more potential winning combinations and is more desirable to the player. In FIGS. 4A to 4B, the indicated symbols 102*a* to 102*d* of the first set 110*a* are rearranged. The F symbol 102*a* in fixed position 100*a* moves to fixed position 100*b* on reel 54*a*. The B symbol 102*b* in fixed position 100*b* on reel 54*a* moves to fixed position 100*c* on the adjacent reel 54*b*. The B symbol 102*c* in fixed position 100*c* on reel 54*b* moves to fixed position 100*d* on reel 54*b*. The F symbol 102*d* in fixed position 100*d* on reel 54*b* moves to fixed position 100*a* on the adjacent reel 54*a*. As discussed above, in one embodiment, the gaming device performs an evaluation of the active paylines before rearranging the second set of indicated symbols.

In similar fashion, the second set of 110*b* of indicated symbols 102*e* to 102*h* are rearranged. The F symbol 102*e* in fixed position 100*e* on reel 54*d* moves to fixed position 100*f* on reel 54*d*. The F symbol 102*f* in fixed position 100*f* on reel 54*d* moves to fixed position 100*g* on the adjacent reel 54*e*. The B symbol 102*g* in fixed position 100*g* on reel 54*e* moves to fixed position 100*h* on reel 54*e*. The B symbol 102*h* in fixed position 100*h* on reel 54*e* moves to fixed position 100*e* on the adjacent reel 54*d*. The gaming device then re-evaluates the paylines for additional winning combinations associated with a predetermined award or outcome in the game. In one embodiment illustrated in FIG. 4B, because the F symbol 102*d* appearing on payline 52*a* on reel 54*a* is different than the remaining B symbols on payline 52*a*, there is no winning combination. Similarly, five of the same symbols are not generated along payline 52*b* of the reels. In one embodiment, the rotation or rearrangement occurs again, and an additional re-evaluation occurs after the rearrangement.

In FIGS. 4B and 4C, the first set of indicated symbols 110*a* on reels 54*a* and 54*b* undergo an additional rearrangement or rotation. In one embodiment, the rearrangement of the symbols continues in an alternating fashion regardless of the favorable outcome which would result from discontinuing the rearrangement of one of the sets of indicated symbols. In an alternative embodiment, the gaming device or, alternatively, the player can make a determination whether a rotation of symbols occurs. In FIG. 4C, for example, the second set of indicated symbols 110*b* includes B symbols 102*h* and 102*g* generated along payline 52*a* on reels 54*d* and 54*e*, respectively, and the second set of indicated symbols 110*b* includes F symbols 102*e* and 102*f* on payline 52*b* on reels 54*d* and 54*e*, respectively, in positions which are potentially favorable to the player. All but one symbol on each of the paylines 52*a* and 52*b* are a winning combination. An additional rearrangement or rotation of the first set of indicated symbols 110*a* on reels 54*a* and 54*b*, however, provides winning combinations on paylines 52*a* and 52*b* as illustrated in FIG. 4C. In one embodiment, the gaming device provides the player at least one award or outcome for the two winning combinations.

Figure 5A:
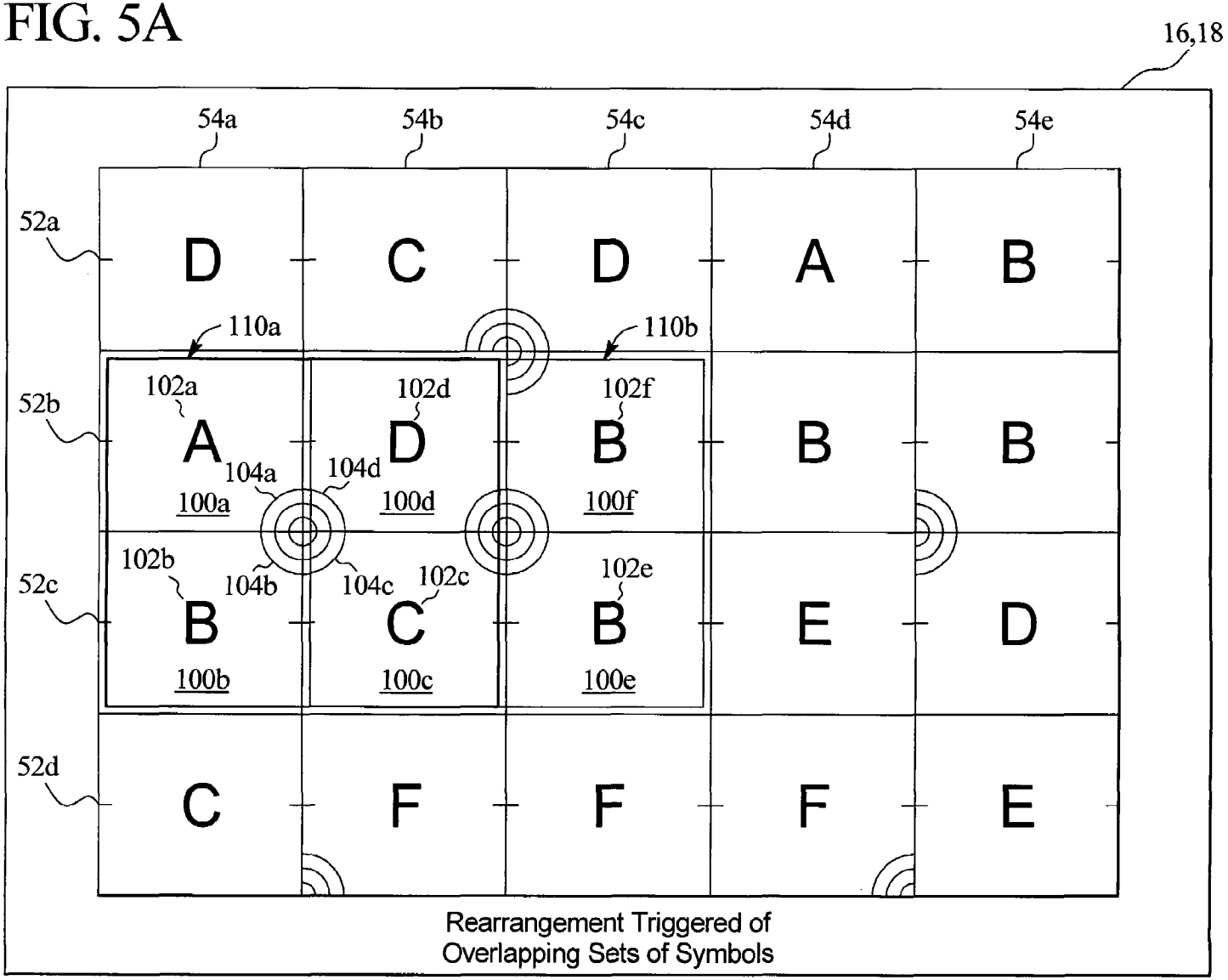
FIGS. 5A, 5B, 5C, 5D and 5E are front perspective views of one embodiment of the present invention illustrating a rearrangement of two overlapping sets of symbols.

In FIGS. 5A to 5E, in one embodiment of the present invention, the gaming device generates overlapping sets of indicated symbols on three different reels, as illustrated in FIG. 5A. In one embodiment, the first set of indicated symbols 110*a* on reels 54*a* and 54*b* are the first set of indicated symbols to rearrange or rotate to new positions. The second set of indicated symbols on reels 54*b* and 54*c* subsequently or, alternatively, simultaneously, rearrange or rotate to new positions. In one embodiment, the gaming device re-evaluates the paylines between each alternating rotation of the symbols on each of the three reels. In a further embodiment, the gaming device alternates between rearranging and evaluating the indicated symbols on reels 54*a* and 54*b* until the symbols in one set are rearranged to their respective original fixed positions. Thereafter, the second set of indicated symbols on reels 54*b* and 54*c* proceed through a series of rotations and re-evaluations of the paylines until the symbols of that set return to their respective original fixed positions.

Figure 5B:
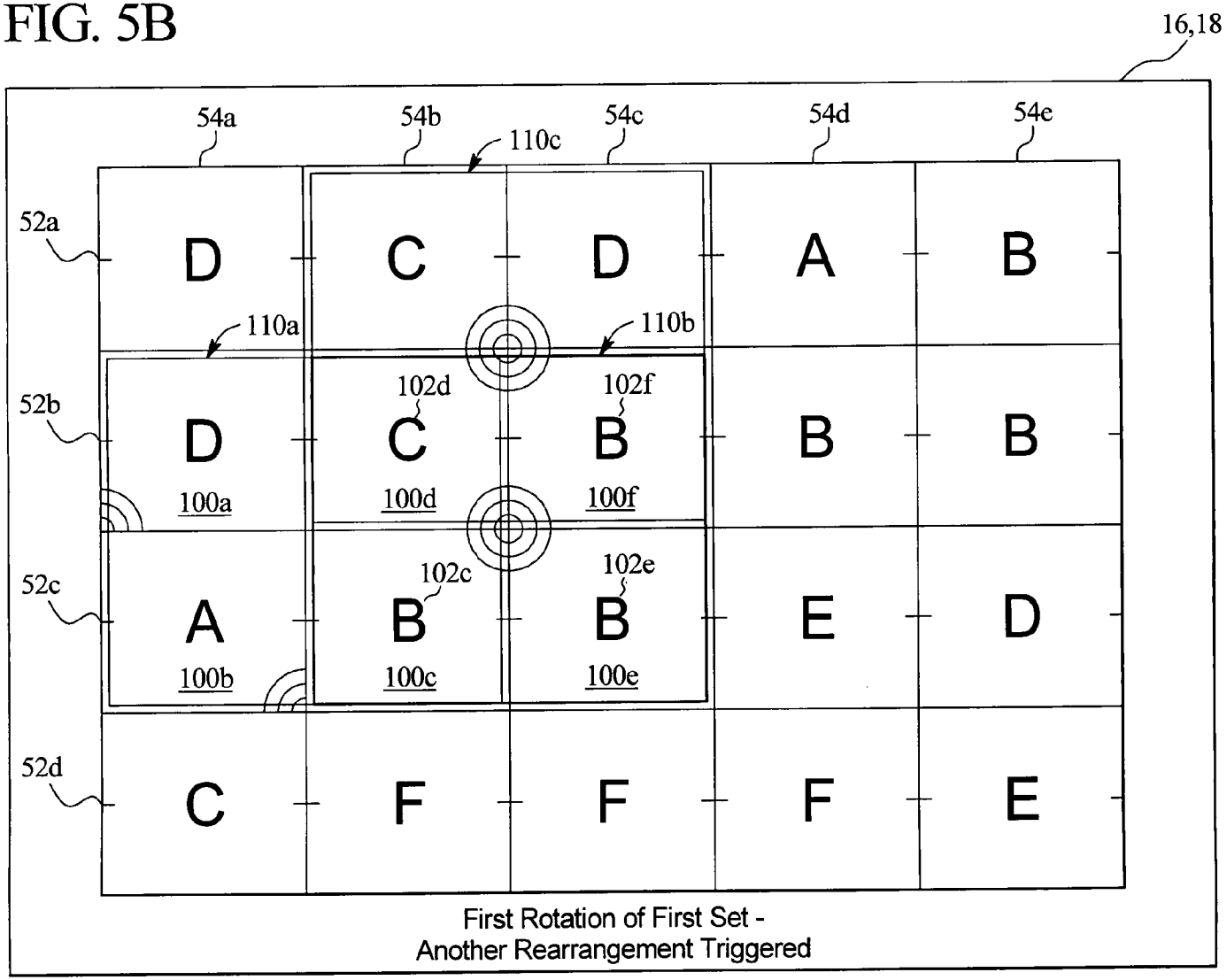

In FIGS. 5A and 5B, the gaming device rearranges the first set of indicated symbols 110*a*. The A symbol 102*a* in fixed position 100*a* moves to fixed position 100*b* on reel 54*a*. The B symbol 102*b* in fixed position 100*b* moves to fixed position 100*c* on the adjacent reel 54*b*. The C symbol 102*c* in fixed position 100*c* moves to fixed position 100*d* on reel 54*b*. The D symbol 102*d* in fixed position 100*d* moves to fixed position 100*a* on the adjacent reel 54*a*.

In one embodiment, the swapping indicators are associated with the symbols such that a rearrangement of the symbols of an indicated set of symbols may cause the swapping indicators associated with those symbols to align or trigger or indicate another set of symbols. In FIG. 5B, the first set of symbols 110*a* indicated on reels 54*a* and 54*b* have rearranged or rotated and have created an additional set of four indicated symbols 110*c* on paylines 52*a* and 52*b* on reels 54*b* and 54*c*. In one embodiment, the additional set of indicated symbols 110*c* enter a series of alternating or sequential rotations and re-evaluations of potential winning combinations on the paylines by the gaming device. In the illustrated embodiment in FIG. 5B, only the original indicated sets of symbols continue to be rearranged and re-evaluated for purposes of determining a winning combination on the paylines.

Figure 5C:
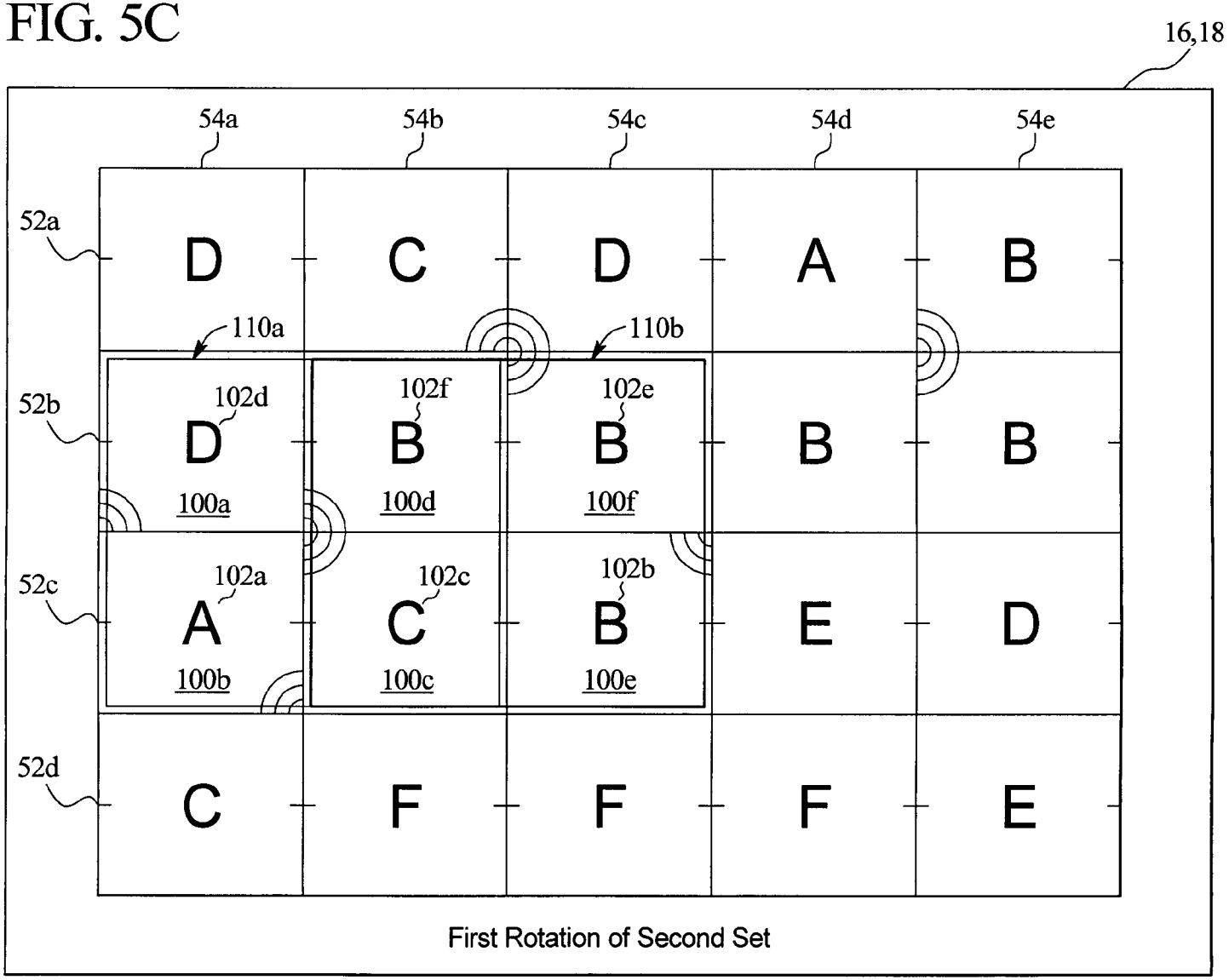

In FIGS. 5B and 5C, the second indicated set of symbols rotate or rearrange to new positions on reels 54*b* and 54*c* to be evaluated by the gaming device for winning combinations. The C symbol 102*c* in fixed position 100*d* moves to fixed position 100*c* on reel 54*b*. It should be appreciated that the C symbol 102*c* moves back to its original position in fixed position 100*c* upon rearrangement of the second set of indicated symbols. In an alternative embodiment, the different sets of indicated symbols rotate in opposite directions or, otherwise, moves in a manner different from the rearrangement of the other set. The B symbol 102*b* in fixed position 100*c* moves to fixed position 100*e* on the adjacent reel 54*c*. It should be appreciated that the B symbol 102*b* has moved across two reels from reel 54*a* to 54*c* after two alternating rearrangements in the illustrated embodiment. It should also be appreciated that, in one embodiment such as one which includes at least two overlapping sets, a symbol is not limited to its original set of indicated symbols. In one embodiment, the symbols rotate within the combined fixed positions of at least two sets of indicated symbols. The final symbol movement for the rearrangement illustrated in FIGS. 5B and 5C includes moving the B symbol 102*e* in fixed position 100*e* to fixed position 100*f* on reel 54*c*, and moving the B symbol 102*f* in fixed position 100*f* to fixed position 100*d* on the adjacent reel 54*b*.

In FIG. 5C, in one embodiment, the second set of symbols 110*b* proceeds through a rearrangement and re-evaluation before the first set of indicated symbols 110*a* proceeds through another rearrangement or rotation. In an alternative embodiment, each symbol in each set of indicated symbols is rearranged and evaluated through the predetermined symbol combinations of the indicated symbols before the rearrangement and symbol combination evaluation occurs for another set. In this embodiment, the gaming device illustrated in FIG. 5C, for example, completes the alternating rearrangement and re-evaluation series or sequence of the first set of symbols 110*a* before rearranging and re-evaluating the second set of indicated symbols 110*b*.

Figure 5D:
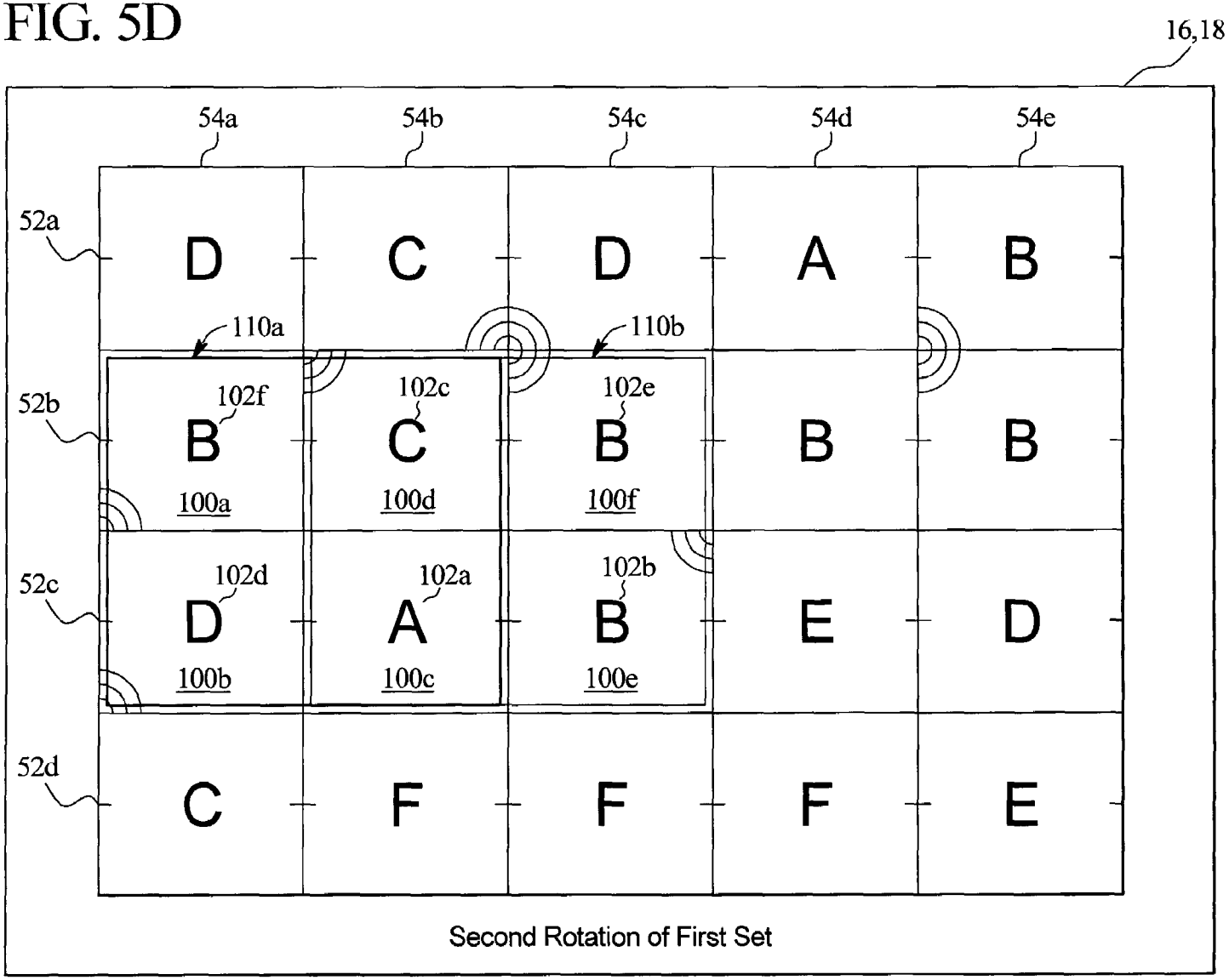

In FIGS. 5C and 5D, the first set of indicated symbols, which now includes symbols from the second set of indicated symbols (the B symbol 102*e*), is rearranged. The D symbol 102*d* in fixed position 100*a* moves to fixed position 100*b* on reel 54*a*. The A symbol 102*a* in fixed position 100*b* moves to fixed position 100*c* on the adjacent reel 54*b*. The C symbol 102*c* in fixed position 100*c* moves to fixed position 100*d* on reel 54*b*. The B symbol 102*f* in fixed position 100*d* moves to fixed position 100*a* on the adjacent reel 54*a*. In FIG. 5D, the first set of indicated symbols 110*a* are re-evaluated by the gaming device based on the new combination of symbols generated by the rearrangement or rotation. Again, no winning combination occurs on the reels.

Figure 5E:
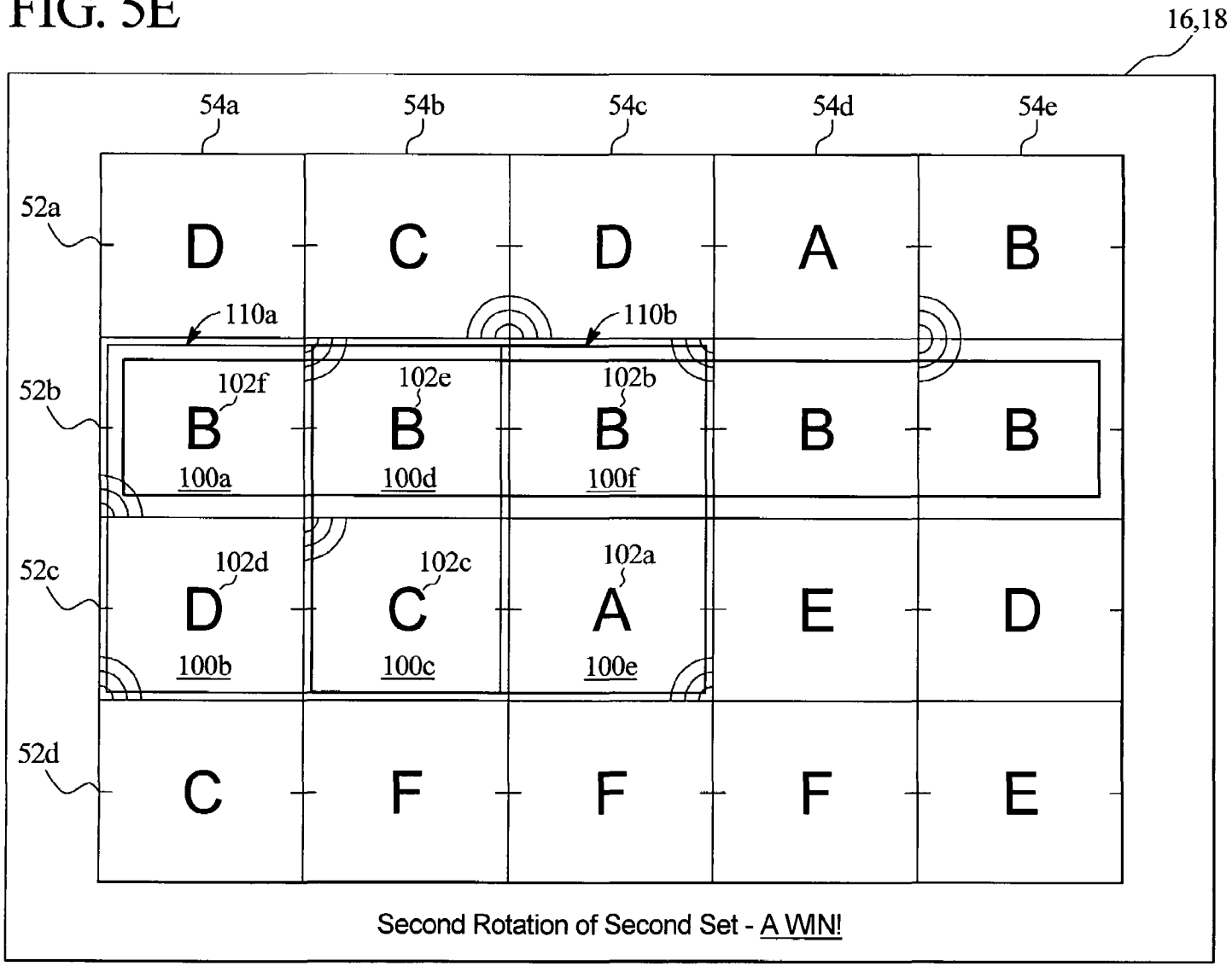

In FIGS. 5D and 5E, the gaming device alternates back to the second set of indicated symbols 110*b* to perform another rearrangement. The C symbol 102*c* in fixed position 100*d* moves to fixed position 100*c* on reel 54*b*. The A symbol 102*a* in fixed position 100*c* moves to fixed position 100*e* on the adjacent reel 54*c*. The B symbol 102*b* in fixed position 100*e* moves to fixed position 100*f* on reel 54*c*. The B symbol 102*e* in fixed position 100*f* moves to fixed position 100*d* on the adjacent reel 54*b*. In FIG. 5E, as a result of the second rotation or rearrangement of the second set of indicated symbols, a winning combination occurs on payline 52*b* for which the player, in one embodiment, is provided an award or outcome. In one embodiment, the sequential or alternating rearrangement of the two indicated sets of symbols continues until the symbols in each set are rearranged to their original positions.

Figure 6A:
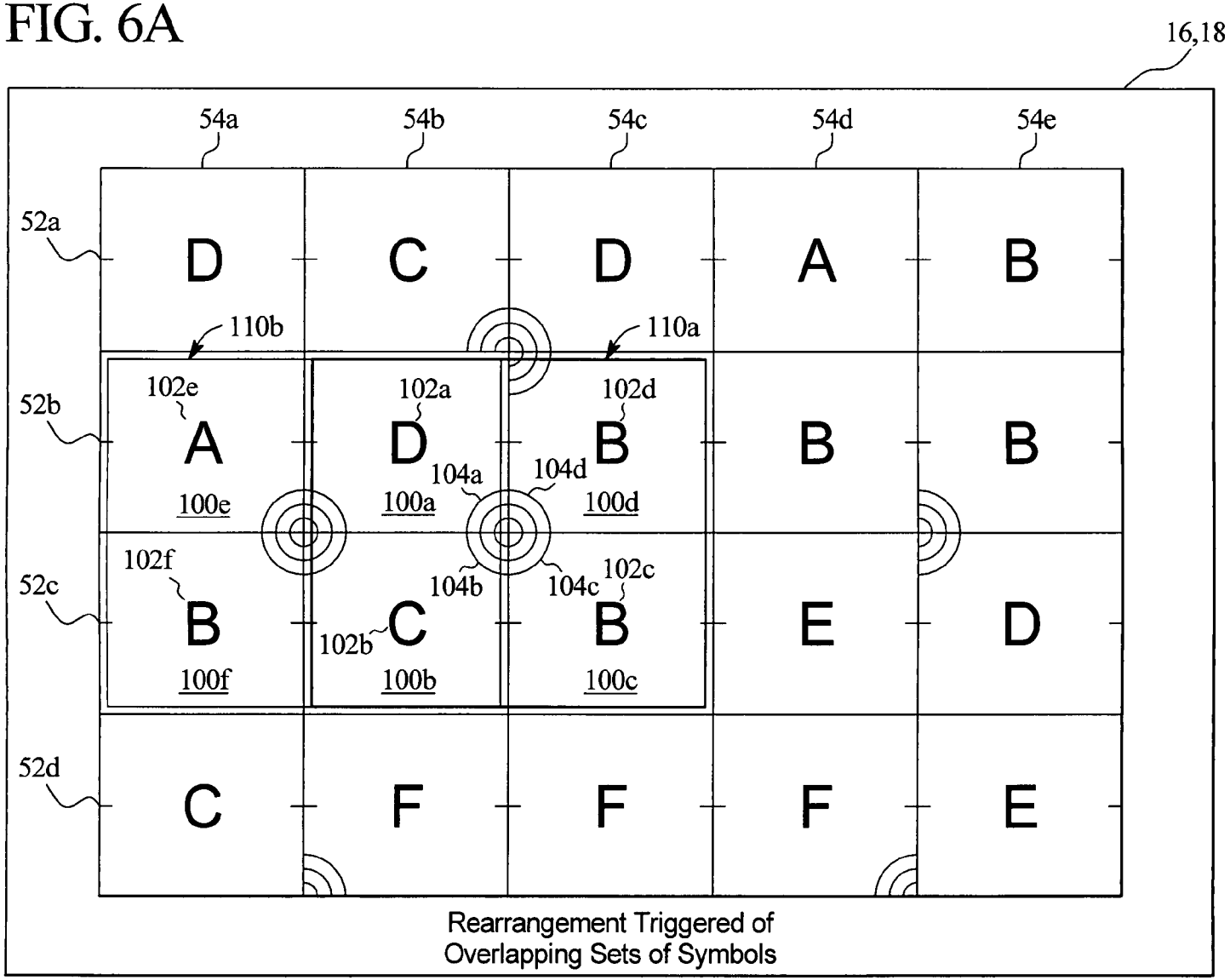
FIGS. 6A, 6B, 6C, 6D and 6E are front perspective views of one embodiment of the present invention illustrating a rearrangement of two overlapping sets of symbols.
Figure 6B:
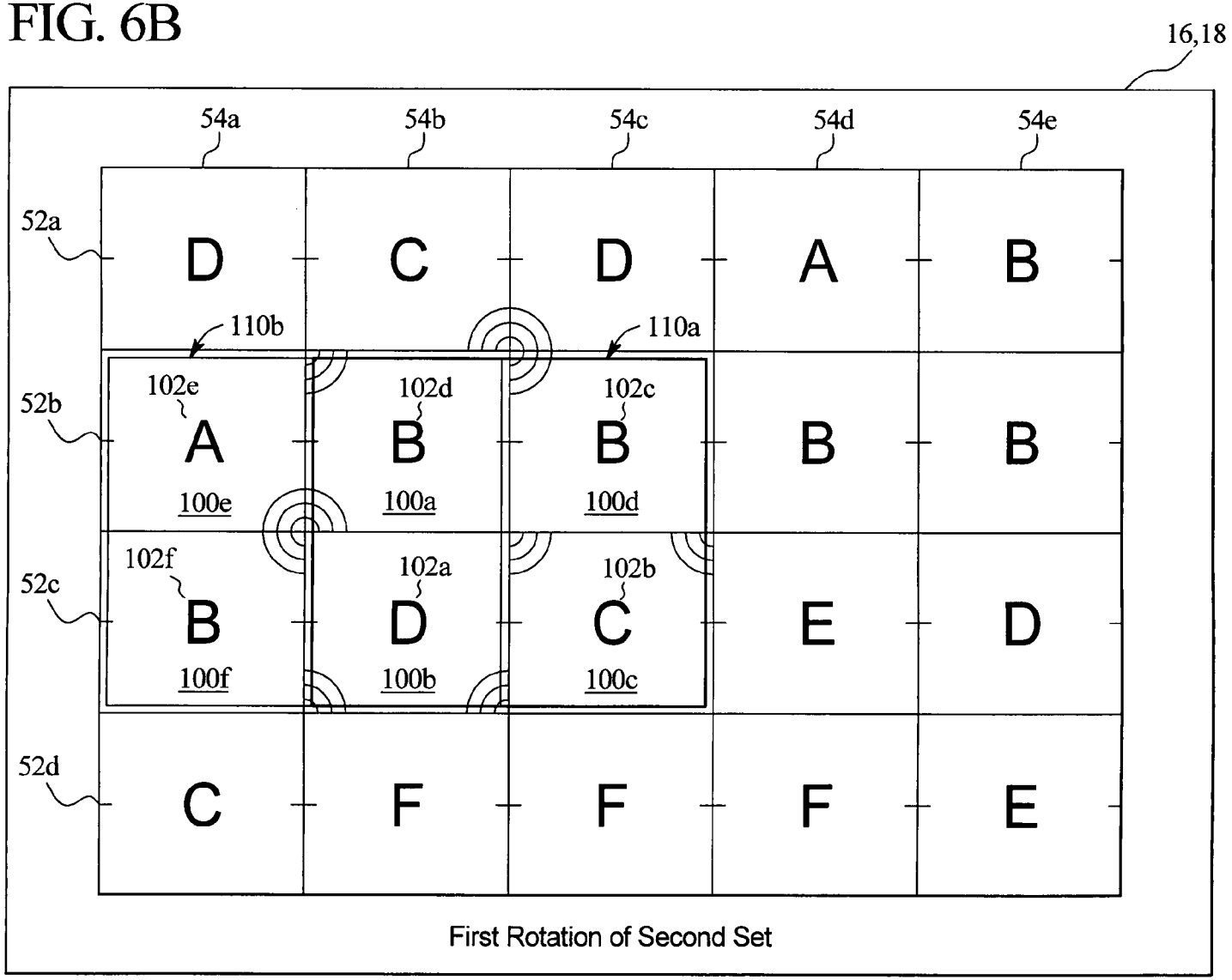

Referring now to FIGS. 6A to 6D, in one embodiment, the order in which two sets of indicated symbols are rotated or rearranged determines whether a player achieves a winning combination on the paylines. FIGS. 6A to 6D illustrate the same displayed symbols in the same fixed positions and the same order of symbols as originally generated in the illustrated display of FIGS. 5A to 5E. In FIG. 6A to 6D, however, the second set of indicated symbols 110*a* on reels 54*b* and 54*c* are rotated or rearranged first instead of the first set of indicated symbols 110*b* on reels 54*a* and 54*b*. Again, in this embodiment, an evaluation of the symbol combinations is made after each alternating rotation or rearrangement of the set of indicated symbols. In FIGS. 6A and 6B, the D symbol 102*a* in fixed position 100*a* on reel 54*b* moves to fixed position 100*b* on reel 54*b*. The C symbol 102*b* in fixed position 100*b* on reel 54*b* moves to fixed position 100*c* on reel 54*c*. The B symbol 102*c* in fixed position 100*c* on reel 54*c* moves to fixed position 100*d* on reel 54*c*. The B symbol 102*d* in fixed position 100*d* on reel 54*c* moves to fixed position 100*a* on the adjacent reel 54*b*. Upon a completed rearrangement of the symbols 102*a* to 102*d*, the gaming device evaluates the paylines on the reels for the winning symbol combinations.

Figure 6C:
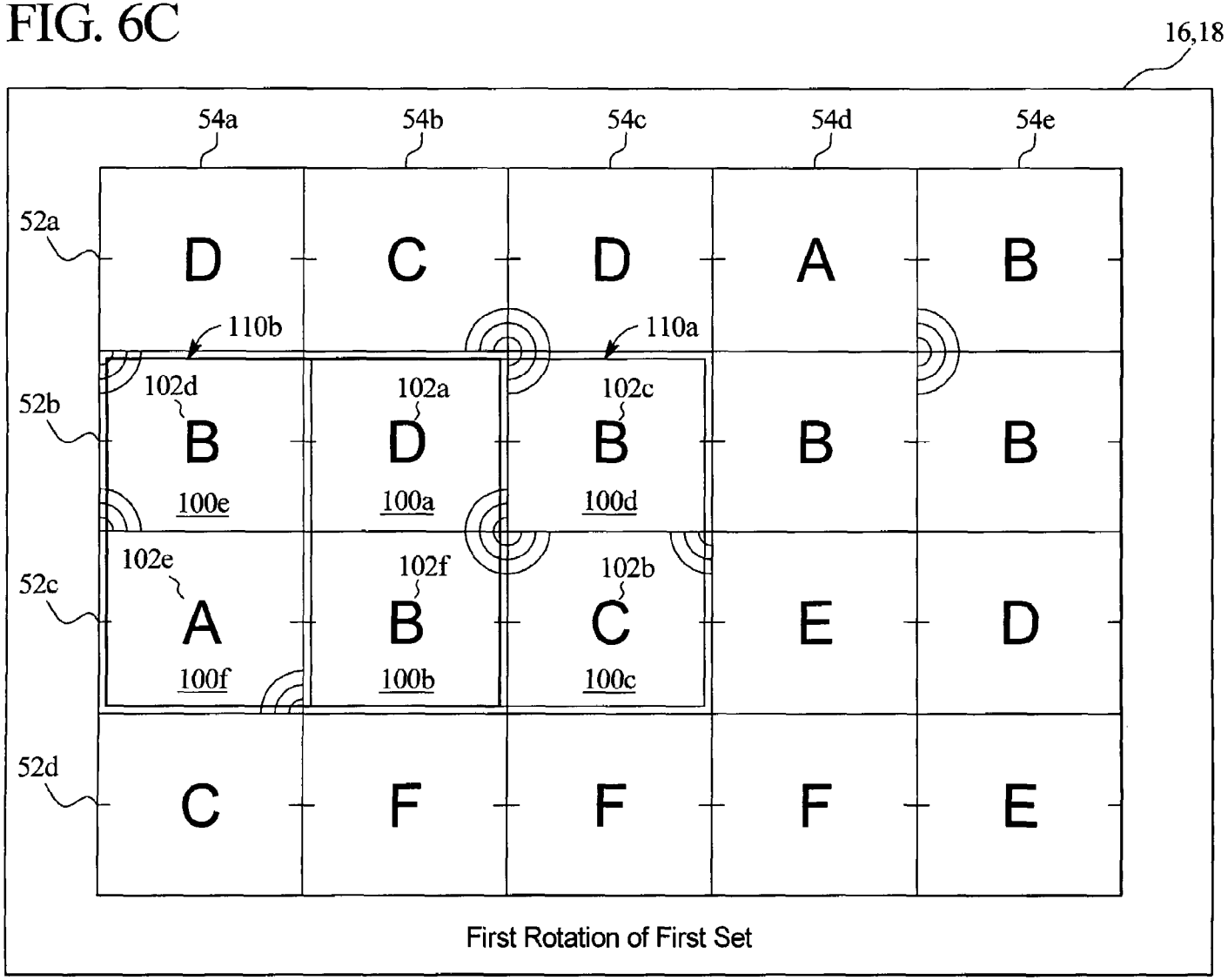
Figure 6D:
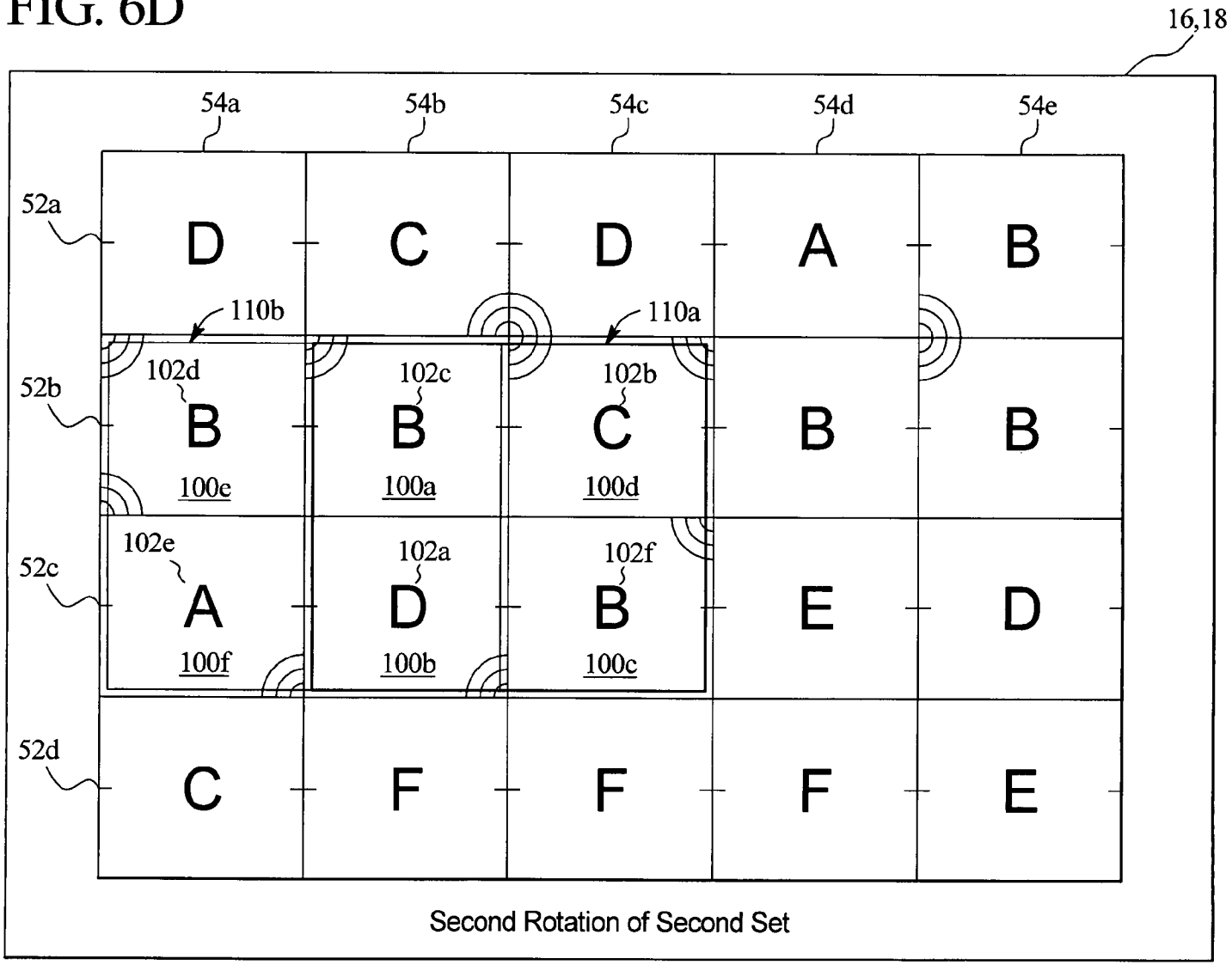
Figure 6E:
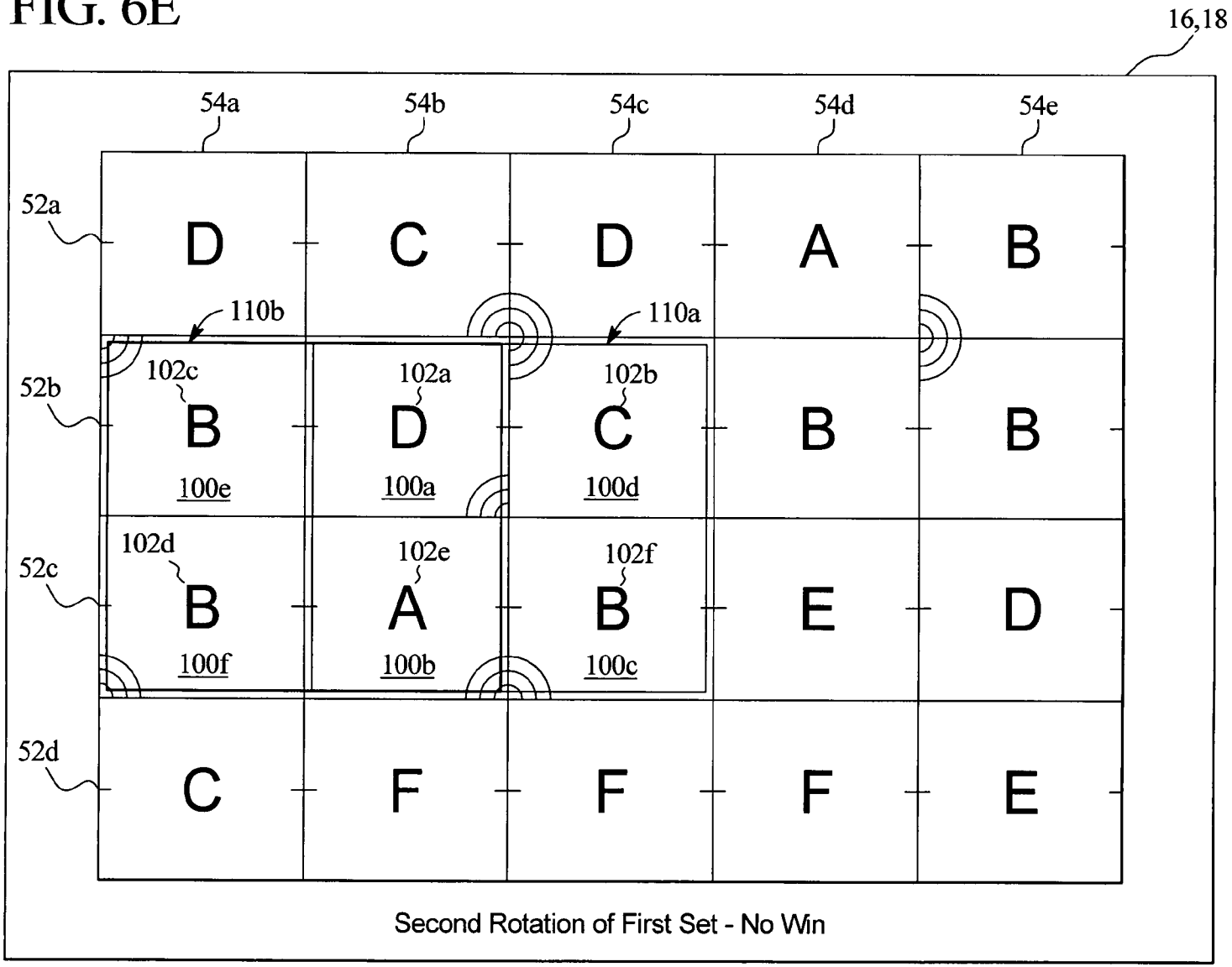

Next, the gaming device rearranges the first set of indicated symbols 110*a*. In FIGS. 6B and 6C, the A symbol 102*e* in fixed position 100*e* on reel 54*a* moves to fixed position 100*f* on reel 54*a*. The B symbol 102*f* in fixed position 100*f* reel 54*a* moves to fixed position 100*b* on the adjacent reel 54*b*. The D symbol 102*a* in fixed position 100*b* on reel 54*b* moves to fixed position 100*a* on reel 54*b*. The B symbol in fixed position 100*a* on reel 54*b* moves to fixed position 100*e* on reel 54*a*. Again, the gaming device makes a determination of whether a winning combination of five symbols exists on the reels and, as illustrated in FIG. 6C, no paylines include a winning combination of symbols. In one embodiment, the gaming device continues to rearrange the sets of indicated symbols in an alternating fashion. In FIGS. 6C and 6D, the D symbol 102*a* in fixed position 100*a* on reel 54*b* moves to fixed position 100*b* on reel 54*b*. The B symbol 102*f* in fixed position 100*b* on reel 54*b* moves to fixed position 100*c* on the adjacent reel 54*c*. The C symbol 102*b* in fixed position 100*c* on reel 54*c* moves to fixed position 100*d* on reel 54*c*. The B symbol 102*c* in fixed position 100*d* on reel 54*c* moves to fixed position 100*a* on the adjacent reel 54*b*. In FIG. 6D, the gaming device makes another determination of whether a winning combination of five symbols on a payline exists, and, upon the completion of another rearrangement of the symbols, no winning combinations exist on any of the paylines. In FIGS. 6D and 6E, the B symbol 102*d* in fixed position 100*e* on reel 54*a* moves to fixed position 100*f* on reel 54*a*. The A symbol 102*e* in fixed position 100*f* on reel 54*a* moves to fixed position 100*b* on the adjacent reel 54*b*. The D symbol 102*a* in fixed position 100*b* on reel 54*b* moves to fixed position 100*a* on reel 54*b*. The B symbol 102*c* in fixed position 100*a* on reel 54*b* moves to fixed position 100*e* on the adjacent reel 54*a*. In FIG. 6E, the gaming device once again makes a determination that no winning combination of five symbols occurs on a payline.

In comparison to the embodiment illustrated in FIGS. 5A to 5E, at this point, after four alternating rearrangements of the indicated symbols of the two sets, the gaming device had generated a winning combination illustrated in FIG. 5E. It should, therefore, be appreciated that the order in which alternating rearrangements of two overlapping sets of indicated symbols are performed may result in different outcomes. In an embodiment where the rearrangement of the indicated symbols continues until the symbols return to their original fixed positions, as illustrated in FIG. 6A, and where no winning combination of symbols is produced on the paylines, the player will not receive an award on this spin of the reels.

In an alternative embodiment, the present invention is adapted to be played in games without reels. Instead of spinning the reels, each symbol display area or position on which a symbol is displayed is rearranged in relation to the other symbol display positions to establish a first position of the symbol display positions. If swapping indicators associated with the symbols form a predetermined configuration, the indicated symbols are rearranged to different symbol display positions whereupon the gaming device re-evaluates the combination of symbols.

Alternative Embodiment

Referring now to FIGS. 7A to 7D, in one embodiment of the present invention, the gaming device displays a plurality of fixed positions on each of five reels 54*a*, 54*b*, 54*c*, 54*d* and 54*e*. The fixed positions on each of the five reels include fixed positions 100*a*, 100*b*, and 100*c* on reel 54*a*; fixed positions, 100*d*, 100*e*, and 100*f* on reel 54*b*; fixed positions, 100*g*, 100*h*, and 100*i* on reel 54*c*; fixed positions, 100*j*, 100*k*, and 100*l* on reel 54*d*; and fixed positions, 100*m*, 100*n* and 100*o* on reel 54*e*. The illustrated gaming device includes three paylines 56*a*, 56*b* and 56*c* associated with the reels. It should be appreciated that other paylines can be included in the game. The illustrated gaming device also includes a plurality of symbols 102 which, in this example, are represented by the letters A 102*a*, B 102*b*, C 102*c*, D 102*d*, E 102*e*, F 102*f*, G 102*g*, H 102*h*, I 102*i*, J 102*j*, K 102*k*, L 102*l*, M 102*m*, N 102*n* and O 102*o* displayed at the reels 54*a*, 54*b*, 54*c*, 54*d* and 54*e* in FIG. 7A. It should be appreciated that the gaming device can include any suitable number of symbols, and the symbols can include any suitable character, numeral, indicia, or image.

Figure 7A:
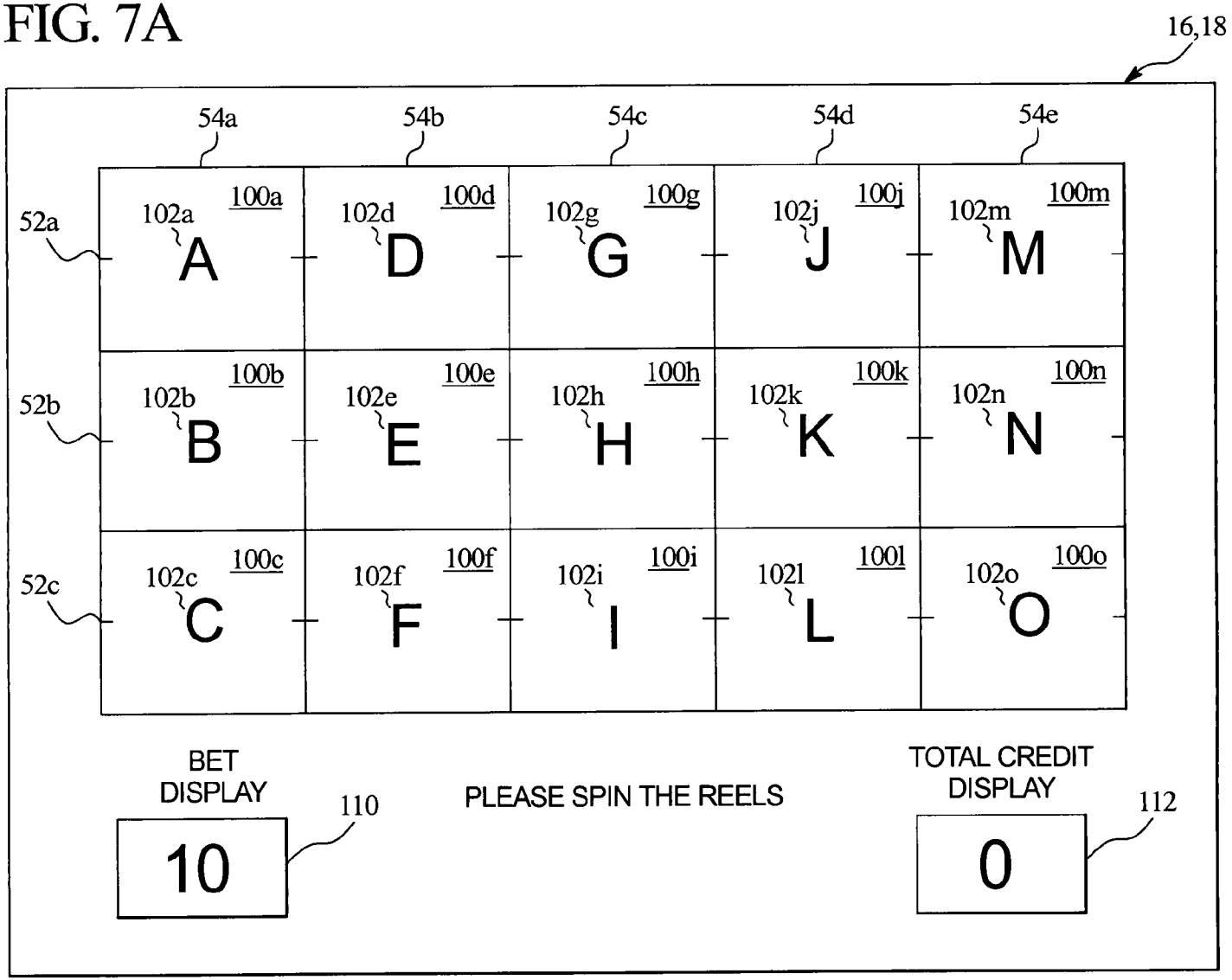
FIGS. 7A, 7B, 7C and 7D are front perspective views of one embodiment of the present invention illustrating one type of rearrangement of the outermost symbols displayed on a reel display.
Figure 7B:
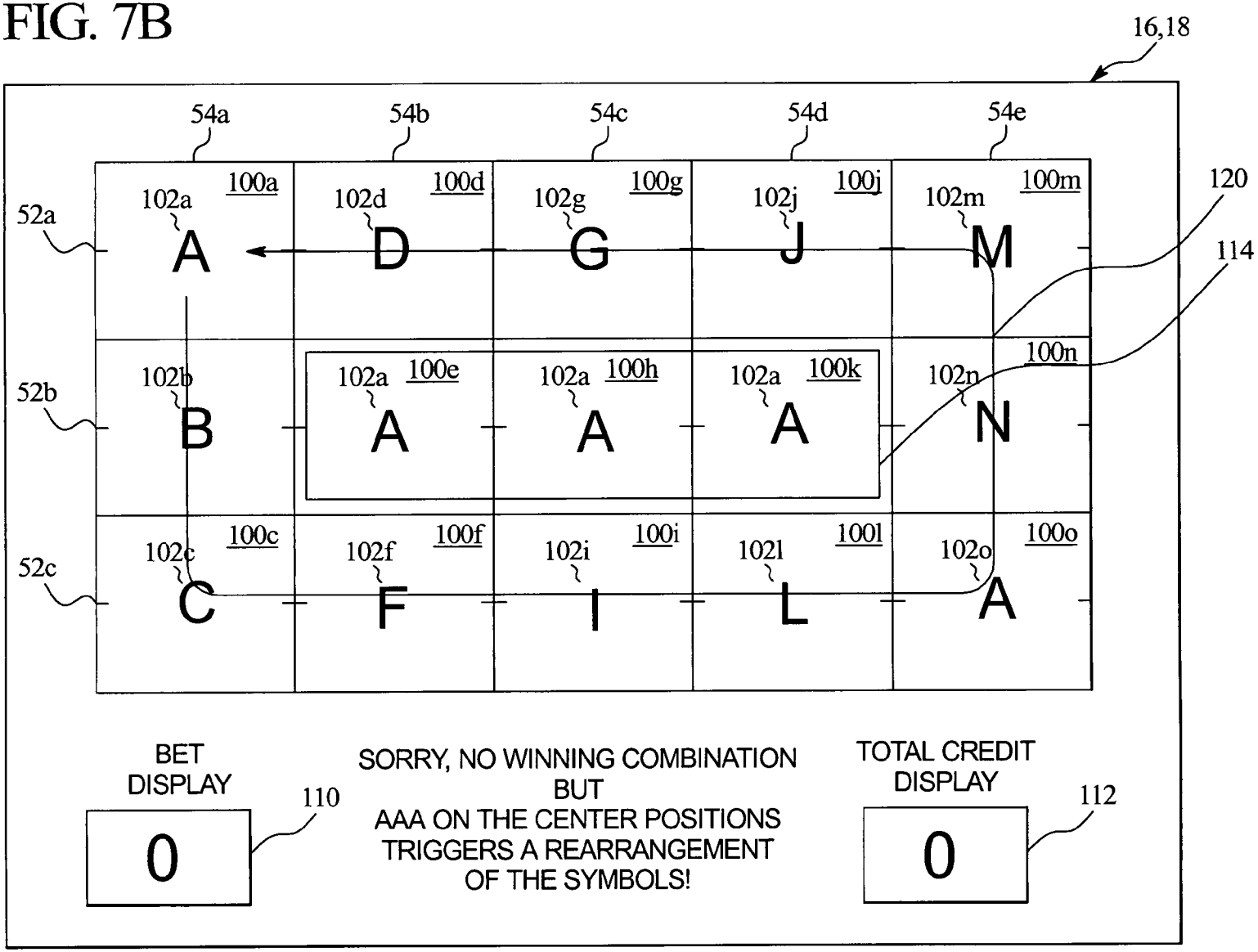

The game begins by activating the reels of FIG. 7A to display a plurality of symbols in FIG. 7B. The bet display 110 is decreased by the number of credits wagered on the reels. In one embodiment, the gaming device performs an evaluation of the symbols and provides at least one award to the player for any winning combination generated on the reels before determining whether a triggering event has occurred. In the embodiment illustrated in FIG. 7B, a triggering event initiates a symbol movement or series of movements or movement sequence which constitutes a rearrangement of certain predetermined symbols along a predetermined rearrangement path 120. In this embodiment, the triggering event includes the generation of a combination of symbols on a plurality of predetermined triggering positions. In one embodiment, each of the predetermined triggering positions are surrounded by fixed positions that are adjacent on each side of the predetermined triggering positions. The predetermined triggering positions of the illustrated embodiment, for example, include the three center fixed positions, 100*e*, 100*h* and 100*k*. The generation of a combination of A symbols 114 on the predetermined triggering positions 100*e*, 100*h* and 100*k* in FIG. 7B initiates the symbol swapping rearrangement illustrated in FIGS. 7C to 7D. It should be appreciated that the triggering event can include the generation of a designated symbol in a predetermined triggering position. It should be further appreciated that the triggering event can include the triggering event described in the embodiment discussed above which occurs when swapping indicators are aligned in a predetermined configuration. Other triggering events can include the generation of a designated symbol such as a wild symbol, player-designated symbol(s) or any combination of symbols.

A rearrangement path of one embodiment of the present invention includes fixed positions arrayed on the perimeter of the plurality of fixed positions. These outermost fixed positions 100*a*, 100*b*, 100*c*, 100*f*, 100*i*, 100*l*, 100*o*, 100*n*, 100*m*, 100*j*, 100*g*, and 100*d* illustrated in FIGS. 7B and 7C define the rearrangement path 120. The movement sequence of the rearrangement in FIG. 7C, then, includes movement of the symbols displayed at the outer fixed positions along the rearrangement path on the perimeter of the display. Also, in this embodiment, the A symbols 102*a* displayed at the predetermined triggering positions 100*e*, 100*h* and 100*k* are locked and do not participate in the rearrangement. In one embodiment, the gaming device enables the player to pick the positions to be locked and around which the symbols displayed in the fixed positions around the locked positions are rearranged.

In one embodiment, the movement from the original fixed position to a different fixed position occurs in a predetermined direction and through a predetermined number of fixed positions. This directional shift of symbols comprises a movement sequence of a rearrangement. In one embodiment, each of the symbols displayed at fixed positions along each rearrangement path move in the same direction and move through the same number of fixed positions to complete a movement sequence of a symbol swapping rearrangement along that rearrangement path. In one embodiment, each of the symbols displayed at fixed positions along each rearrangement path move to each of the fixed positions along the rearrangement path to complete a movement sequence of a symbol swapping rearrangement along that rearrangement path. It should be appreciated that the symbol swapping rearrangement can include movement sequences along a combination of different rearrangement paths.

Figure 7C:
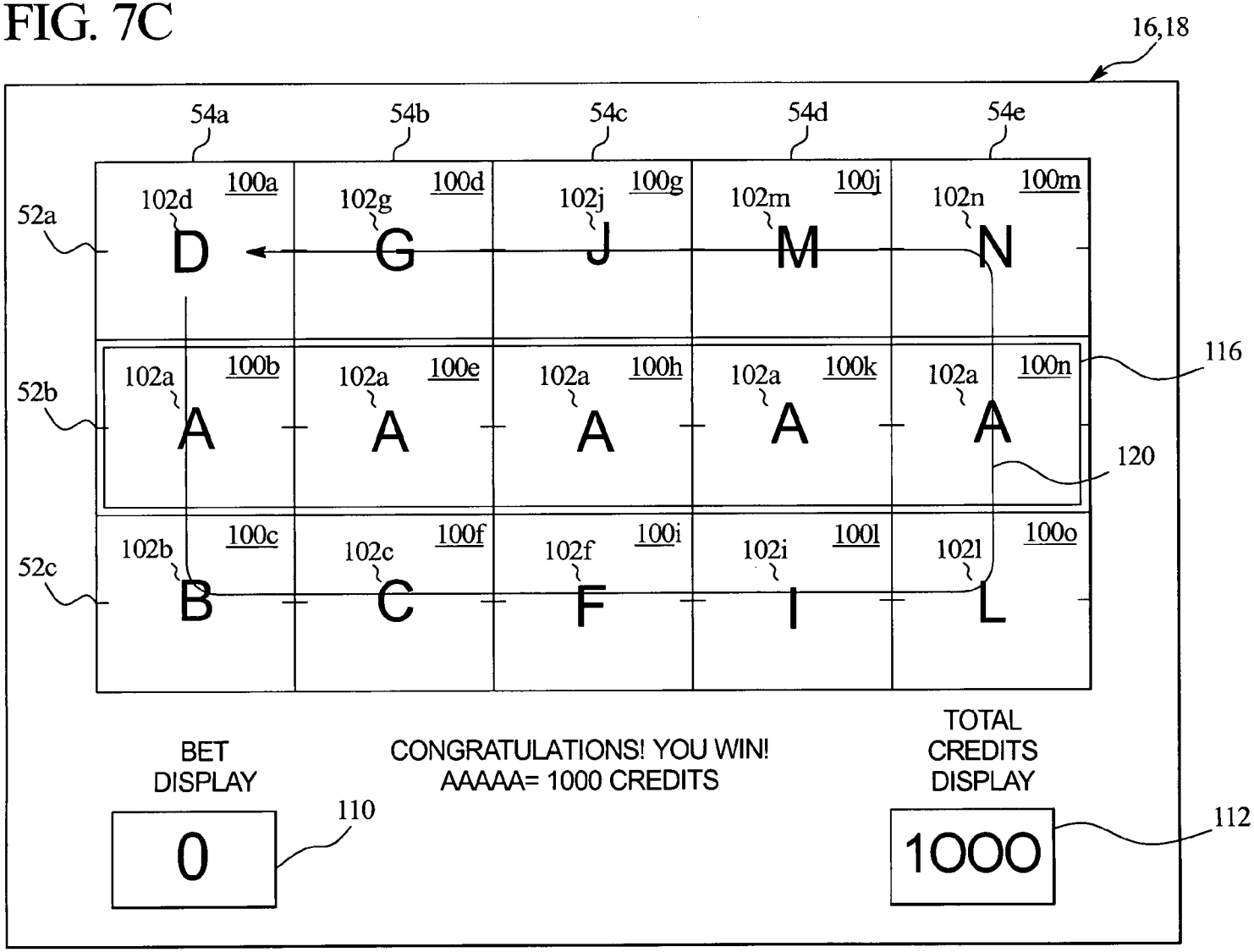

FIGS. 7B and 7C illustrate an example of a specific movement sequence of the symbols displayed at the outer fixed positions of the perimeter of the plurality of fixed positions. The movement sequence of a symbol swapping rearrangement of one embodiment of the present invention includes movement in a counter-clockwise fashion along the rearrangement path 120 to immediately adjacent fixed positions. For example, in FIG. 7B, the A symbol 102*a* in fixed position 100*a* of reel 54*a* moves to the fixed position 100*b* on reel 54*a*. The B symbol 102*b* in fixed position 100*b* on reel 54*a* moves to the fixed position 100*c* on reel 54*a*. The C symbol 102*c* in fixed position 100*c* on reel 54*a* moves to the fixed position 100*f* on adjacent reel 54*b*. The F symbol 102*f* in fixed position 100*f* on reel 54*b* moves to the fixed position 100*i* on the adjacent reel 54*c*. The I symbol 102*i* in fixed position 100*i* on reel 54*c* moves to the fixed position 100*l* on the adjacent reel 54. The L symbol 102*l* in fixed position 100*l* on reel 54*d* moves to the fixed position 100*o* on the adjacent reel 54*e*. The A symbol 102*a* in fixed position 100*o* on reel 54*e* moves to the fixed position 100*n* on reel 54*e*. The N symbol 102*n* in fixed position 100*n* on reel 54*e* moves to the fixed position 100*m* on the adjacent reel 54*e*. The M symbol 102*m* in fixed position 100*m* on reel 54*e* moves to the fixed position 100*j* on the adjacent reel 54*d*. The J symbol 102*j* in fixed position 100*j* on reel 54*d* moves to the fixed position 100*g* on the adjacent reel 54*c*. The G symbol 102*g* in fixed position 100*g* on reel 54*c* moves to the fixed position 100*d* on adjacent reel 54*b*. Finally, the D symbol 102*d* in fixed position 100*d* moves to the fixed position 100*a* on the adjacent reel 54*a*. This symbol movement completes a single movement sequence in the counter-clockwise direction along the rearrangement path 120.

In one embodiment illustrated in FIG. 7C, five A symbols 116 displayed along payline 52*b* as a result of the rearrangement constitute a winning combination. In one embodiment, a player is provided at least one award or outcome for any winning combination determined by the gaming device. In FIG. 7C, for example, the player is provided an award of one thousand credits corresponding to the winning combination and indicated by the total credits display 112. In one embodiment, a determination of a winning combination occurs on the modified reels after each single position or multiple-position movement. It should be appreciated that a determination of a winning combination on the modified reels can occur after every predetermined movement sequence which can include combinations of single or multiple position movements.

Figure 7D:
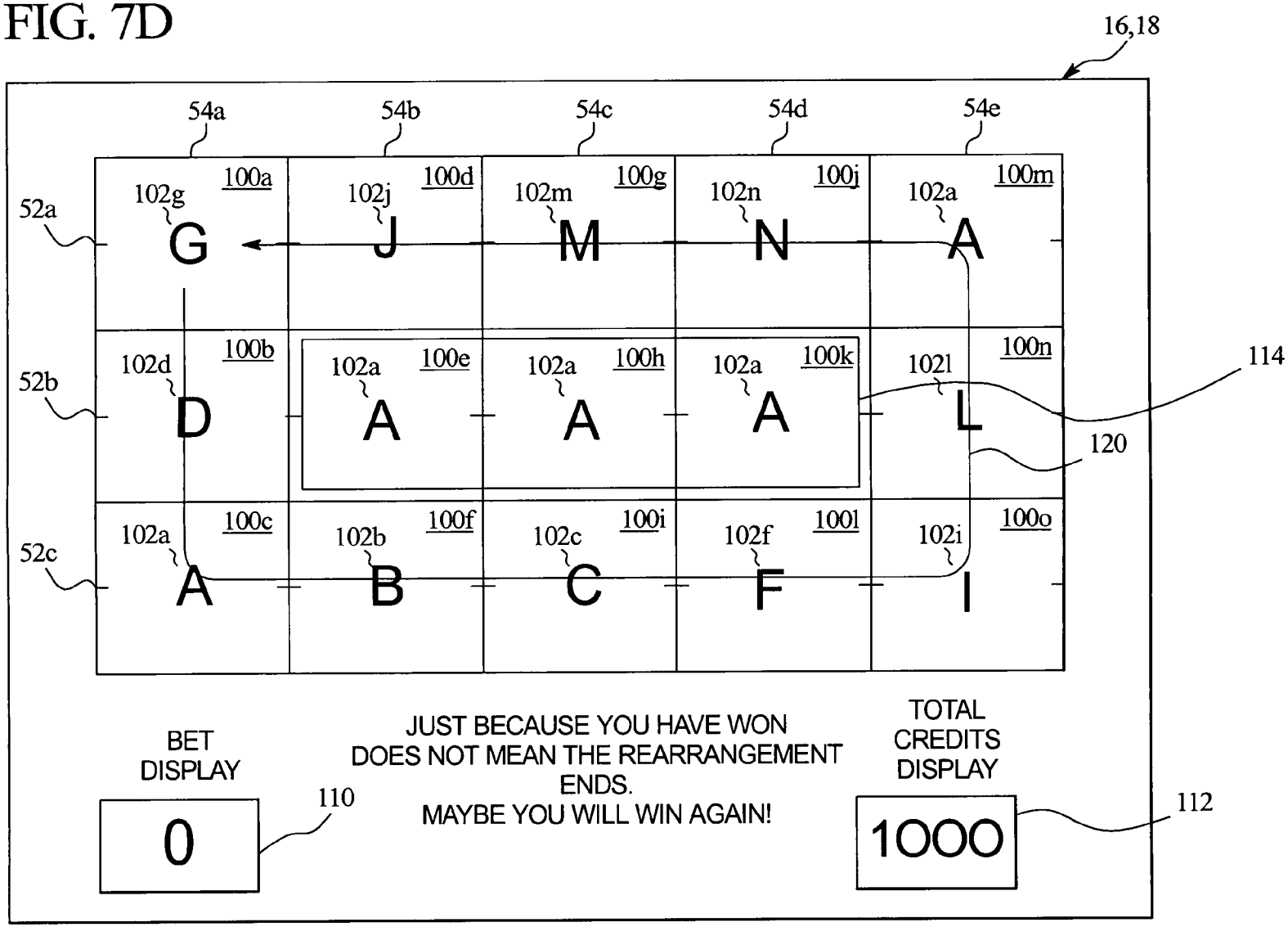

It should be further appreciated that additional rearrangements can occur even though a winning combination is generated on the reels. In FIG. 7D, for example, although a winning combination has occurred in the game illustrated in FIG. 7C, the rearrangements can continue with the player being eligible to win awards associated with other winning combinations resulting from subsequent symbol rearrangements. In addition, other rearrangement triggering events can result from subsequent symbol rearrangements causing the symbols to be further rearranged a predetermined number of times.

Figure 8A:
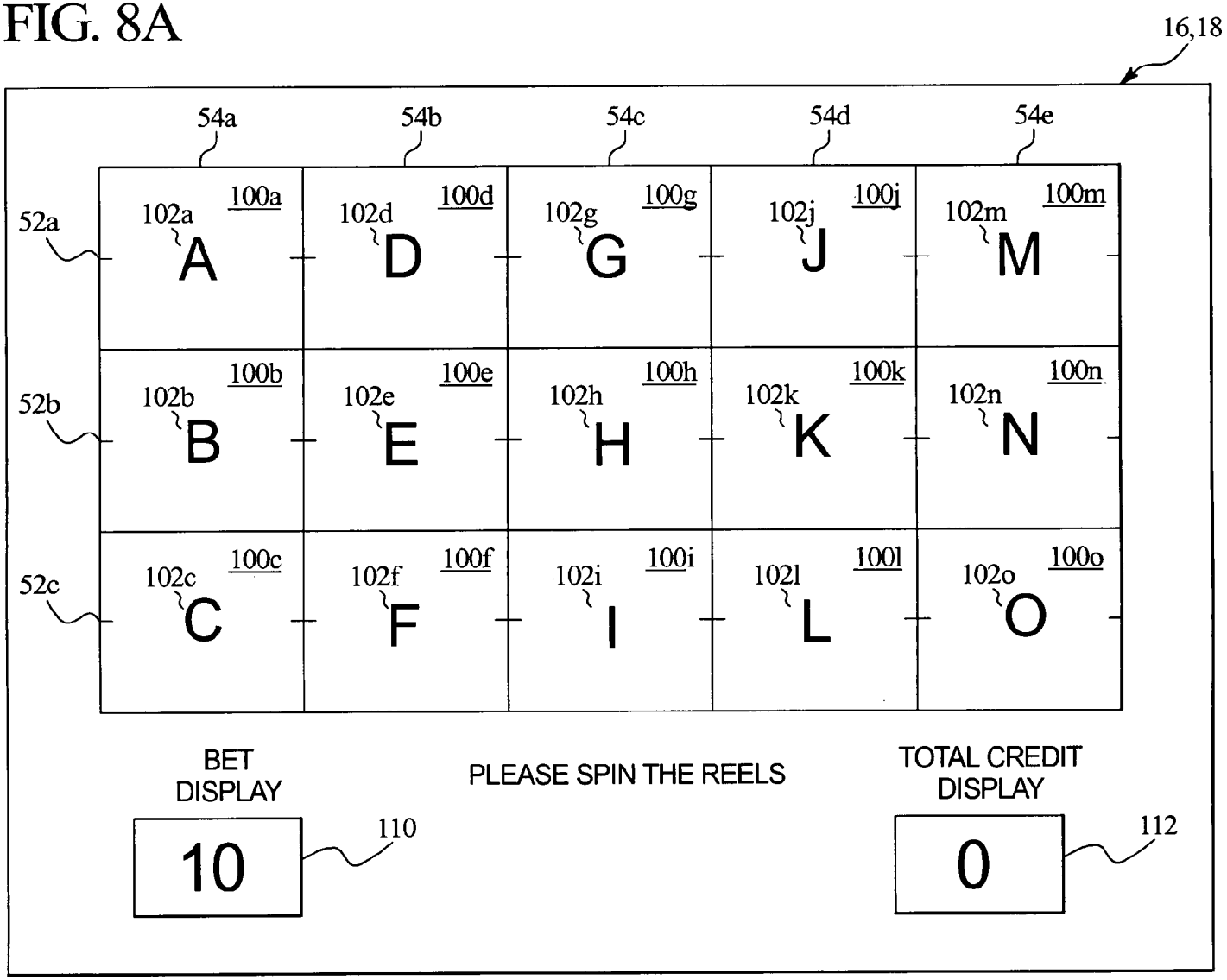
FIGS. 8A, 8B and 8C are front perspective views of one embodiment of the present invention illustrating one type of rearrangement of the outermost symbols displayed on a reel display.
Figure 8B:
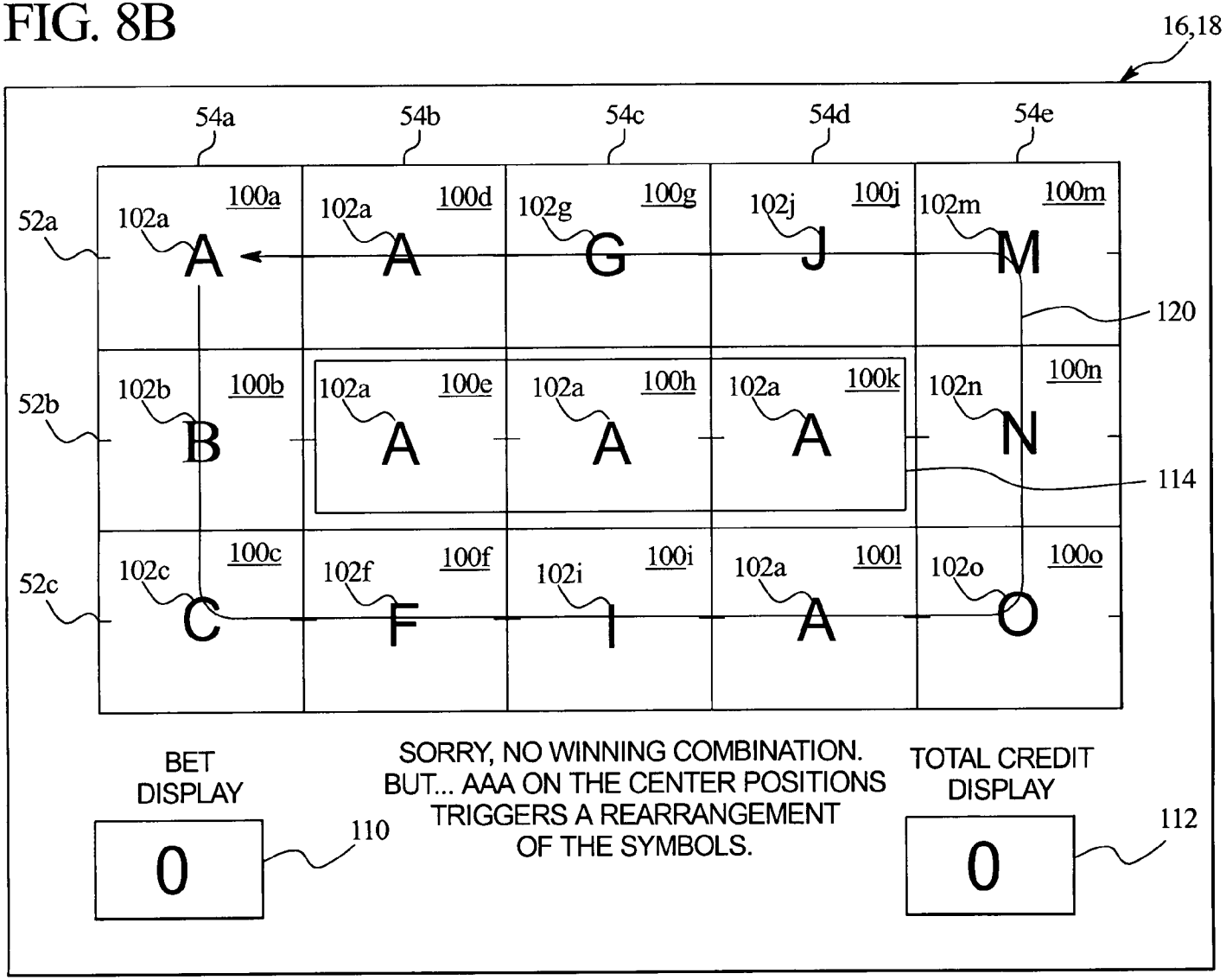
Figure 8C:
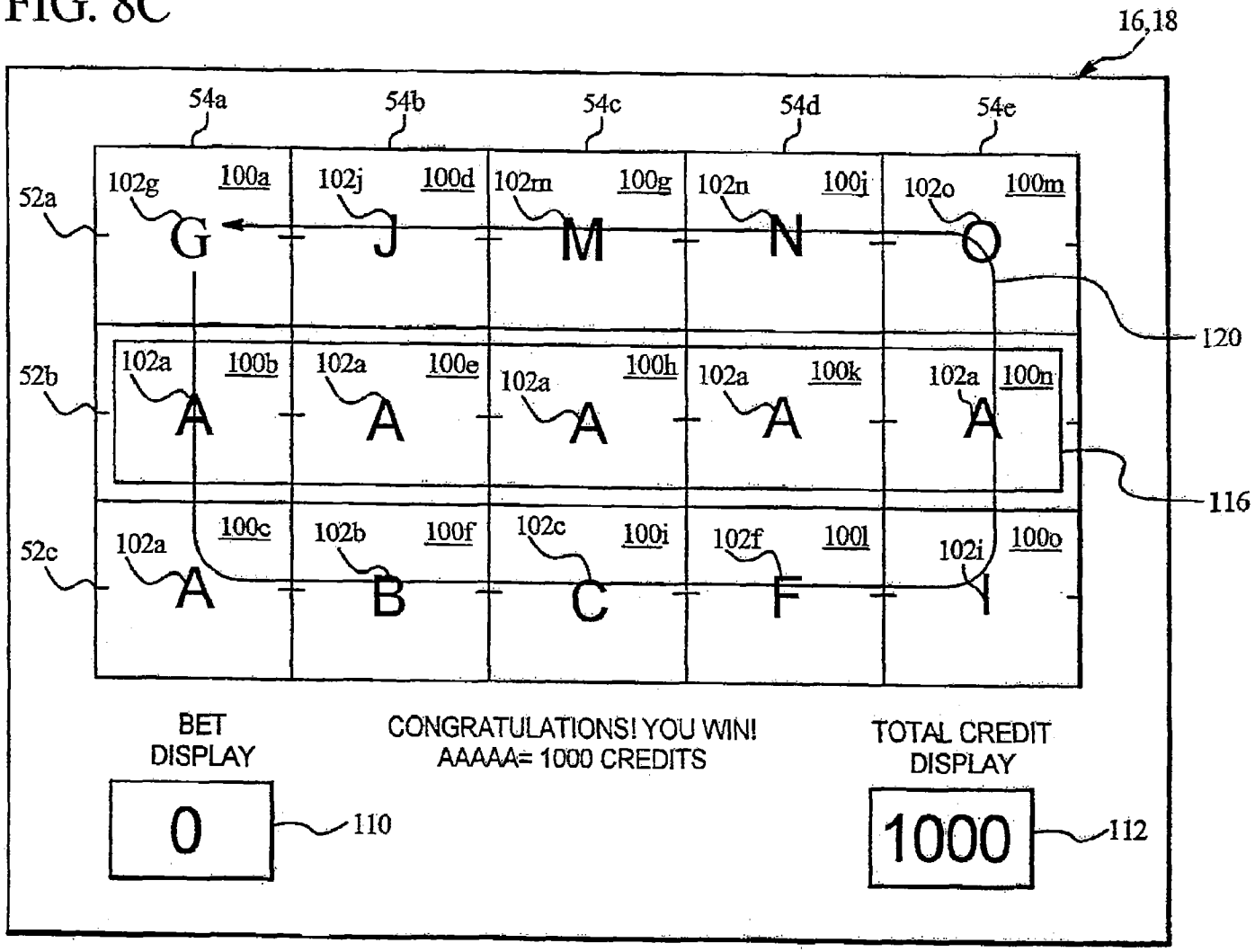

Examples of other types of movement sequences along different rearrangement path configurations contemplated by the present invention include moving at least one symbol through a plurality of fixed positions. The movement sequence of a symbol swapping rearrangement of one embodiment includes movement in a counter-clockwise fashion along the rearrangement path 120 through a predetermined number of fixed positions. The reels illustrated in FIG. 8A are activated, and no winning combination occurs on the reels. However, in the embodiment illustrated in FIG. 8B, a triggering condition for a rearrangement occurs. FIGS. 8B and 8C illustrate an example of an alternative movement sequence of the symbols displayed at the outer fixed positions of the perimeter of the plurality of fixed positions. For example, the A symbol 102*a* in fixed position 100*a* of reel 54*a* in FIG. 8B moves through fixed position 100*b* on reel 54*a* to the fixed position 100*c* on reel 54*a* illustrated in FIG. 8C. The B symbol 102*b* in fixed position 100*b* on reel 54*a* moves through fixed position 100*c* on reel 54*a* to the fixed position 100*f* on adjacent reel 54*b*. The C symbol 102*c* in fixed position 100*c* on reel 54*a* moves through fixed position 100*f* on the adjacent reel 54*b* to the fixed position 100*i* on reel 54*c*. The F symbol 102*f* in fixed position 100*f* on reel 54*b* moves through fixed position 100*i* on the adjacent reel 54*c* to the fixed position 100*l* on reel 54*d*. The I symbol 102*i* in fixed position 100*i* on reel 54*c* moves through fixed position 100*l* on the adjacent reel 54*d* to the fixed position 100*o* on reel 54*e*. The A symbol 102*a* in fixed position 100*l* on reel 54*d* moves through fixed position 100*o* on the adjacent reel 54*e* to the fixed position 100*n* on reel 54*e*. The O symbol 102*o* in fixed position 100*o* on reel 54*e* moves through fixed position 100*n* on reel 54*e* to the fixed position 100*m* on reel 54*e*. The N symbol 102*n* in fixed position 100*n* on reel 54*e* moves through fixed position 100*m* on reel 54*e* to the fixed position 100*j* on the adjacent reel 54*d*. The M symbol 102*m* in fixed position 100*m* on reel 54*e* moves through fixed position 100*j* on reel 54*d* to the fixed position 100*g* on reel 54*c*. The J symbol 102*j* in fixed position 100*j* on reel 54*d* moves through fixed position 100*g* on the adjacent reel 54*c* to the fixed position 100*d* on reel 54*b*. The G symbol 102*g* in fixed position 100*j* on reel 54*c* moves through fixed position 100*d* on reel 54*b* to the fixed position 100*a* on reel 54*a*. Finally on reel 54*b*, the A symbol 102*a* in fixed position 100*d* moves through fixed position 100*a* to the fixed position 100*b* on the adjacent reel 54*a*. This completes a single movement sequence through a predetermined number of fixed positions in the counter-clockwise direction along the rearrangement path 120. As indicated by the total credits display 112, the player is provided one thousand credits corresponding to the winning combination of five A symbols 114 on activated payline 56*b* according to the illustrated embodiment.

Figure 9A:
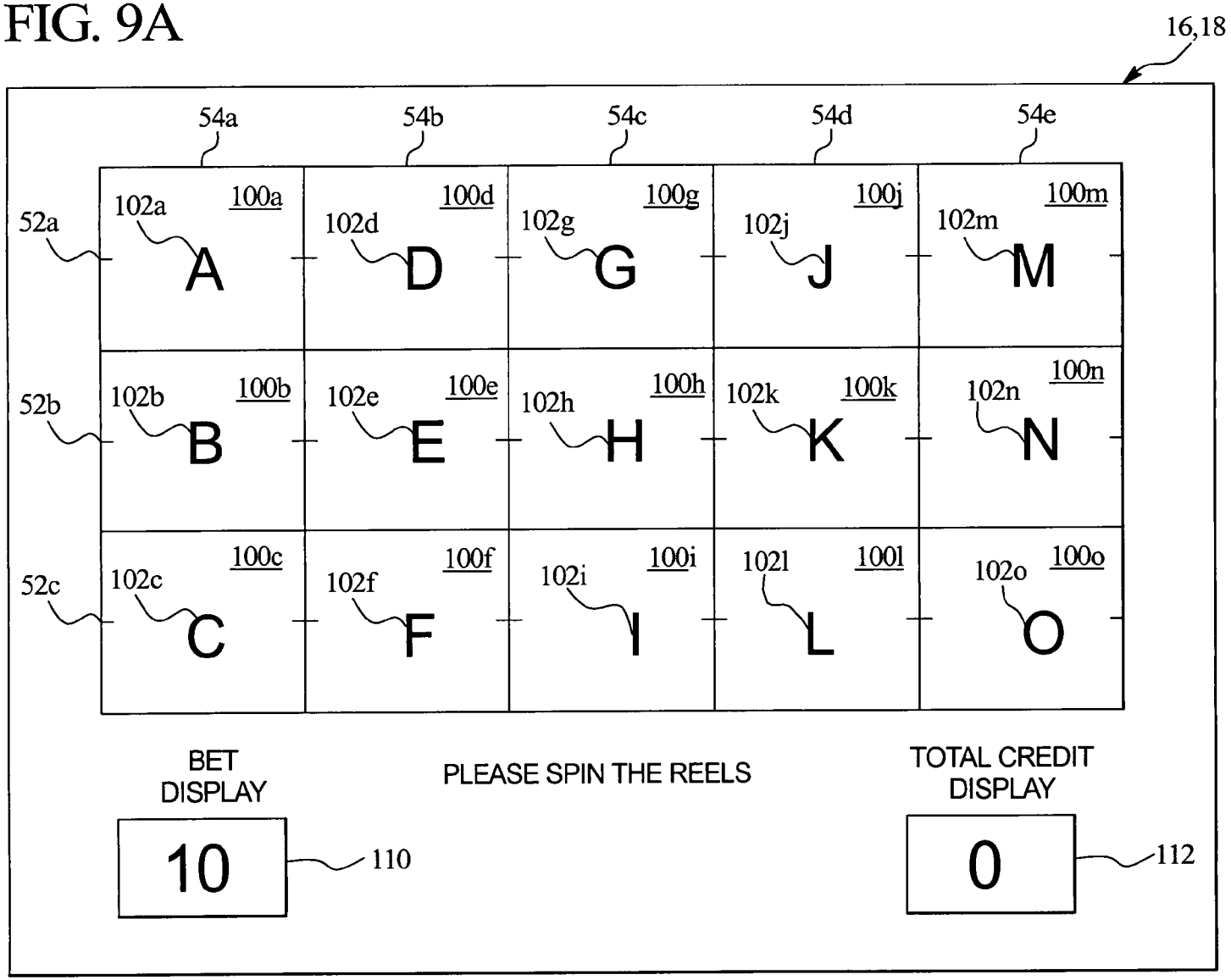
FIGS. 9A, 9B and 9C are front perspective views of one embodiment of the present invention illustrating one type of rearrangement of the outermost symbols displayed on a reel display.
Figure 9B:
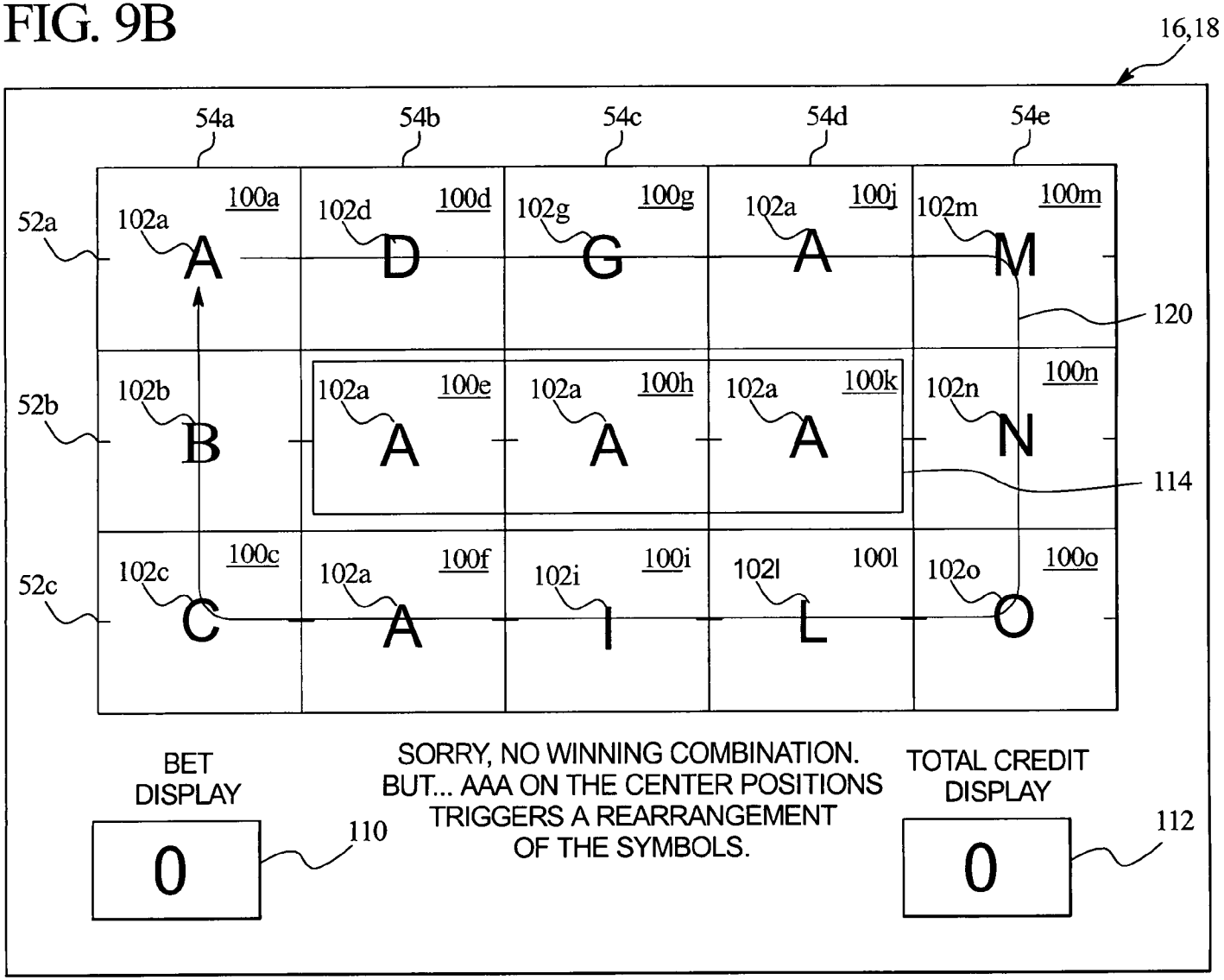
Figure 9C:
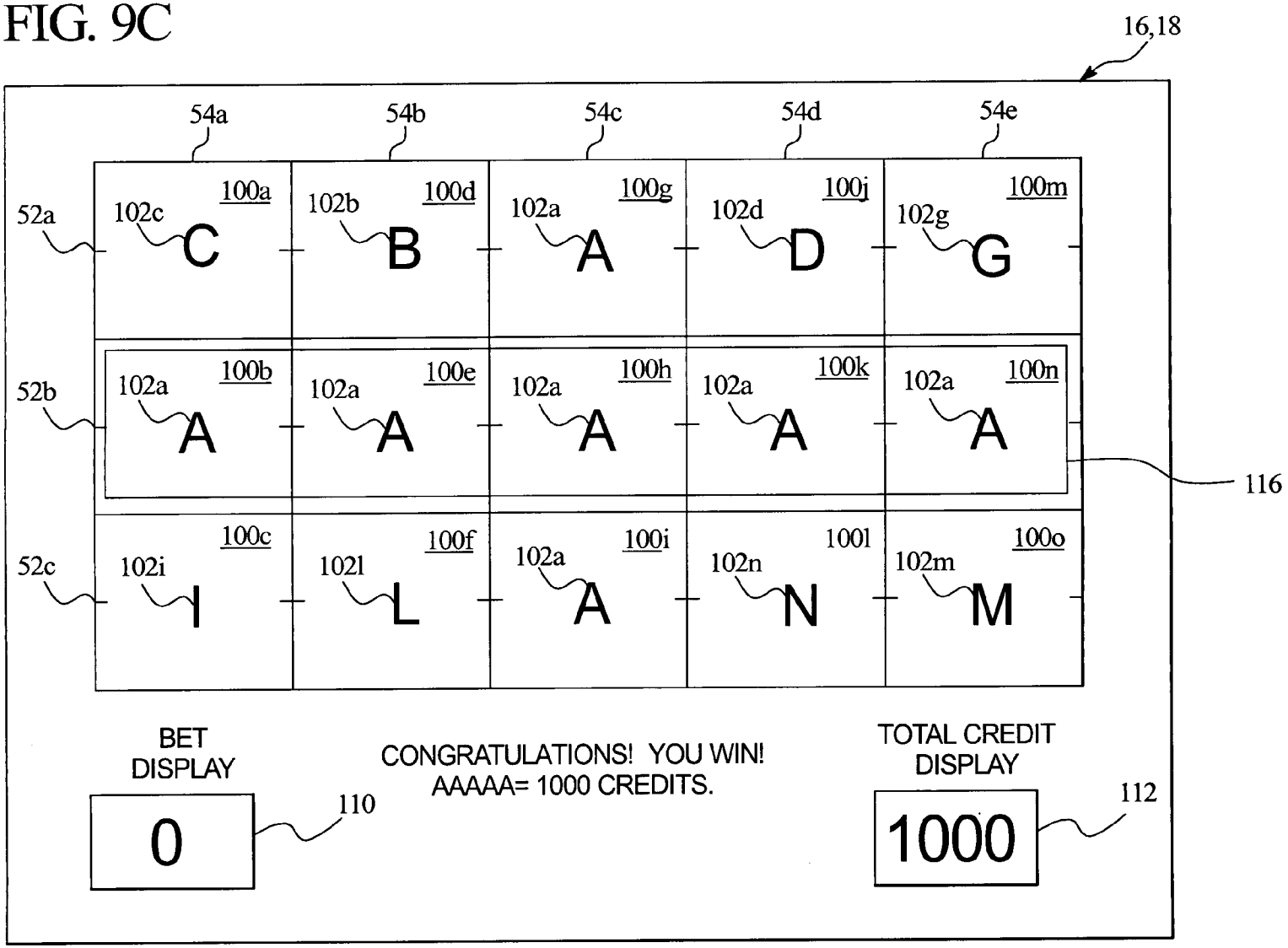

Furthermore, other types of movement sequences along different rearrangement path configurations include moving at least one symbol in a plurality of directions. As illustrated in FIGS. 9B and 9C, movement can occur in a clockwise fashion along the rearrangement path 120 through a predetermined number of fixed positions. For example, the A symbol 102*a* in fixed position 100*a* of reel 54*a* in FIG. 9B moves clockwise through fixed position 100*d* on the adjacent reel 54*b* to the fixed position 100*g* on reel 54*c* illustrated in FIG. 9C. The B symbol 102*b* in fixed position 100*b* on reel 54*a* moves through fixed position 100*a* on reel 54*a* to the fixed position 100*d* on the adjacent reel 54*b*. The C symbol 102*c* in fixed position 100*c* on the adjacent reel 54*a* moves through fixed position 100*b* on reel 54*a* to the fixed position 100*a* on reel 54*a*. The A symbol 102*a* in fixed position 100*f* on reel 54*b* moves through fixed position 100*c* on the adjacent reel 54*a* to the fixed position 100*b* on reel 54*a*. The I symbol 102*i* in fixed position 100*i* on reel 54*c* moves through fixed position 100*f* on the adjacent reel 54*b* to the fixed position 100*c* on reel 54*a*. The L symbol 102*l* in fixed position 100*l* on reel 54*d* moves through fixed position 100*i* on the adjacent reel 54*c* to the fixed position 100*f* on reel 54*b*. The O symbol 102*o* in fixed position 100*o* on reel 54*e* moves through fixed position 100*l* on the adjacent reel 54*d* to the fixed position 100*i* on reel 54*c*. The N symbol 102*n* in fixed position 100*n* on reel 54*e* moves through fixed position 100*o* on reel 54*e* to the fixed position 100*l* on the adjacent reel 54*d*. The M symbol 102*m* in fixed position 100*m* on reel 54*e* moves through fixed position 100*n* on reel 54*e* to the fixed position 100*o* on reel 54*e*. The A symbol 102*a* in fixed position 100*j* on reel 54*d* moves through fixed position 100*m* on the adjacent reel 54*e* to the fixed position 100*n* on reel 54*e*. The G symbol 102*g* in fixed position 100*g* on reel 54*c* moves through fixed position 100*j* on the adjacent reel 54*d* to the fixed position 100*m* on reel 54*e*. Finally, the D symbol 102*d* in fixed position 100*d* moves through fixed position 100*g* on the adjacent reel 54*c* to the fixed position 100*j* on reel 54*d*. This series of symbol movements completes a symbol rearrangement in the clockwise direction along the rearrangement path 120 and produces a winning combination of A symbols 114 along payline 52*b*. It should be appreciated that a symbol swapping arrangement of the present invention can include any of the different movement sequences illustrated and discussed above and combinations thereof.

Figure 10A:
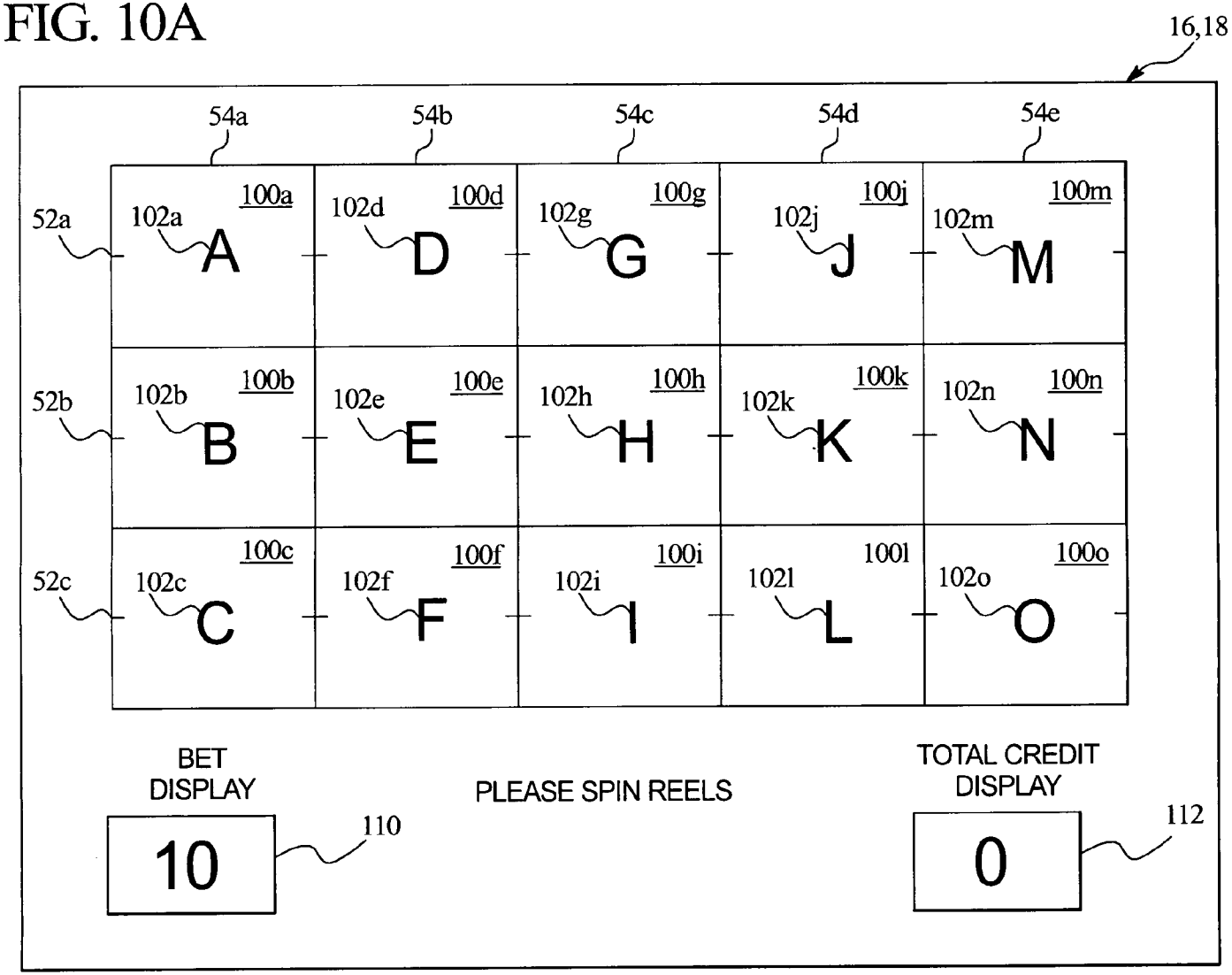
FIGS. 10A, 10B, and 10C are front perspective views of one embodiment of the present invention illustrating a rearrangement of all of the displayed symbols, including the triggering symbols.
Figure 10B:
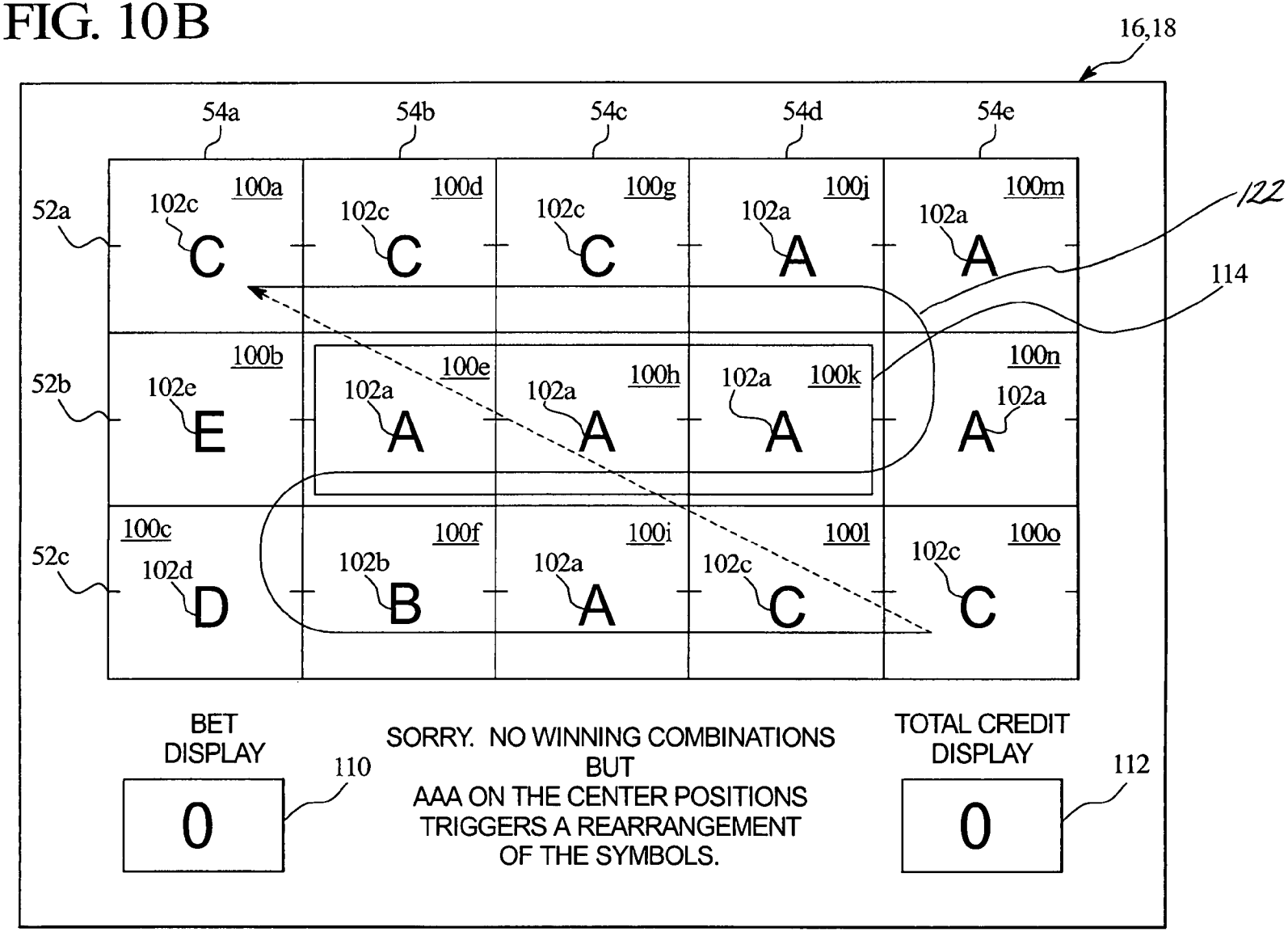
Figure 10C:
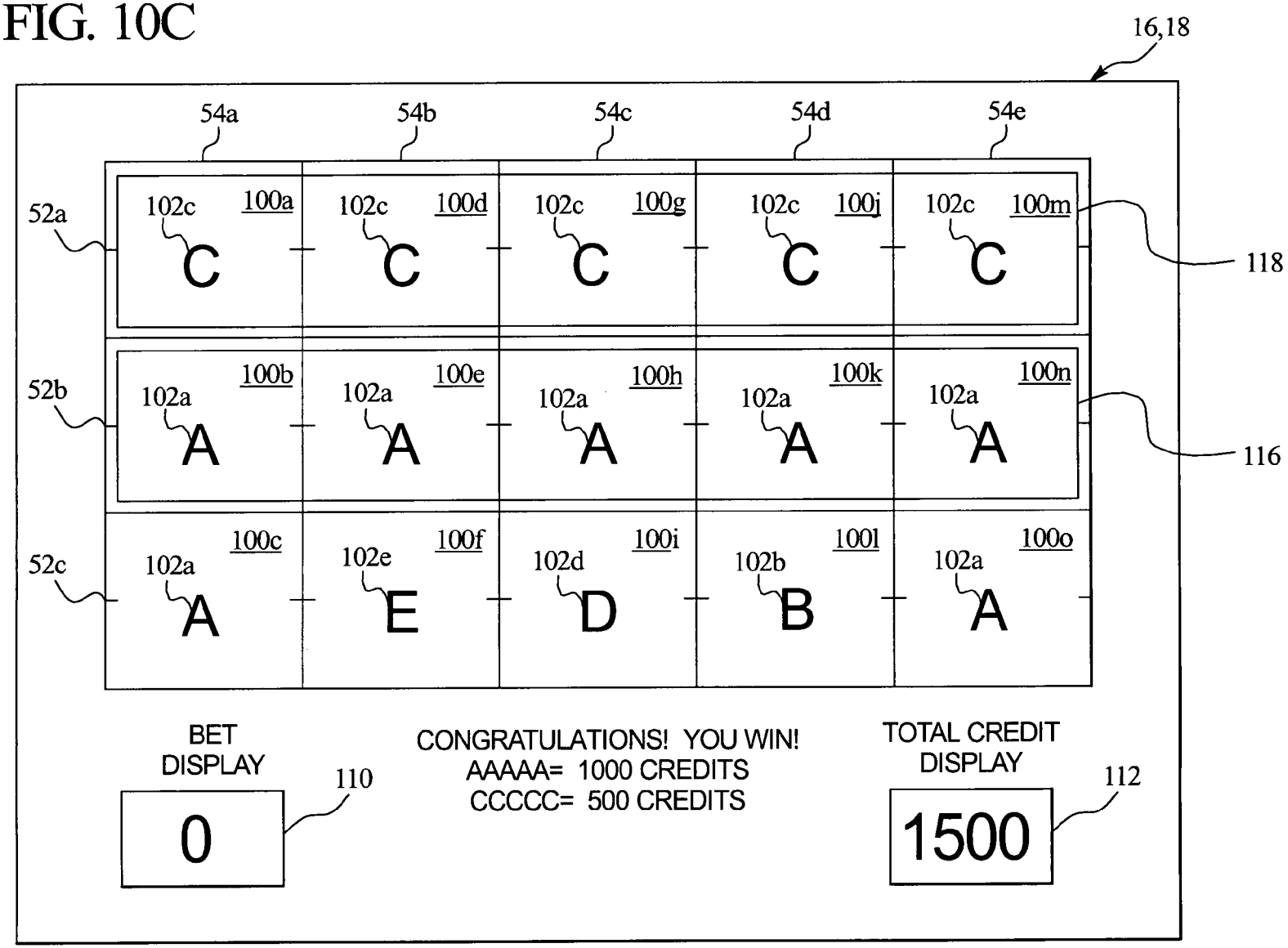

Referring now to FIGS. 10A, 10B, and 10C, in one embodiment, the symbols displayed at the predetermined triggering positions 100*e*, 100*h* and 100*k* are not locked and, therefore, are included in the rearrangement. The fixed positions 100*a*, 100*d*, 100*g*, 100*j*, 100*m*, 100*n*, 100*k*, 100*h*, 100*e*, 100*b*, 100*c*, 100*f*, 100*i*, 100*l* and 100*o* define a rearrangement path 122 which includes all the symbols on the display including the symbols displayed at the predetermined triggering positions 100*e*, 100*h* and 100*k*.

The reels illustrated in FIG. 10A are activated to generate the symbols displayed in FIG. 10B, and the amount of the wager is deducted from the bet display 110. The generation of a combination of A symbols 114 on the predetermined triggering positions 100*e*, 100*h* and 100*k* in FIG. 10B initiates the symbol swapping rearrangement of the symbols illustrated in FIGS. 10B and 10C.

In one embodiment, the rearrangement path occurs in a snake-like fashion in a horizontal direction, across rows from right to left and from left to right, in a vertical direction, up and down columns, and diagonally across the matrix or grid. FIGS. 10B and 10C illustrate an example of a specific movement sequence of the rearrangement of one embodiment of the present invention which occurs in a snake-like fashion along rearrangement path 122. Specifically, in this embodiment, each of the displayed symbols are shifted two fixed positions across a row and/or down a column to a fixed position along the rearrangement path. It should be appreciated that the rearrangement path can occur in a vertical direction, up or down columns, in a horizontal direction, from right to left or from left to right, diagonally across a matrix or grid, or any combination thereof. It should be further appreciated that the movement sequence of the rearrangement can include movement of the symbols displayed at the fixed positions in any direction along a rearrangement path through single or multiple fixed positions.

In FIG. 10B, the C symbol 102*c* in fixed position 100*a* of reel 54*a* moves across row 52*a* from left to right to the fixed position 100*g* on non-adjacent reel 54*c* as illustrated in FIG. 10C. Likewise, the C symbol 102*c* in fixed position 100*d* on reel 54*b* moves to the fixed position 100*j* on non-adjacent reel 54*d*. The C symbol 102*c* in fixed position 100*g* on reel 54*c* moves to the fixed position 100*m* on the adjacent reel 54*e*. The A symbol 102*a* in fixed position 100*j* on reel 54*d* moves across row 52*a* from left to right and down column 54*e* to the fixed position 100*n* on the adjacent reel 54*e*. The A symbol 102*a* in fixed position 100*m* on reel 54*e* moves to the fixed position 100*k* on the adjacent reel 54*d*. The A symbol 102*a* in fixed position 100*n* on reel 54*e* moves to the fixed position 100*n* on the non-adjacent reel 54*c*. The A symbol 102*a* in fixed position 100*k* on reel 54*d* moves to the fixed position 100*e* on the non-adjacent reel 54*b*. The A symbol 102*a* in fixed position 100*h* on reel 54*c* moves to the fixed position 100*b* on the non-adjacent reel 54*a*. The A symbol 102*a* in fixed position 100*e* on reel 54*b* moves to the fixed position 100*c* on the adjacent reel 54*a*. The E symbol 102*e* in fixed position 100*b* on reel 54*a* moves to the fixed position 100*f* on the adjacent reel 54*b*. The D symbol 102*d* in fixed position 100*c* on reel 54*a* moves to the fixed position 100*i* on the non-adjacent reel 54*c*. The B symbol 102*b* in fixed position 100*f* moves to the fixed position 100*l* on the non-adjacent reel 54*d*. The A symbol 102*a* in fixed position 100*i* on reel 54*c* moves to the fixed position 100*o* on the non-adjacent reel 54*e*. The C symbol 102*c* in fixed position 100*l* on reel 54*d* moves from left to right across row 52*c* and diagonally across the grid to the fixed position 100*a* on the non-adjacent reel 54*a*. Finally, the C symbol 102*c* in fixed position 100*o* on reel 54*e* moves diagonally across the grid to the fixed position 100*d* on the non-adjacent reel 54*b*. This completes a single movement sequence of a symbol swapping rearrangement along the rearrangement path 122.

Again, in one embodiment, a determination of a winning combination occurs on the modified reels after each rearrangement. In FIG. 10C, as a result of the rearrangement, a winning combination of five A symbols 116 is generated along payline 52*b*. The player is provided an award of one thousand credits corresponding to the winning embodiment 114. In one embodiment, a player is provided at least one award or outcome for any winning combination determined by the gaming device. Therefore, in the embodiment illustrated in FIG. 10C, the player is provided an additional award of five hundred credits corresponding to the winning combination of five C symbols 118 generated along payline 52*a* as indicated by the total credits display 112. It should be appreciated that subsequent rearrangements can occur even though a winning combination has been generated on the reels.

Figure 11A:
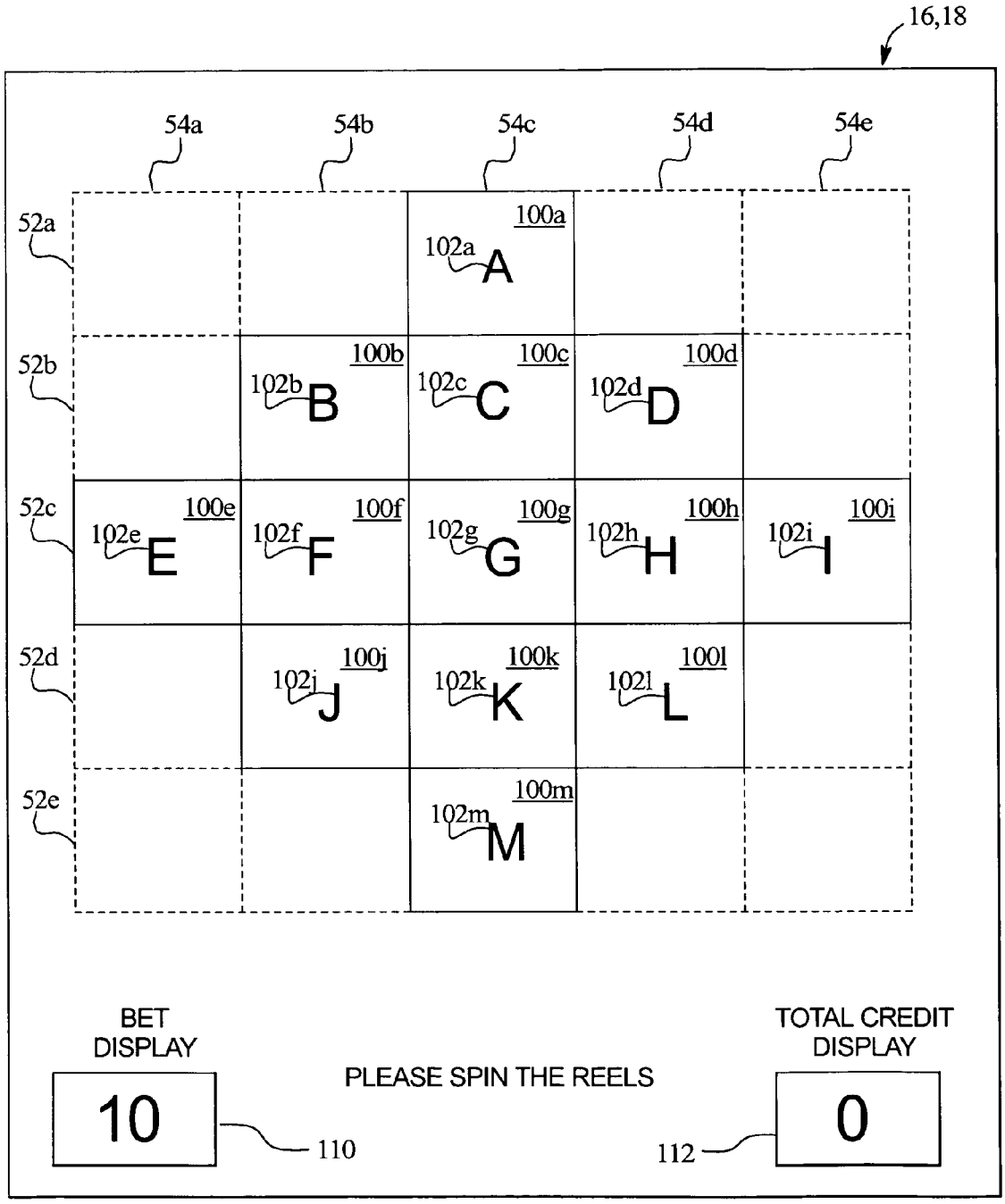
FIGS. 11A, 11B, and 11C are front perspective views of one embodiment of the present invention illustrating a rearrangement of symbols on a display having a different number of rows in each column.
Figure 11B:
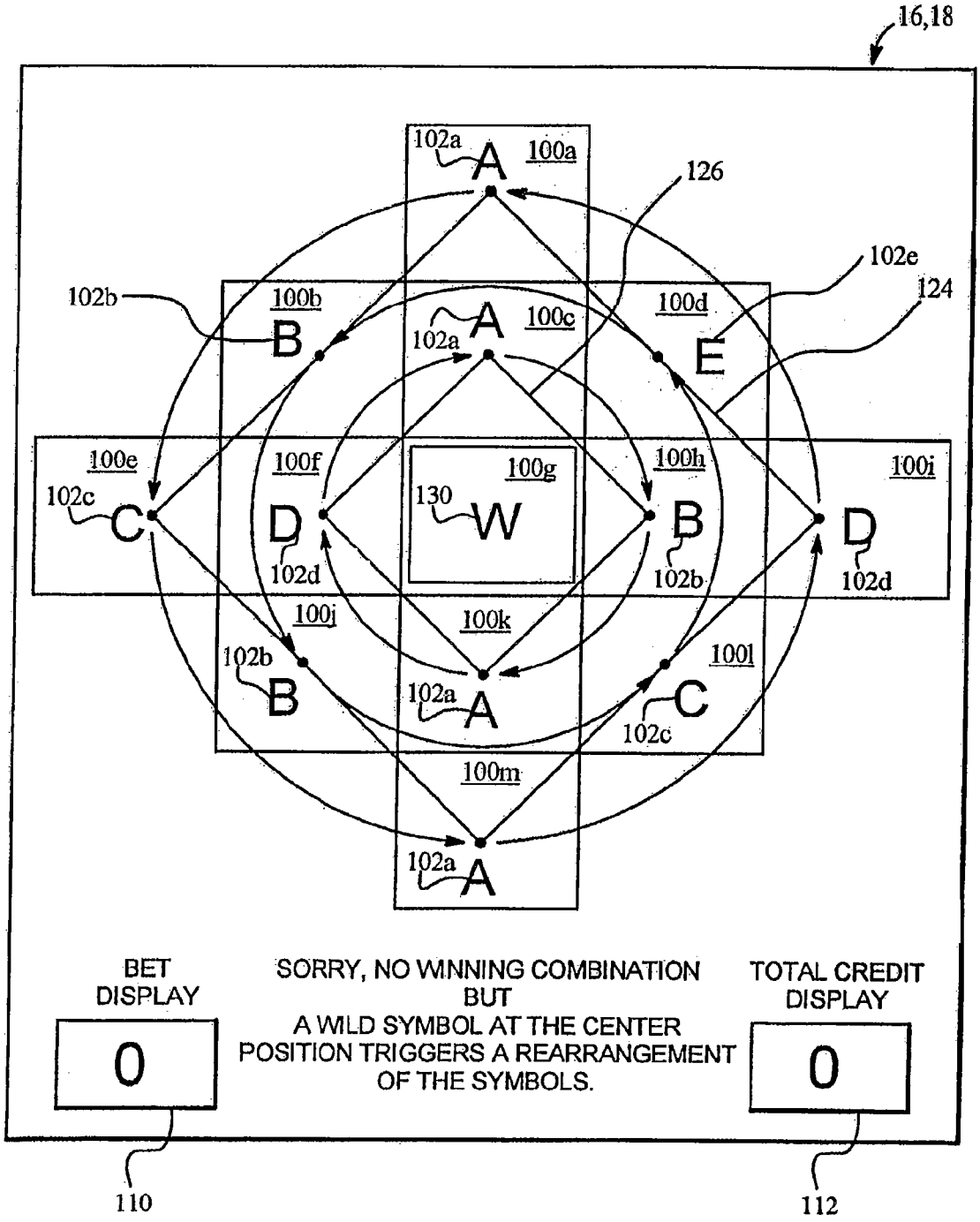
Figure 11C:
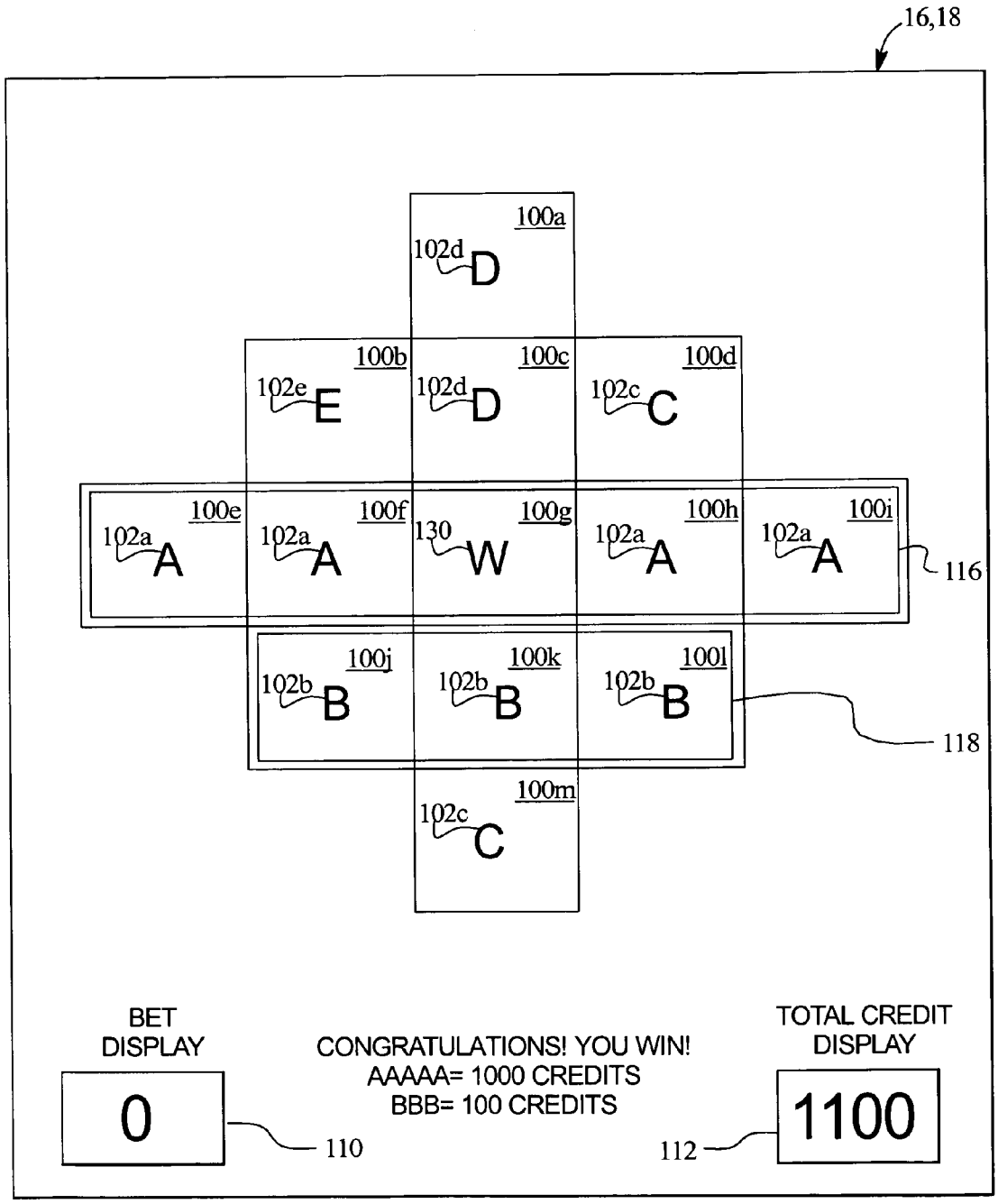

Referring to FIGS. 11A, 11B and 11C, in one embodiment of the present invention fixed positions are arranged in a pattern having different numbers of columns of fixed symbols in each row of fixed positions. It should be appreciated that each of the fixed positions can be an independent reel as described in U.S. Pat. No. 6,413,162.

In FIG. 11A, the gaming device includes five rows and five columns having a different number of columns of fixed positions in each row. For example, row one 52*a* includes one column 54*c* or one fixed position 100*a*. Row two 52*b* includes three columns 54*b*, 54*c* and 54*d* or three fixed positions 100*b*, 100*c* and 100*d*. Row three 52*c* includes five columns 54*a*, 54*b*, 54*c*, 54*d* and 54*e* or five fixed positions 100*e*, 100*f*, 100*g*, 100*h* and 100*i*. Row four 52*d* includes three columns 54*b*, 54*c* and 54*d* or three fixed positions 100*j*, 100*k* and 100*l*. Row five 52*e* includes one column 54*c* or fixed position 100*m*. It should be appreciated that each of the rows can have the same number of columns with the rearrangement paths limited to the fixed positions described above.

In one embodiment, the reels of FIG. 11A are activated and the bet display 110 indicates the number of credits wagered. FIG. 11B illustrates the initiation of a rearrangement of displayed symbols upon the generation of a rearrangement triggering symbol on the predetermined fixed position 100*g*. In this embodiment, the rearrangement triggering symbol includes a wild symbol 130. It should be appreciated that triggering a symbol swapping rearrangement can include other triggering symbols, triggering symbols generated on any fixed position, or a combination of triggering symbols generated on any combination of fixed positions or on a plurality of predetermined fixed positions. In a preferred embodiment, the predetermined fixed position includes fixed positions adjacently arranged on all sides of the fixed position. As illustrated in FIGS. 11B and 11C, the predetermined fixed position 100*g* includes fixed positions 100*c*, 100*f*, and 100*k* and 100*h* adjacently arranged on all sides of the fixed position 100*g*.

In one embodiment illustrated in FIG. 11A, two rearrangement paths are included in the game. It should be appreciated that a gaming device of the present invention can include a plurality of rearrangement paths having different movement sequences along different numbers of fixed positions. It should be further appreciated that the rearrangement paths can overlap or include fixed positions common to more than one rearrangement path. The rearrangement paths in FIG. 11A, for example, include rearrangement path 124 which is defined by eight fixed positions 100*a*, 100*b*, 100*e*, 100*j*, 100*m*, 100*l*, 100*i* and 100*d* and rearrangement path 126 which is defined by four fixed positions 100*c*, 100*h*, 100*k* and 100*f* which are different from the fixed positions defining rearrangement path 124. In one embodiment, the player is enabled to pick a rearrangement path upon which the symbols are rearranged.

Upon the triggering event, the displayed symbols on each of the fixed positions on the rearrangement paths 124 and 126 move to a fixed position other than the original fixed position.

FIG. 11A illustrates movement sequences of each of the symbols displayed at the fixed positions of rearrangement path 124 that are different from the movement sequences of each of the symbols displayed at the fixed positions of rearrangement path 126. The displayed symbols at the fixed positions of rearrangement path 124 move in a counter-clockwise direction through one fixed position to a second fixed position. In contrast, the symbols displayed at the fixed positions of rearrangement path 126 in FIG. 11A move to fixed positions in a clockwise direction. It should be appreciated that the symbol-swapping rearrangement can include multiple combinations of random or predetermined symbol movement, including different rearrangement paths having different directions of movement through different numbers of fixed positions.

FIGS. 11B and 11C illustrate an example of specific movement sequences of a rearrangement of one embodiment of the present invention which differ in the direction of movement and the number of fixed positions through which the symbols move. In the rearrangement of symbols displayed at fixed positions along rearrangement path 124, the gaming device moves the A symbol 102*a* from fixed position 100*a* in a counter-clockwise direction, skipping fixed position 100*b* along rearrangement path 124, to display the A symbol 102*a* at fixed position 100*e* as illustrated in FIG. 11C. Similarly, the B symbol 102*b* displayed at fixed position 100*b* is moved in a counter-clockwise direction to fixed position 100*j*, skipping fixed position 100*e*. The C symbol 102*c* displayed at fixed position 100*e* is moved in a counter-clockwise direction to fixed position 100*m*, skipping fixed position 100*i*. The B symbol 102*b* displayed at fixed position 100*i* is moved in a counter-clockwise direction to fixed position 100*p*, skipping fixed position 100*m*. The A symbol 102*a* displayed at fixed position 100*m* is moved in a counter-clockwise direction to fixed position 100*i*, skipping fixed position 100*l*. The C symbol 102*c* displayed at fixed position 100*l* is moved in a counter-clockwise direction to fixed position 100*d*, skipping fixed position 100*j*. The D symbol 102*d* displayed at fixed position 100*b* is moved in a counter-clockwise direction to fixed position 100*j*, skipping fixed position 100*e*. The B symbol 102*b* displayed at fixed position 100*b* is moved in a counter-clockwise direction to fixed position 100*j*, skipping fixed position 100*e*. This completes a single movement sequence of a symbol swapping rearrangement along the rearrangement path 124.

In the rearrangement of symbols displayed at fixed positions along rearrangement path 126, the A symbol 102*a* displayed at fixed position 100*c* illustrated in FIG. 11B is moved along rearrangement path 126 in a clockwise direction along rearrangement path 126 to the fixed position 100*h* illustrated in FIG. 11C. The B symbol 102*b* is moved in a clockwise direction from fixed position 100*h* to the fixed position 100*k*. The A symbol 102*a* displayed at fixed position 100*k* is moved in a clockwise direction to the fixed position 100*f*, and the D symbol 102*d* displayed at fixed position 100*f* is moved in a clockwise direction to the fixed position 100*c*. FIG. 11C illustrates the display of the symbols after the symbol-swapping rearrangement. It should be appreciated that a determination of winning combinations of symbols can be made after each rearrangement along rearrangement path 124 and along rearrangement path 126, separately or after both have occurred. In one embodiment, multiple winning combinations can occur after a single rearrangement sequence. For example, as illustrated in FIG. 11C, the four A symbols 102*a* in fixed positions 100*e*, 100*f*, 100*h* and 100*i* combine with the wild symbol to form a winning combination 116. In addition, the B symbols 102*b* in fixed positions 100*j*, 100*k* and 100*l* combine to form a winning combination 118. The gaming device in one embodiment, provides the player an award for each of the winning combinations as indicated by the total credits display 112.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. A gaming device comprising:

at least one display device; and at least one processor programmed to operate with said at least one display device to:

(a) display a plurality of symbols, each of the plurality of symbols being displayed at one of a plurality of positions, the plurality of positions including at least one designated triggering position;

(b) determine if a triggering symbol has been displayed at the at least one designated triggering position;

(c) if the triggering symbol has been displayed at the at least one designated triggering position, automatically rearrange a plurality of the symbols of the displayed plurality of symbols by sequentially moving the plurality of symbols along a predetermined rearrangement path including a plurality of the positions and displaying each of the plurality of symbols moving along the rearrangement path at at least one of the other positions along the rearrangement path, wherein the rearrangement path does not include any of the at least one designated triggering position and the plurality of symbols moving along the rearrangement path do not include the triggering symbol displayed at the at least one designated triggering position;

(d) evaluate the displayed symbols to determine an amount of an award associated with any winning combinations of the displayed symbols each time the symbols are rearranged; and (e) provide an award including a sum of said determined amounts.

2. The gaming device of claim 1, which includes a plurality of reels which include the symbols.

3. The gaming device of claim 2, wherein at least one of the reels is an independent reel and wherein each of the independent reels is operable to generate one of the plurality of the symbols.

4. The gaming device of claim 1, wherein the positions are arranged in a matrix of a plurality of rows and a plurality of columns.

5. The gaming device of claim 4, wherein at least two rows include a different number of columns.

6. The gaming device of claim 1, which includes at least one combination of triggering symbols.

7. The gaming device of claim 1, wherein a plurality of the positions are triggering positions.

8. The gaming device of claim 7, wherein the rearrangement path does not include the triggering positions.

9. The gaming device of claim 1, wherein the direction of at least one movement of the symbols along the rearrangement path is selected from the group consisting of: clockwise, counterclockwise, horizontal, vertical and diagonal.

10. The gaming device of claim 1, wherein the at least one processor is programmed to make a determination of a winning combination of displayed symbols after each symbol displayed at each of the plurality of positions associated with the rearrangement path is sequentially moved and displayed at at least one of the other positions along the rearrangement path.

11. The gaming device of claim 1, wherein, upon generating the triggering symbol, the at least one processor is programmed to operate with the at least one display device to rearrange the displayed symbols until the at least one processor determines a winning combination of displayed symbols.

12. A method of operating a gaming device, said method comprising:

(a) displaying a plurality of positions on at least one display device, the positions including at least one designated triggering position;

(b) displaying, on said at least one display device, one of a plurality of symbols at each of the plurality of displayed positions;

(c) determining, using at least one processor, if a triggering symbol has been displayed at the at least one designated triggering position;

(d) if the triggering symbol has been displayed at the at least one designated triggering position, associating a predetermined rearrangement path with a plurality of the positions using said at least one processor, wherein the rearrangement path does not include any of the at least one designated triggering position, and automatically rearranging the symbols of the plurality of symbols generated and displayed at the positions associated with the rearrangement path by sequentially moving the plurality of symbols along the rearrangement path and displaying each of the plurality of symbols moving along the rearrangement path at at least one of the other positions along the rearrangement path, wherein the plurality of symbols moving along the rearrangement path do not include the triggering symbol displayed at the at least one designated triggering position;

(e) evaluating the displayed symbols using said at least one processor to determine an amount of an award associated with any winning combinations of the displayed symbols each time the symbols are rearranged; and (f) providing an award including a sum of said determined amounts.

13. The method of claim 12, which includes generating the symbols on a plurality of reels.

14. The method of claim 12, which includes arranging the positions in a matrix including a plurality of rows and a plurality of columns.

15. The method of claim 14, wherein at least two rows include a different number of columns.

16. The method of claim 12, wherein rearranging the symbols displayed at the positions associated with the rearrangement path includes moving said symbols in a direction along the rearrangement path selected from the group consisting of: clockwise, counterclockwise, horizontal, vertical and diagonal.

17. The method of claim 12, which includes determining any winning combination of displayed symbols after each move along the rearrangement path.

18. The method of claim 17, wherein determining any winning combination of displayed symbols occurs upon moving each symbol displayed at each of the rearrangement positions to a next position along the rearrangement path.

19. The method of claim 12, which includes determining a winning combination of displayed symbols upon a predetermined number of moves of said displayed symbols.

20. The method of claim 12, which is provided through a data network.

21. The method of claim 20, wherein the data network is an internet.

22. A gaming device comprising:

at least one display device; and at least one processor programmed to operate with the at least one display device to:

(a) display a plurality of symbols, each of the plurality of symbols being displayed at one of a plurality of positions, the plurality of positions including at least one designated triggering position;

(b) determine if a triggering symbol has been generated at the at least one designated triggering position;

(c) if the triggering symbol has been generated at the at least one designated triggering position, automatically rearrange a plurality of the displayed symbols by sequentially moving the plurality of symbols along a predetermined rearrangement path including a plurality of the positions and displaying the symbols moving along the rearrangement path at at least one of the other positions along the rearrangement path, wherein the rearrangement path does not include any of the at least one designated triggering position and the plurality of symbols moving along the rearrangement path do not include the triggering symbol generated at the at least one designated triggering position;

(d) evaluate the displayed symbols to determine an amount of an award associated with any winning combinations of the displayed symbols each time the symbols are rearranged; and (e) provide an award including a sum of said determined amounts.

23. The gaming device of claim 22, which includes a plurality of reels which include the symbols.

24. The gaming device of claim 23, wherein at least one of the reels is an independent reel and wherein each of the independent reels is operable to generate one of the plurality of the symbols.

25. The gaming device of claim 22, wherein the positions are arranged in a matrix of a plurality of rows and a plurality of columns.

26. The gaming device of claim 25, wherein at least two rows include a different number of columns.

27. The gaming device of claim 22, wherein the rearrangement path is associated with a plurality of positions arranged along a perimeter of the positions displayed by said display device.

28. The gaming device of claim 22, wherein each position is associated with at least one predetermined rearrangement path.

29. The gaming device of claim 22, which includes at least one combination of triggering symbols.

30. The gaming device of claim 22, wherein a plurality of the positions are triggering positions.

31. The gaming device of claim 22, wherein, upon generating the triggering symbol, the at least one processor is programmed to provide the award for each winning combination resulting from each move of the displayed symbols.

32. The gaming device of claim 22, which includes a plurality of rearrangement paths, wherein each rearrangement path includes a predetermined number of positions and none of the rearrangement paths include the at least one designated triggering position.

33. The gaming device of claim 32, wherein at least one of the positions is included in a plurality of rearrangement paths.

34. The gaming device of claim 32, wherein the rearrangement of the symbols displayed at the positions associated with at least one rearrangement path is different from the rearrangement of the symbols displayed at the positions associated with at least one other rearrangement path.

35. The gaming device of claim 34, wherein the direction of rearrangement of the symbols displayed at the positions associated with at least one rearrangement path is different from the direction of rearrangement of the symbols displayed at the positions associated with at least one other rearrangement path.

36. The gaming device of claim 35, wherein the direction of at least one movement of the symbols along the rearrangement path is selected from the group consisting of: clockwise, counterclockwise, horizontal, vertical and diagonal.

37. The gaming device of claim 32, wherein a player is enabled to determine the rearrangement path along which the symbols displayed at the positions associated with said rearrangement path are moved.

38. The gaming device of claim 32, wherein the at least one processor is programmed to determine any winning combination of displayed symbols for each movement of displayed symbols along a rearrangement path until the displayed symbols are moved to the original positions of said rearrangement path before moving the displayed symbols associated with another rearrangement path.

39. A method of operating a gaming device, said method comprising:

(a) displaying a plurality of positions on at least one display device, the plurality of positions including at least one designated triggering position;

(b) displaying, on said at least one display device, one of a plurality of symbols at each of the plurality of positions;

(c) determining, using at least one processor, if a triggering symbol has been displayed at the at least one designated triggering position;

(d) if the triggering symbol has been displayed at the at least one designated triggering position, associating a plurality of the positions with a predetermined rearrangement path using at least one processor, and automatically rearranging the plurality of symbols displayed at the plurality of positions associated with the predetermined rearrangement path by sequentially moving the symbols along the rearrangement path and displaying each of the symbols moving along the rearrangement path at at least one of the other positions along the rearrangement path, wherein the rearrangement path does not include any of the at least one designated triggering position and the plurality of symbols moving along the rearrangement path do not include the triggering symbol displayed at the at least one designated triggering position;

(e) evaluating the displayed symbols using at least one processor to determine an amount of an award associated with any winning combinations of the displayed symbols each time the symbols are rearranged; and (f) providing an award including a sum of said determined amounts.

40. The method of claim 39, which includes generating and displaying the symbols on a plurality of reels.

41. The method of claim 39, which includes arranging the positions in a matrix including a plurality of rows and a plurality of columns.

42. The method of claim 41, wherein at least two rows include a different number of columns.

43. The method of claim 39, wherein rearranging the symbols generated in the positions associated with the rearrangement path includes moving said symbols in a direction along the rearrangement path selected from the group consisting of: clockwise, counterclockwise, horizontal, vertical and diagonal.

44. The method of claim 39, which includes determining any winning combination of displayed symbols after each move along the rearrangement path.

45. The method of claim 39, wherein determining any winning combination of displayed symbols occurs upon moving each symbol displayed at each of the rearrangement positions to a next position along the rearrangement path.

46. The method of claim 39, which includes determining a winning combination of displayed symbols upon a predetermined number of moves of said displayed symbols.

47. The method of claim 39, which includes associating a predetermined number of positions with a plurality of rearrangement paths.

48. The method of claim 47, wherein at least one of the positions is included in a plurality of rearrangement paths.

49. The method of claim 47, which includes moving the symbols displayed at positions along the rearrangement path in a different manner than the symbols displayed at positions along any other rearrangement path.

50. The method of claim 47, which includes enabling the player to determine the rearrangement path along which the symbols generated in positions along the rearrangement path are moved.

51. The method of claim 47, which includes moving the symbols generated in positions along a first rearrangement path and determining any winning combination of said symbols until the symbols are rearranged to their original positions before moving the symbols generated in positions along a second rearrangement path.

52. The method of claim 39, which is provided through a data network.

53. The method of claim 52, wherein the data network is an internet.

* * * * *

UNITED STATES PATENT AND TRADEMARK OFFICE

CERTIFICATE OF CORRECTION

PATENT NO. : 7,578,735 B2
APPLICATION NO. : 10/953599
DATED : August 25, 2009
INVENTOR(S) : Frizzell et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 494 days.

Signed and Sealed this

Seventh Day of September, 2010

David J. Kappos

David J. Kappos
*Director of the United States Patent and Trademark Office*